US006818390B2

(12) United States Patent
Cuong et al.

(10) Patent No.: US 6,818,390 B2
(45) Date of Patent: Nov. 16, 2004

(54) DEFORMABLE COLOR PHOTOGRAPHIC SILVER HALIDE MATERIAL

(75) Inventors: Ly Cuong, Köln (DE); Markus Geiger, Leverkusen (DE); Leon Vermeulen, Herenthout (BE); Arno Schmuck, Leichlingen (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 10/713,848

(22) Filed: Nov. 14, 2003

(65) Prior Publication Data

US 2004/0106076 A1 Jun. 3, 2004

Related U.S. Application Data

(60) Provisional application No. 60/429,594, filed on Nov. 27, 2002.

(30) Foreign Application Priority Data

Nov. 15, 2002 (EP) ..... 02102599

(51) Int. Cl.[7] ..... G03C 1/46

(52) U.S. Cl. ..... 430/503; 430/567; 430/502; 430/523; 430/613; 430/614; 430/581; 430/583

(58) Field of Search ..... 430/502, 503, 430/523, 567, 613, 614, 581, 583

(56) References Cited

U.S. PATENT DOCUMENTS

| | | | | |
|---|---|---|---|---|
| 2003/0064331 | A1 | 4/2003 | Ly et al. | |
| 2004/0106075 | A1 * | 6/2004 | Cuong et al. | 430/503 |

FOREIGN PATENT DOCUMENTS

| | | |
|---|---|---|
| DE | 100 55 094 | 5/2002 |
| EP | 0 270 078 | 6/1988 |
| EP | 0 490 416 | 6/1992 |
| EP | 1 089 125 | 4/2001 |
| GB | 739477 | 10/1955 |
| GB | 2 321 977 | 8/1998 |
| JP | 2271980 | 11/1990 |
| JP | 05-045799 | 2/1993 |

* cited by examiner

*Primary Examiner*—Geraldine Letscher
(74) *Attorney, Agent, or Firm*—Connolly Bove Lodge & Hutz LLP

(57) ABSTRACT

A deformable color photographic silver halide material, said color photographic silver halide material comprising on a deformable plastic support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler can be deformed without loss in image quality and is suitable for large formats and automatic processing.

19 Claims, No Drawings

DEFORMABLE COLOR PHOTOGRAPHIC SILVER HALIDE MATERIAL

CROSS-REFERENCE TO RELATED PATENT APPLICATIONS

This application claims the benefit of U.S. Provisional Application No. 60/429,594 filed Nov. 27, 2002, which is incorporated by reference. In addition, this application claims the benefit of European Application No. 02102599.4 filed Nov. 15, 2002, which is also incorporated by reference.

FIELD OF THE INVENTION

The present invention relates to a deformable material for producing a deformed image without significant image degradation and is suitable for large formats and automatic processing.

BACKGROUND OF THE INVENTION.

Deformable materials with colour and/or black and white motives, particularly those made of plastic, are used e.g. as protective and/or decorative foils particularly in the furniture industry, in which they are used as design elements to cover low-priced and/or light weight carrier materials and/or carrier materials that are critical to the conditions of their use; the configuration of deformable material and carrier material replacing much more expensive and/or heavier and/or less easier to handle and/or less resistant materials such as real wood, stainless steel or marble.

The manufacture of deformed plastic pieces with any kind of representations like images, designs, patterns, letters and so forth, usually proceeds by printing on an undeformed flat foil of a thermoplastic polymer and is then deformed using heat and pressure.

The results obtained are unsatisfactory, because the printed pieces after deformation exhibit a loss in image quality, that is visible at all parts where the deformation has led to an elongation of the deformed material. In particular a significant loss in image quality is observed after deformation at curved parts and still more so at sharp edges, which is particularly noticeable as a bright line and/or increased granularity following the curves and/or edges in homogeneously coloured dark areas, which is unacceptable, particularly in the case of decorated furniture. Furthermore, the printing processes require complicated prepress steps and are therefore expensive and are not suitable for the manufacture of individual designs with small production runs.

Photographic layers, which were laminated onto a support, have, for example, been disclosed in EP-A 0 250 657, U.S. Pat. No. 3,871,119, EP-A 0 490 416 and EP-A 0 276 506 for the manufacture of materials for identity cards and in EP-A 1 189 108 have been disclosed for materials with a broader colour gamut. The layers can subsequently be covered with a protective foil, as disclosed, for example, in U.S. Pat. No. 4,370,397 and GB 2,121,812.

The disclosed ID-cards are all flat, so that there are no requirements regarding deformability and their suitability or otherwise therefor was not disclosed.

Furthermore, as laminatable photographic layers those with special binders have been disclosed, although neither of these options produces an optimum image quality. In particular the graininess realized with state of the art laminatable materials is unacceptably high. The DTR materials that are also known to be laminatable, are not suitable for the furniture industry, because the two-sheet process has not been adapted to the large format automated processing needed in this field.

Representations like images, designs, patterns, letters and so forth, of the highest quality can be realized with colour photographic materials, comprising on a support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler. As a support for reflective material, paper coated on both sides with polyethylene and for transparent materials longitudinally and laterally stretched polyester is usually used. The deformation according to the present invention of such colour photographic materials is not possible.

The deformability of special photographic materials consisting of a support, an optional adhesive layer and a black and white silver halide emulsion photographic layer with special binders was disclosed in FR 968 638 and GB 739,477. According to FR 968 638 gelatin cannot be used as a binder, because cracking occurred upon bending.

The known deformable photographic materials as disclosed in FR 968 638 and GB 739 477 did not fulfil the present quality requirements for photographically produced images and the bending behaviour was unsatisfactory.

GB 2,321,977 and the corresponding W098/35269 disclose a mouldable photographic material comprising a thermoplastic base sheet, a primer layer providing a key for a light sensitive layer, and a protective thermoplastic foil, the foil being bonded to the light sensitive layer with an optical quality adhesive.

Furthermore, no deformable photographic materials are known, which are satisfactory for both a long exposure and for a digital exposure, such as, for example, required in the furniture industry, to enable the exposure of large formats. Analogue long exposures are desirable so that inexpensive exposure configurations can be used, but digital exposure is being increasingly required, because it is much faster and because rolls of film are much easier to expose continuously. Furthermore, different designs can be much more easily realized in production, since no film is necessary as an intermediate step. Nowadays new designs are usually produced by computer and can be directly used in digital exposure to realize optimal image quality.

Digital exposure proceeds pixel-wise, line-wise or area-wise with high intensity strongly focussed beam of light beam e.g. from lasers, light emitting diodes (LED), DMD (digital micromirror devices) apparatuses, cathode ray tubes and such like and with short to very short exposure times per pixel. A pixel is the smallest image area on the copying material, which can be addressed by the exposure apparatus. Conventional silver halide emulsions exhibit a too low sensitivity, due to an unsatisfactory reciprocity, which results in a too low contrast and insufficient maximum density at such short exposure times.

A similar reciprocity failure is also observed at exposure times above 10 s (long exposure times), which are necessary for analogue exposure of large formats.

OBJECTS OF THE INVENTION

It is therefore an object of the present invention to provide a deformable colour photographic material, which enables high quality representations like images, designs, patterns, letters and so forth to be realized, which undergo the desired deformation by heat and/or pressure without significant visible loss in image quality. A further advantage of the present invention compared to printing processes is the possibility to produce even single pieces as a proof or demonstration example.

Further aspects and advantages of the invention will become apparent from the description hereinafter.

SUMMARY OF THE INVENTION

It has been surprisingly found, that the deformable colour photographic recording material of the present invention is suitable for digital exposure and gives high quality images, said colour photographic silver halide material comprising on a deformable plastic support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler.

Surprisingly it has been found, at variance with the disclosure in FR 968 638, that gelatin can be successfully used in the materials used in the process according to the present invention. The reason why the use of gelatin failed according to FR 968 638, but surprisingly was very successful for the present invention, may be the difference between single layer black and white materials like those described in FR 968 638, that essentially only contain silver halide crystals dispersed in the binder, and multilayer colour photographic materials according to the present invention, that also comprise softer materials like couplers in their layers.

Aspects of the present invention are realized with a deformable colour photographic silver halide material, the colour photographic silver halide material comprising on a deformable plastic support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler.

Aspects of the present invention are also realized with a process for producing a deformed image comprising the steps of: exposing the above-mentioned colour photographic silver halide material; conventionally processing the exposed colour photographic material to produce an image; and deforming the colour photographic material.

DETAILED DESCRIPTION OF THE INVENTION

Definitions

The term deformation (also known as moulding) used in disclosing the present invention refers to three-dimensional deformation in which an initially flat object e.g. a plate or a sheet is deformed to a three dimensional shape using a shaping tool to which pressure and/or heat is applied, in the course of which at least a part of the initially flat object is elongated (stretched), the shape being maintained upon cooling and/or upon releasing the pressure. The out-of-plane deformation is usually of a greater measure than the thickness of the initially flat object, the thickness being defined as the distance between the surface to which the tool is applied and the opposite surface of the initially flat object. The term deformable as used in qualifying colour photographic silver halide material is the ability to undergo deformation as defined above.

The term to deform means the process of deformation.

The term deformable plastic as used in disclosing the present invention includes all polymers, which can be deformed, without fracturing, exhibiting cracks or thermally decomposing. The term deformable plastic includes all polymers, that are available in foil form and that are not stretched.

The term conventional processing as used in disclosing the present invention means chromogenic chemical colour processing as used for the processing of conventional photographic materials such as color papers, color films or display materials and is further specified in the following description.

The terms immediate and fast hardeners mean that the hardener is capable of hardening gelatin immediately after coating or at least several days after coating to such an extent that no further changes in sensitometry and swelling behaviour due to the presence of hardener occur. By swelling is meant the difference between wet layer thickness and dry layer thickness upon aqueous processing of the material.

The term silver nitrate (equivalent to AgX present) is used in the examples to characterize the silver halide emulsions means the weight of silver nitrate in a given amount of silver halide emulsion that results when the quantity of silver halide in the emulsion is hypothetically converted into the equivalent weight of silver nitrate.

Process for Producing a Deformed Image

Aspects of the present invention are realized with a process for producing a deformed image comprising the steps of: exposing the colour photographic silver halide material, according to the present invention; conventionally processing the exposed colour photographic material to produce an image; and deforming the colour photographic material.

There are commonly used apparatus available for exposure and conventional processing of the photographic material of the present inventions that are able to process long and wide sheets as well as wide rolls of the material as are needed e.g. in the furniture industry.

Exposure preferably is carried out digitally and proceeds preferably from the side remote from the support, but in the case of a transparent or slightly coloured support exposure can also be carried out through the support if a loss in sharpness is tolerable.

To avoid light scattering and resulting loss in sharpness in the case of a transparent or translucent support, it is preferred to place a dark sheet in contact with the side of the material remote from the light source upon exposure. The same effect can be achieved when the material comprises an antihalation layer, that is bleached during the chemical processing of the material. Suitable absorbing material for said antihalation layer is described in Research Disclosure 38 957, 1996, VIII., from page 610, herein incorporated by reference. The antihalation layer has to be arranged on the side of the emulsion layers remote from the light source.

In a preferred embodiment of the invention the support is provided on the image side between the silver halide layers and the support with a layer reflecting white light and on the opposite side with a non-bleachable black antihalation layer as described in U.S. Pat. No. 4,224,402, herein incorporated by reference.

After image-wise exposure the colour photographic material is appropriately processed. Details of processing and the chemicals required therefor together with exemplary colour photographic materials are to be found in Research Disclosure 37254, part 10 (1995) page 294 and in Research Disclosure 37038, parts XVI to XXIII (1995), from page 95, herein incorporated by reference.

Conventional processing of the colour photographic material comprises the steps of chromogenic development, bleaching and fixing and for colour reversal materials in addition a reversal step and a black and white development. The bleaching and fixing steps can be carried out within one bleach/fixing step. Processes and the compounds especially suitable for the process of the present invention are commonly known in the art and described e.g. in Ullmann's Encyclopedia of Industrial Chemistry, $5^{th}$ edition, Vol. A20, p 68 to 98, herein incorporated by reference, in particular the color negative paper processes such as EP-2 (Eastman Kodak) and AP 92 (Agfa) for silver bromide chloride emulsions and RA-4 (Eastman Kodak) and AP 94 (Agfa) processes for predominantly silver chloride emulsions.

In another preferred embodiment of the process, according to the present invention, the conventional processing of the colour photographic material is carried out with development times between 15 and 130 s. Longer development times are necessary, if, for example, silver-rich materials are processed in order to attain a particularly high colour density.

Deformable Plastic Support

Deformable plastics are those which can be deformed, without fracturing, exhibiting cracks or thermally decomposing. All polymers, that are available in foil form and that are not stretched fall under the term deformable plastics.

A good reference point for the temperature necessary for deformation is the glass transition temperature (Tg). Deformation is usually done between the glass transition temperature and the melting point of the deformable plastic. The pressure needed for deformation can easily be tested; the higher the deformation temperature is with respect to the glass transition temperature, the lower the pressure needed. Just below the melting point only a very low pressure is needed. The time needed for the deformation can also be easily tested and adjusted. A higher temperature and/or a higher pressure results in a shorter time.

Suitable support materials, e.g. foils, films or sheets, are preferably taken from the group of plastics knows as thermoplastics and include poly(vinylchloride) (PVC), polycarbonate (PC), non-oriented polyester, acrylonitrile-butadiene-styrene (ABS), polyolefin, copolymers and mixtures of said polymers. Suitable copolymers include vinylchloride copolymer, in particular ABS copolymerized with vinylchloride and polyolefin copolymer.

According to a preferred embodiment of the deformable colour photographic silver halide material, according to the present invention, deformable plastic support is a polycarbonate, poly(vinylchloride), vinylchloride copolymer or a polyester; or a copolyester based on PET.

Suitable polycarbonates for use in the colour photographic material of the present invention, contain repeating units represented by the formula:

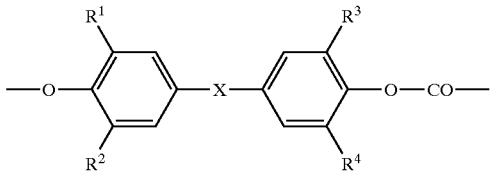

wherein X represents —S—, —$SO_2$—, —C($R_5$, $R_6$)— or —C[=C($R_7$,$R_8$)]—; $R_1$, $R_2$, $R_3$, $R_4$, $R_7$ and $R_8$ independently represent a hydrogen atom, or an alkyl- or aryl-group; and $R_5$ and $R_6$ independently represent a hydrogen atom or an alkyl- or aryl-group or together represent the atoms necessary to form a cycloaliphatic ring, e.g. a cyclohexane ring. The polycarbonates preferably have weight averaged molecular weights between 10,000 and 500,000. Polycarbonates based on bisphenol A are particularly preferred.

Poly(vinylchloride) for use in the colour photographic material of the present invention, preferably contain at least 50% by weight vinylchloride units and optionally contain further hydrophobic units. Preferred comonomers are vinylidene chloride, vinyl acetate, acrylonitrile, styrene, butadiene, chloroprene, dichlorobutadiene, vinyl fluoride, vinylidene fluoride and trifluroethylene. The poly (vinylchloride) preferably contains 60 to 65% by weight of chlorine. A PVC support used in the colour photographic material of the present invention, can contain plasticizers, but for ecological reasons and for reasons of stability of the photographic material preferably contains no plasticizers. Furthermore, the PVC can contain stabilizers and antioxidants with inorganic heavy metal salts, metal soaps (particularly of Ba, Cd, Pb, Zn and Ca), dibutyl and dioctyl tin compounds and epoxidized soya oil. Further optional ingredients of PVC include lubricants, impact modifier, process aids, fillers, fire retardants, smoke repressants, blowing agents, colourants, antistatic agents, viscosity modifier, biostabilizers and UV absorber.

Suitable polyesters include condensation products of aromatic, aliphatic or cycloaliphatic dicarboxylic acids with aliphatic or alicyclic glycols, whereby the dicarboxylic acids have preferably 4 to 20 C-atoms and the glycols preferably 2 to 24 C-atoms. The polyesters can also be modified by adding small quantities of other monomers. Preferred polyesters are poly(ethylene terephthalate) (PET) or copolyesters based on PET (CoPET) like the preferred CoPET Eastar PETG Copolyester 6763 delivered by Eastman (PETG). However, stretched (oriented) polyesters are unsuitable, because they form micro-cracks upon deformation.

Suitable polyolefins include polypropylene, polyethylene and polymethylpentene either individually or as mixtures. Preferred polyolefins include copolymers of propylene and/or ethylene with hexene and/or butene and/or octene.

Preferred deformable plastics for deformable colour photographic materials, according to the present invention, are PVC, vinylchloride copolymer and PC, because they bend well and the photographic layer is particularly little affected. PC is particularly preferred due to its high tensile strength and ensures a good storage stability.

The support can be a single layer foil, but can also consist of a compound arrangement of several plastic foils. All plastic foils must be of a deformable plastic. The thickness of the support is preferably between 0.05 and 0.75 mm.

The support can be coated with one or several layers to provide the support with e.g. a colour layer or an adhesive layer.

Depending upon the desired effect, the support can be white, transparent, translucent or coloured with dyes or pigments and may also have structure or roughness on either or both sides. Structure or roughness in the foil is preferably realized during its manufacture.

The support may contain pigments or other colorants. An opaque, white colour can be realized by coextrusion of white pigments such as titanium dioxide. Suitable colorants include dyes such as Ultramarine Blue.

To improve the adhesion of hydrophilic layers of colour photographic materials on hydrophobic supports, it is preferred to pretreat the support with a hydrophilizing process, for example corona (air ionization at about 10 to 20 kV)

treatment. Furthermore, a subbing layer between the support and the layer of the layer configuration of the colour photographic material closest to the support is also preferred.

In a preferred embodiment of the deformable colour photographic silver halide material, according to the present invention, the deformable colour photographic material further contains a subbing layer containing 1.3 to 80% by weight of a proteinaceous colloid, 0 to 85% by weight of colloidal silica and 0 to 30% by weight of a siloxane, which can form a reaction product with the colloidal silica. In a further preferred embodiment of the deformable colour photographic silver halide material, according to the present invention, the deformable colour photographic material, further contains a subbing layer on the same side of the support as the silver halide emulsion layers. Particularly preferred is a subbing layer that further contains 1.0 to 70% by weight of an ionogenic polyester-polyurethane, which is coated from an aqueous dispersion, in which isocyanate groups in its structure have reacted with an ionomer compound, which contains at least one active hydrogen atom and a carboxylate or sulphonate salt group, and in which the number of salt groups is sufficiently high to render the polyester-polyurethane dispersible in an aqueous medium. Preferred proteinaceous colloids are gelatin and casein, with gelatin being particularly preferred.

Suitable anionic polyester-polyurethanes are disclosed in U.S. Pat. No. 3,397,989, U.S. Pat. No. 4,388,403 and DE-OS 3 630 045, herein incorporated by reference, with those with carboxylate and sulphonate groups, such as disclosed in U.S. Pat. No. 3,397,989, being particularly preferred. The polyester-polyurethanes preferably contain a linear polyester with OH-end groups and a molecular weight between 300 and 2,000. The polyester-polyurethanes are preferably employed as an aqueous dispersion, with a particularly preferred dispersion containing the reaction products of the following components with respect to the end dispersion: 23% by weight of a polyester based on adipic acid and hexandiol with an average molecular weight of 840, 14% by weight 4,4'-diisocyanatodicyclohexylmethane, 2% by weight dimethylolpropionic acid and 1.5% by weight of trimethylamin, with the composition further containing 7.5% by weight N-Methyl-pyrrolidon and 52% by weight water. Said particularly preferred dispersion is called hereinafter dispersion (D-1).

Suitable polyester-polyurethane dispersions include Dispercoll® products from BAYER.

Suitable colloidal silica's include products marketed under the trade names LUDOX® (Du Pont), SYTON® (Du Pont) and KIESELSOLE® (Bayer). Their average particle size is preferably between 5 and 100 nm.

Suitable siloxanes are represented by the formula:

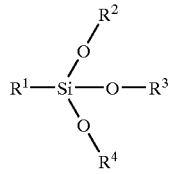

in which $R^1$ represents a polymerizable group or has a OH— and/or $NH_2$— group which can react with the protein-containing colloid, particularly a group which contains a reactive halogen, an epoxy group or an α, β-ethylenically unsaturated group. Examples of $R^1$ are: $ClCH_2CONH$-A-; $BrCH_2CONH$-A-; $CH_2{=}CH(CH_3)COO$-A-; $CH_2{=}CHSO_2CH_2OCH_2SO_2NH$-A-; $CH_2{=}CHCONH$-A-; $CH_2{=}C(CH_3)CONH$-A-;

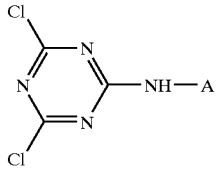

in which A represents an alkylene group, or

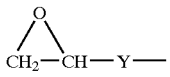

and in which Y represents a bivalent hydrocarbon chain, which can be interrupted by oxygen. $R^2$, $R^3$ and $R^4$ independently represent an optionally substituted hydrocarbon group such as methyl or ethyl.

Suitable siloxane compounds include:

SL-1

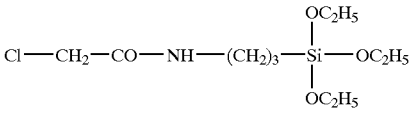

SL-2

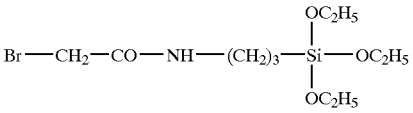

SL-3

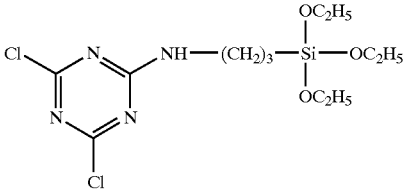

SL-4

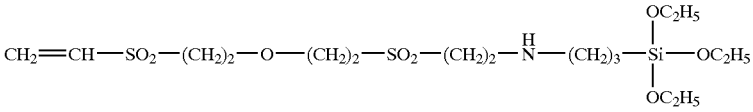

-continued

SL-5

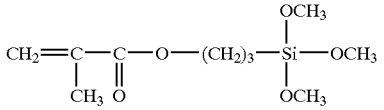

SL-6

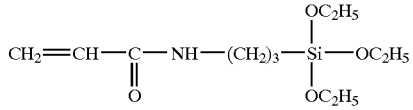

SL-7

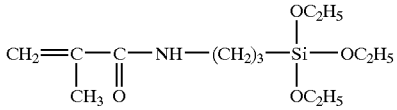

SL-8

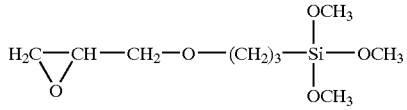

The adhesion of the subbing layer to the support can be improved by corona-pretreatment of the support. A surfactant (wetting agent)can be added to the subbing layer coating composition to improve the wetting of the subbing layer.

Suitable wetting agents include those containing saponines and products marketed under the trade names TERGITOL® (supplied by Union Carbide Corp. and Niacet Corp.) or Manoxol® (supplied by e.g. Rohm and Haas).

In respect of support materials and subbing layers EP-A 0 276 506 and EP-A 490 416 are herein incorporated by reference.

In a further preferred embodiment of the deformable colour photographic silver halide material, according to the present invention, the deformable plastic support is laminatable e.g. by coating the backside of the support with an adhesive layer suitable for pressure and/or heat adhesion processes. Such pressure sensitive adhesive layers are preferably covered with a protective foil. The adhesive layer, with or without protective foil, can be applied to the support at any time before lamination, thus even before the coating of the support with light-sensitive layers. It is preferred to apply the adhesive layer after processing the colour photographic material.

Provision of a Protective Foil on the Image Side of the Support

In a preferred embodiment of the deformable colour photographic silver halide material, according to the present invention, the outermost on the image side of the deformable colour photographic material is provided with a protective foil, preferably via an adhesive layer, which, for example, protects the image from scratching and environmental effects due to oxygen, UV-light and water. The protective foil provided on the image side of the support preferably comprises homopolymers such as PVC, PC, a polyalkylene or a polyester like PET or CoPET, in particular PVC. The protective foil can also comprise block copolymers with polymer subunits that are preferably selected from the aforementioned homopolymers; mixed copolymers obtained by mixed polymerization of at least two monomers, in particular of at least two different vinyl monomers such as a vinylchloride, an alkylene or a styrene; or blends of at least two polymers selected from the aforementioned homopolymers and/or block copolymers and/or mixed copolymers.

In a preferred embodiment of the present invention, the adhesive layer is a polyalkylene foil (adhesive foil), in particular a polyethylene foil, that can be laminated in direct contact to the protective foil or that is adhered to the protective foil using a glue layer.

Preferably the protective foil and/or the adhesive layer and/or the glue layer if present contain a UV-absorber such as hydroxybenzophenone or hydroxybenzotriazole. Preferred UV-absorber are those known under the trade name Tinuvin and are delivered by Ciba-Geigy. Suitable protective foils, adhesives and glues include those disclosed in EP-A 0 348 310, U.S. Pat. No. 4,456,667, U.S. Pat. No. 4,455,359, U.S. Pat. No. 4,378,392, U.S. Pat. No. 4,370,397, U.S. Pat. No. 3,871,119 and GB-A 2,321,977 herein incorporated by reference. The protective foil can consist of a single polymer composition or can be a mixture or a laminate of the same or different polymers, taken from the group of PVC, PC, PET, CoPET or a polyalkylene. It is preferred, that at least one of the polymers used for the protective foil is of the same plastic material that is used for the support.

In a preferred embodiment of the protective foil used for the material, according to the present invention, the protective foil has a $T_g$ that is similar to the $T_g$ of the deformable plastic support. Particularly preferred adhesive foils of polyethylene have a melting point of ca. 90 to 100° C.

In a further preferred embodiment of the protective foil used for the material, according to the present invention, the protective foil can be coloured and/or printed with any kind of design, image or text.

The sandwich of protective foil, optionally a glue layer and the adhesive layer is preferably laminated to the image side of the photographic material using a roller laminator.

According to a preferred embodiment of the process, according to the present invention, the deformable colour photographic silver halide material is provided with a protective foil before deforming the colour photographic material with a work piece.

Deformation of the Colour Photographic Material

The deformation of the colour photographic material is usually carried out after conventional processing of the exposed colour photographic material, but can also be performed before processing and even before exposure. However, it is preferred to carry out the deformation after conventional processing of the exposed colour photographic material.

According to a preferred embodiment of the process, according to the present invention, the deforming step comprising the application of heat and pressure and wherein at least part of the deformable colour photographic material is elongated during the process. The tool used in the deformation step can, for example, be a mould into which the heated plastic is sucked, blown or pressed. In the furniture industry, for example, the piece of furniture to which the colour photographic material is to be applied, can itself be the shaping tool. In this case the shaping tool is termed the "work piece". The colour photographic material is thereby pressed onto the piece of furniture (the work piece), for example with the aid of a membrane press, and thereby intimately attached to the piece of furniture. In this process the work piece covered with the photographic material is pressed onto an elastic membrane (usually made of rubber) which itself is placed on top of a tank completely filled with hot water of about 95° C. or filled with hot oil to enable the process, according to the present invention, to be carried out at higher temperatures.

According to a preferred embodiment of the process, according to the present invention, the deforming step comprises deforming the deformable colour photographic material by vacuum deformation.

Adhesion of the deformed colour photographic material to the piece of furniture is preferably supplemented with an adhesive. In the case of very soft materials deformable at room temperature (25° C.) a pressure adhesive is sufficient (e.g. a contact adhesive). The piece of furniture, e.g. a piece of chipwood, has only been taken as an example. The deformable colour photographic material, according to the present invention, can easily been used in other technical areas, e.g. the automotive industry, by just replacing the work piece and using adhesives that are known to work for the material the work piece is made of.

According to a preferred embodiment of the process, according to Is the present invention, the deforming step comprises deforming the deformable colour photographic material by injection moulding, wherein the photographic material is placed in a die mould and the injected plastic material deforms the deformable colour photographic material and forms a single entity with the deformable colour photographic material.

In a preferred embodiment of the process, according to the present invention, the deforming step comprises deforming the deformable colour photographic material in contact with a work piece. Usually the support side of the deformable colour photographic material is applied to the work piece e.g. a piece of furniture. In this case it is preferable that the image side of the processed colour photographic material is provided with a transparent protective foil as described above just before the deformation step so as to prevent damage during the deformation step.

If the support is clear or at least transparent and not too strongly coloured, the silver halide emulsion-side of the deformable colour photographic material can be applied to the work piece. In such cases, in addition to the usual cold and hot-melt adhesives, a gelatin solution containing a gelatin-hardening agent can also be used as an adhesive. Instead of adhering the silver halide emulsion-side directly to the work piece, a preferably reflective, e.g. white or opaque protective foil can be placed in between the silver halide emulsion side of the colour photographic material and the work piece.

In a preferred embodiment of the present invention, the adhesion of the deformed photographic material to the work piece is further improved, particularly at the corners and edges of the work piece and where the deformed material ends, e. g. at the corners and the edges on the back side of a piece of furniture. This can be carried out by pretreatment of the work piece, particularly at the corners and edges, with a glue before the deformation; or processing the work piece coated with the deformable photographic material with a hot-knife and/or applying glue after deformation and if necessary after having cut-off surplus photographic material to seal the corners and edges and to prevent peeling of the deformed material.

Colour Photographic Material

In a preferred embodiment of the deformable colour photographic silver halide material, according to the present invention, a colour photographic silver halide material is provided able to undergo deformation without significant image degradation, the colour photographic silver halide material comprising on a deformable plastic support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler.

In a further preferred embodiment of the deformable colour photographic silver halide material, according to the present invention, the silver halide emulsions have an overall silver chloride content of at least 70 mol % to enable short development times, a silver chloride content of at least 98 mol % being particularly preferred. Silver halide emulsions which are substantially free from silver iodide are preferred, emulsions with less than 1 mol % iodide and in particular emulsions with less than 0.1 mol % iodide being particularly preferred.

At least one silver halide emulsion used in the material, according to the present invention, preferably contains silver halide crystals that are doped with at least one dopant. It is particularly preferred, that at least one blue-, at least one green- and at least one red-sensitive silver halide emulsion layer in each case comprises at least one silver halide emulsion whose silver halide crystals are doped with at least one dopant. Suitable dopants and processes for their addition are to be found in Research Disclosure 37038, parts XV-B (1995), from page 90 herein incorporated by reference. For silver halide crystals with a high silver chloride content the preferred dopants are Ir-, Rh- and Hg-salts.

The silver halide emulsions used in the colour photographic material of the present invention, are preferably prepared by a simple double jet process, a double jet process with separate preprecipitation (formation of crystal nuclei) and precipitation thereon or a combined double jet recrystallization process.

At least one silver halide emulsion preferably contains silver halide crystals with at least two different zones (structured crystals), in which the outermost zone has a higher molar content of silver bromide than the rest of the crystal. The nucleus of the structured crystals is preferably prepared by a double jet process with a silver nitrate solution and a halide solution, predominantly chloride, and precipitation thereon preferably occurs by recrystallization of a fine-grained silver bromide-chloride emulsion (Lippmann emulsion) with a molar silver bromide content of at least 5 percent.

According to a preferred embodiment of the deformable colour photographic silver halide material, according to the present invention, at least one silver halide emulsion contains structured crystals with a silver chloride content of at least 70 mol % and with at least two different zones, the outermost zone having a higher molar content of silver bromide than the rest of the crystal.

According to another preferred embodiment of the deformable colour photographic silver halide material, according to the present invention, at least one blue-, at least one green- and at least one red-sensitive silver halide emulsion layer in each case comprises at least one silver halide emulsion which contains the structured crystals.

According to another preferred embodiment of the deformable colour photographic silver halide material, according to the present invention, the green-sensitive silver halide emulsion layer and/or the red-sensitive silver halide emulsion layer contains at least one silver halide emulsion with silver halide crystals having an average grain size (volume averaged, diameter of a sphere with an equivalent volume) of at least 0.40 $\mu$m.

According to another preferred embodiment of the deformable colour photographic silver halide material, according to the present invention, the silver halide emulsions contain one or more binders, with the binders being at least 80% by weight of gelatin being particularly preferred.

In a preferred embodiment of the colour photographic material, according to the present invention, yellow couplers, purple couplers and blue-green couplers represented by formulae (IV), (V), (VI), (XIV), (VII) and (VIII) are used.

Yellow Coupler:

(IV)

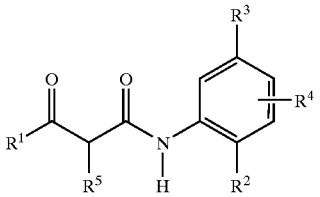

wherein $R^1$ represents alkyl, alkoxy, aryl or hetero-aryl groups, $R^2$ represents alkoxy or aryloxy groups or halogen, $R^3$ represents $—CO_2R^6$, $—CONR^6R^7$, $—NHCO_2R^6$, $—NHSO_2R^6$, $—SO_2NR^6R^7$, $—SO_2NHCOR^6$, $—NHCOR^6$ groups, Cl $R^4$ represents hydrogen or a substituent, $R^5$ represents hydrogen or a group which can be split off during coupling, $R^6$, $R^7$ independently represent hydrogen or alkyl or aryl groups and one of the $R^2$, $R^3$ and $R_4$ group is a ballast group.

Magenta Coupler:

(V)

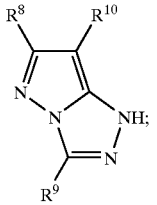

(VI)

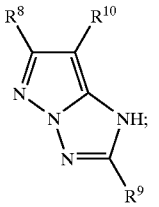

wherein $R^8$ and $R^9$ independently represent hydrogen or alkyl, aralkyl, aryl, aryloxy, alkylthio, arylthio, amino, anilino, acylamino, cyano, alkoxycarbonyl, alkylcarbamoyl or alkylsulfamoyl groups, wherein these groups are optionally further substituted and wherein at least one of these groups contains a ballast group, and $R^{10}$ represents hydrogen or a group which can split off during chromogenic coupling.

$R^8$ is preferably a tert.-butyl group; $R^{10}$ is preferably chlorine.

(XIV)

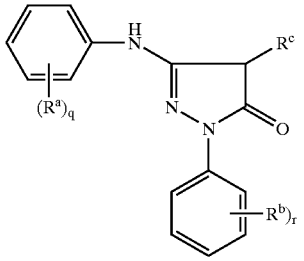

wherein r is an integer from 1 to 5; q is 1, 2 or 3; $R^c$ represents a group which can split off during chromogenic coupling; $R^a$ represents halogen or alkoxy or acylamino groups; and $R^b$ represents halogen or cyano, thiocyanato, alkoxy, alkyl, acylamino or alkoxycarbamyl groups.

$R^c$ is preferably hydrogen or a group which can split off as an anion under the basic conditions of chromogenic coupling.

Particularly preferred, $R^c$ represents —S-aryl or —N=N-aryl, wherein aryl preferably is a phenyl or naphthyl group, that is optionally substituted by halogen, like chlorine or bromine or $C_1$–$C_{18}$-alkyl or $C_1$–$C_{18}$-alkoxy groups.

Cyan Coupler:

(VII)

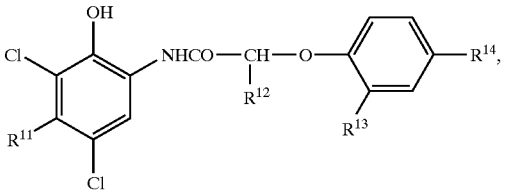

wherein $R^{11}$, $R^{12}$, $R^{13}$ and $R^{14}$ independently represent hydrogen or a $C_1$–$C_6$-alkyl group. $R^{11}$ is preferably a $CH_3$ or $C_2H_5$; $R^{12}$ is preferably a $C_2$–$C_6$-alkyl group; and $R^{13}$ and $R^{14}$ are preferably t-$C_4H_9$ or t-$C_5H_{11}$.

(VIII)

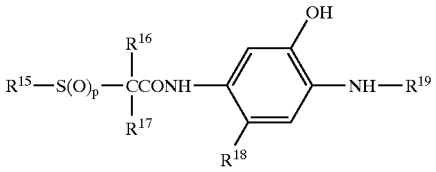

wherein $R^{15}$ represents alkyl, alkenyl, aryl or hetero-aryl groups; $R^{16}$, $R^{17}$ independently represent hydrogen, alkyl, alkenyl, aryl or hetero-aryl groups; $R^{18}$ represents hydrogen or a group which can split off during chromogenic coupling; $R^{19}$ represents $—COR^{20}$, $—CO_2R^{20}$, $—CONR^{20}R^{21}$, $—SO_2R^{20}$, $—SO_2NR^{20}R^{21}$, $—CO—CO_2R^{20}$, $—COCONR^{20}R^{21}$ or a group with the formula:

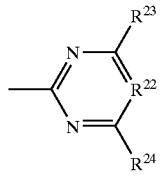

wherein $R^{20}$ represents alkyl, alkenyl, aryl or hetero-aryl groups; $R^{21}$ represents hydrogen or $R^{20}$; $R^{22}$ represents —N═ or —C($R^{25}$)═; $R^{23}$, $R^{24}$ and $R^{25}$ independently represent —$OR^{21}$, —$SR^{21}$, —$NR^{20}R^{21}$, —$R^{21}$ or Cl; and p is 1 or 2.

The following groups of couplers according to formula (VIII) are preferred:

(1) couplers in which p=1 and $R^{15}$ to $R^{25}$ have the meaning given above.

(2) couplers in which p=2, $R^{19}$ represents —CO—$R^{26}$, $R^{26}$ represents alkenyl or hetero-aryl groups and $R^{15}$ to $R^{18}$ have the meanings given above.

(3) couplers in which p=2, $R^{19}$ represents —$SO_2R^{27}$, —$SO_2N(R^{27})_2$, —$CO_2R^{27}$, —$COCO_2$—$R^{27}$, or —COCO—$N(R^{27})_2$, $R^{27}$ represents alkyl, aryl, alkenyl or hetero-aryl groups and $R^{15}$ to $R^{18}$ have the meanings given above.

(4) couplers in which p=2, $R^{19}$ represents a group with the formula:

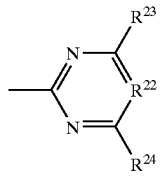

and $R^{15}$ to $R^{18}$ and $R^{22}$ to $R^{24}$ have the meanings given above.

(5) couplers in which p=2 and $R^{19}$ represents a group with the formula:

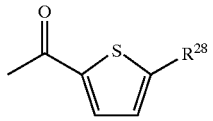

$R^{28}$ represents hydrogen, Cl, CN, Br, F, —$COR^{29}$, —$CONHR^{29}$ or $CO_2R^{29}$ and $R^{29}$ represents alkyl or aryl groups.

(6) couplers in which p=2 and $R^{19}$ represents a group with the formula:

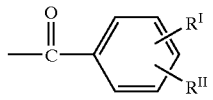

wherein $R^I$ represents halogen, CN, —$CF_3$ or alkoxycarbonyl groups; $R^{II}$ represents hydrogen or has the same meaning as $R^I$; and $R^{15}$ to $R^{18}$ have the meanings given above.

(7) couplers in which p=2 and $R^{19}$ represents —$COR^{20}$; $R^{20}$ represents alkyl, aryl or hetero-aryl groups and $R^{15}$ to $R^{18}$ have the meanings given above.

(8) couplers in which p=2 and $R^{19}$ represents a group with the formula:

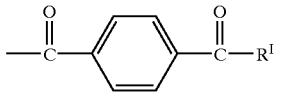

wherein $R^I$ represents —$OR^{II}$ or —$NR^{III}R^{IV}$; $R^{II}$ and $R^{III}$ represent an optionally substituted $C_1$–$C_6$-alkyl group; $R^{IV}$ represents hydrogen or has the same meaning as $R^{III}$; and $R^{15}$ to $R^{18}$ have the meanings given above.

In the formula (VIII) and the Compounds (1) to (8) the substituents have the following preferred meanings: $R^{15}$ represents alkyl or aryl groups; $R^{16}$ and $R^{17}$ independently represent H or alkyl or aryl groups; $R^{18}$ represents H, Cl, alkoxy, aryloxy, alkylthio or arylthio groups; $R^{22}$ represents —N═; and $R^{23}$ and $R^{24}$ independently represent —$OR^{21}$, —$NR^{20}R^{21}$ or —Cl.

In formula (VIII) and the Compounds (1) to (8) the substituents have the following particularly preferred meanings: $R^{15}$ is a group according to one of formulae (15-1), (15-2) and (15-3):

(15-1)

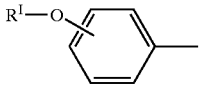

wherein $R^I$ represents an alkyl group with at least 8 C-atoms;

(15-2)

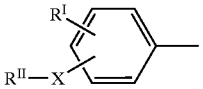

wherein $R^I$ represents alkyl, alkenyl, alkoxy, aryloxy, acyloxy, acylamino, sulfonyloxy, sulfamoylamino, sulfonamido, ureido, hydroxycarbonyl, hydroxy, carbonylamino, carbamoyl, alkylthio, arylthio, alkylamino, arylamino groups or hydrogen; $R^{II}$ represents an alkyl or aryl group; X represents S, NH or $NR^{III}$ and $R^{III}$ represents an alkyl or aryl group;

(15-3)

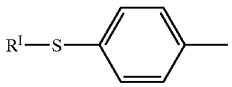

wherein $R^I$ represents an optionally substituted alkyl group; $R^{16}$ represents an alkyl group, in particular $C_1$–$C_4$-alkyl group; $R^{17}$ represents H; and $R^{20}$ represents an alkyl or aryl group.

Particularly preferred couplers are group (6) couplers according to formula (VIII) in which $R^{15}$ is represented by formula (15-1); group (7) couplers according to formula (VIII) in which $R^{15}$ is represented by formula (15-2); group (8) couplers according to formula (VIII) in which $R^{15}$ is represented by formula (15-3); and group (8) couplers according to formula (VIII) and $R^{15}$ is a group with 8 to 18 carbon atoms.

Alkyl- and alkenyl-groups can be straight chain, branched, cyclic and optionally substituted. Aryl- and hetero-aryl-groups are optionally substituted and the aryl group is preferably a phenyl group. Possible substituents for the alkyl, alkenyl, aryl and hetero-aryl groups are: alkyl, alkenyl, aryl, hetero-aryl, alkoxy, aryloxy, alkenyloxy, hydroxy, alkylthio, arylthio, halogen, cyano, acyl, acyloxy or acylamino groups, wherein an acyl group can be derived from an aliphatic, olefinic or aromatic carbonic, carboxylic, carboxylamino, sulfonic, sulfonamido, sulfinic, phosphoric, phosphonic or phosphorous acid.

Examples of cyan couplers according to formula (VII) are:

VII-1 with $R^{11}=C_2H_5$, $R^{12}=n\text{-}C_4H_9$, $R^{13}=R^{14}=t\text{-}C_4H_9$,
VII-2 with $R^{11}=R^{12}=C_2H_5$, $R^{13}=R^{14}=t\text{-}C_5H_{11}$,
VII-3 with $R^{11}=C_2H_5$, $R^{12}=n\text{-}C_3H_7$, $R^{13}=R^{14}=t\text{-}C_5H_{11}$,
VII-4 with $R^{11}=CH_3$, $R^{12}=C_2H_5$, $R^{13}=R^{14}=t\text{-}C_5H_{11}$.

Examples of cyan couplers according to formula (VIII) with p=2 are:

| No. | $R^{16}$ | $R^{17}$ | $R^{15}$ | $R^{19}$ | $R^{18}$ |
|---|---|---|---|---|---|
| VIII-1 | $-C_2H_5$ | H | 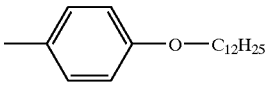 | 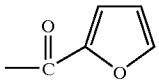 | —Cl |
| VIII-2 | $-C_2H_5$ | H | 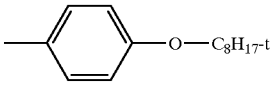 | 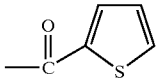 | —H |
| VIII-3 | $-C_6H_{13}$ | H | 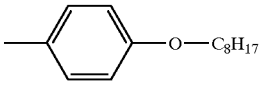 | 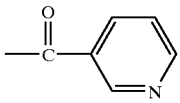 | $-OCH_2CH_2-SCH_2COOH$ |
| VIII-4 | -Phenyl | H | 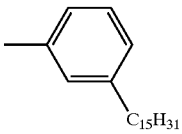 | 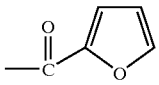 | —Cl |
| VIII-5 | $-CH_3$ | $-CH_3$ | $-C_{16}H_{33}$ | 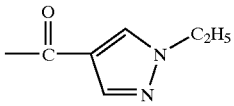 | —Cl |
| VIII-6 | -Phenyl | H | $-C_{12}H_{27}$ | 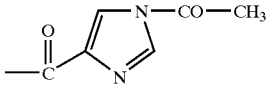 | $-SCH_2CH_2-COOH$ |
| VIII-7 | $-C_2H_5$ | H | 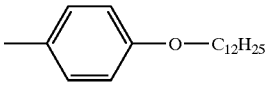 | 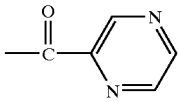 | $-O-CH_2-COOCH_3$ |
| VIII-8 | $C_{12}H_{25}$ | H | 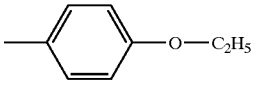 | 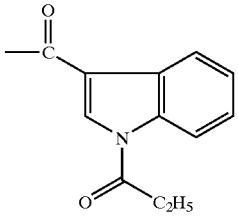 | —Cl |
| VIII-9 | $-C_3H_7\text{-i}$ | H | 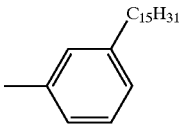 | 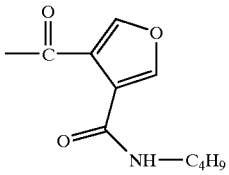 | —Cl |

-continued
| No. | $R^{16}$ | $R^{17}$ | $R^{15}$ | $R^{19}$ | $R^{18}$ |
|---|---|---|---|---|---|
| VIII-10 | $—CH_3$ | $—CH_3$ | 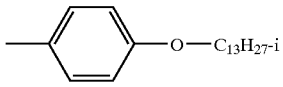 | 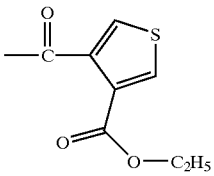 | 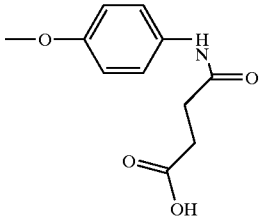 |
| VIII-11 | $—C_2H_5$ | H | 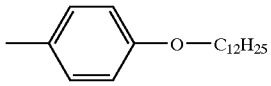 | 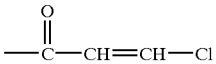 | —Cl |
| VIII-12 | -phenyl | H | $—C_{16}H_{33}$ | 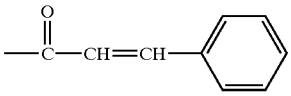 | H |
| VIII-13 | $—C_{12}H_{25}$ | H | 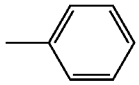 | 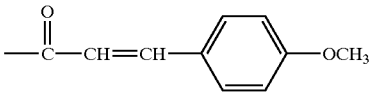 | —Cl |
| VIII-14 | $—C_4H_9$ | H | 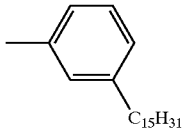 | 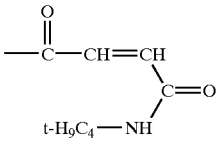 | $—OCH_2COOCH_3$ |
| VIII-15 | $—CH_3$ | $—CH_3$ | 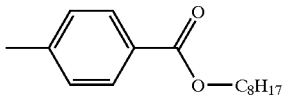 | 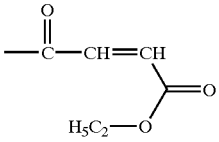 | —Cl |
| VIII-16 | $—C_2H_5$ | H | 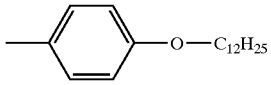 | $—SO_2—C_4H_9$ | —Cl |
| VIII-17 | $—C_2H_5$ | H | 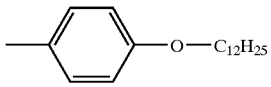 | $—CO—O—C_4H_9$-i | —Cl |
| VIII-18 | $—C_3H_7$-i | H | 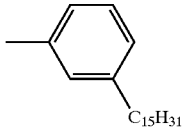 | 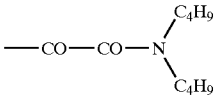 | $—OCH_2—COOCH_3$ |
| VIII-19 | -phenyl | H | 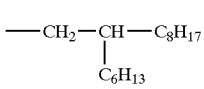 | $—SO_2—NH—C_4H_9$-t | H |
| VIII-20 | $—C_6H_{13}$ | H | 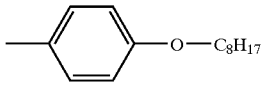 | 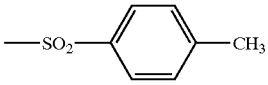 | H |
| VIII-21 | $—CH_3$ | $—CH_3$ | 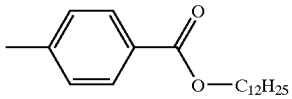 | $—CO—CO—OC_2H_5$ | —Cl |

-continued
| No. | $R^{16}$ | $R^{17}$ | $R^{15}$ | $R^{19}$ | $R^{18}$ |
|---|---|---|---|---|---|
| VIII-22 | $—C_4H_9$ | H | 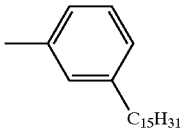 | $—SO_2—CH_3$ | —Cl |
| VIII-23 | -phenyl | -phenyl | $—C_{12}H_{25}$ | $—SO_2—C_4H_9$ | $—SCH_2CH_2—COOH$ |
| VIII-24 | $—C_{12}H_{25}$ | H | 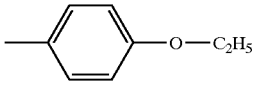 | $—CO—O—C_2H_5$ | —Cl |
| VIII-25 | $—C_2H_5$ | H | 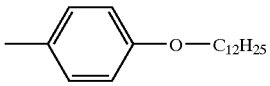 | 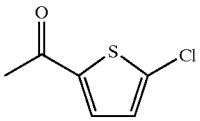 | —Cl |
| VIII-26 | $—CH_3$ | H | 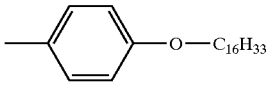 | 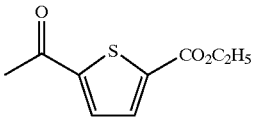 | —Cl |
| VIII-27 | $—C_2H_5$ | H | 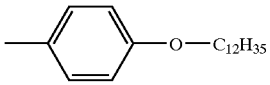 | 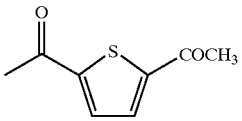 | —Cl |
Examples of cyan couplers according to formula (VIII) with p=2 and
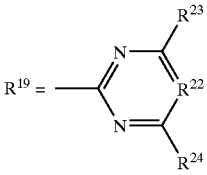
are:
| Nr. | $R^{16}$ | $R^{17}$ | $R^{15}$ | $R^{23}$ |
|---|---|---|---|---|
| VIII-28 | $—C_2H_5$ | H | 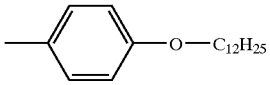 | $—N(C_4H_9)_2$ |
| VIII-29 | $—C_2H_5$ | H | 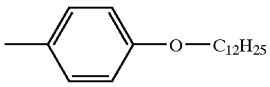 | 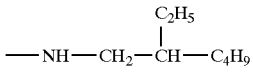 |
| VIII-30 | $—C_2H_5$ | H | 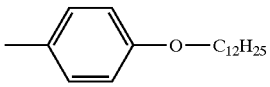 | $—OCH_3$ |

-continued

| | | | | |
|---|---|---|---|---|
| VIII-31 | —$C_6H_{13}$ | H | 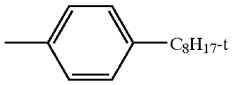 | —Cl |
| VIII-32 | -phenyl | H | —$C_{12}H_{25}$ | —$OCH_3$ |
| VIII-33 | —$CH_3$ | —$CH_3$ | 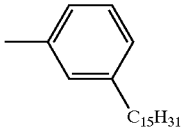 | —NH—$C_4H_9$ |
| VIII-34 | H | H | 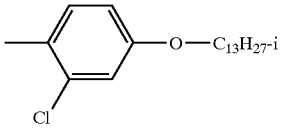 | —$OCH_3$ |
| VIII-35 | —$CH_3$ | H | 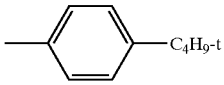 | —Cl |

| Nr. | $R^{24}$ | $R^{22}$ | $R^{18}$ |
|---|---|---|---|
| VIII-28 | —$N(C_4H_9)_2$ | —N= | —C— |
| VIII-29 | —NH—$CH_2$—CH($C_2H_5$)—$C_4H_9$ | —N= | —Cl |
| VIII-30 | —$OCH_3$ | —N= | —Cl |
| VIII-31 | —NH—$C_4H_9$ | —C(NH$C_4H_9$)= | H |
| VIII-32 | —$N(C_4H_9)_2$ | —N= | —$OCH_2COOCH_3$ |
| VIII-33 | —NH—$C_4H_9$ | —C(N$(C_2H_5)_2$)= | —Cl |
| VIII-34 | —NH—$C_4H_9$ | —N= | —S—$CH_2CH_2$—COOH |
| VIII-35 | —N(—$CH_2$—CH($C_2H_5$)—$C_4H_9$)$_2$ | —N= | —Cl |

Examples of cyan couplers according to formula (VIII) with p=1 are:

| Nr. | $R^{16}$ | $R^{17}$ | $R^{15}$ |
|---|---|---|---|
| VIII-36 | —$C_2H_5$ | H | 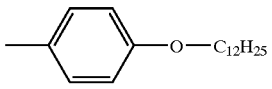 |
| VIII-37 | —$C_4H_9$ | H | 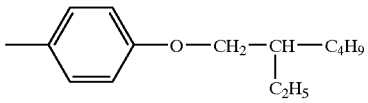 |
| VIII-38 | —$C_6H_{13}$ | H | 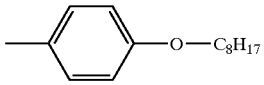 |
| VIII-39 | —$CH_3$ | —$CH_3$ | 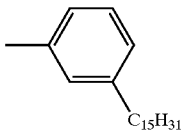 |

-continued
| | | | |
|---|---|---|---|
| VIII-40 | -Phenyl | H | $—CH_2—CH(C_4H_9)—C_6H_{13}$ |
| VIII-41 | $—C_2H_5$ | H | 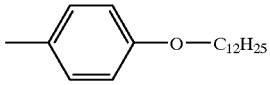 |
| VIII-42 | $—C_{12}H_{25}$ | H | 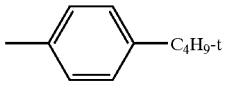 |
| VIII-43 | $—C_4H_9$ | H | $—C_{12}H_{25}$ |
| VIII-44 | $—C_2H_5$ | H | 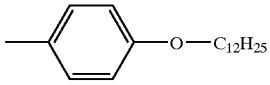 |
| VIII-45 | $—C_3H_7$-i | H | $—C_{16}H_{33}$ |
| VIII-46 | $—CH_2CH_2CH_2CH_2—$ | | 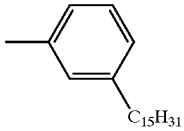 |
| VIII-47 | $—C_2H_5$ | $—C_2H_5$ | 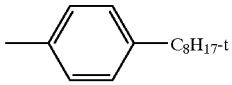 |
| VIII-48 | -phenyl | H | $—C_{12}H_{25}$ |
| VIII-49 | $—C_{12}H_{25}$ | H | 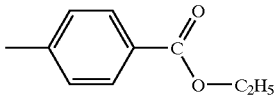 |
| VIII-50 | $—C_2H_5$ | H | 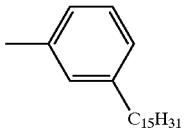 |
| VIII-51 | $—C_6H_{13}$ | H | 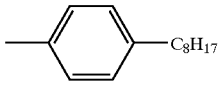 |
| VIII-52 | $—C_4H_9$ | H | 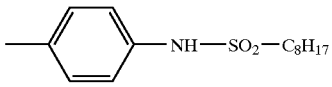 |
| VIII-53 | $—CH_3$ | H | 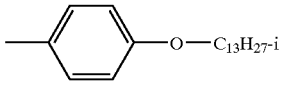 |
| VIII-54 | -Phenyl | H | $—CH_2—CH(C_2H_5)—C_4H_9$ |
| VIII-55 | $—C_2H_5$ | H | 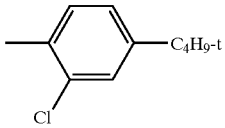 |

-continued
| | | | |
|---|---|---|---|
| VIII-56 | $—C_2H_5$ | H | 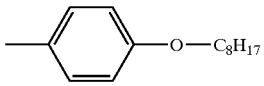 |
| VIII-57 | $—C_3H_7$ | H | 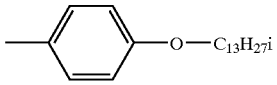 |
| VIII-58 | $—C_2H_5$ | H | 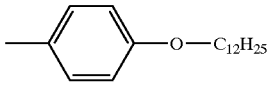 |
| VIII-59 | —H | H | 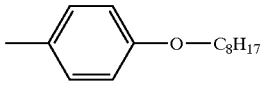 |
| VIII-60 | $—C_2H_5$ | H | 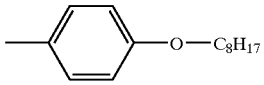 |
| Nr. | $R^{19}$ | $R^{18}$ |
|---|---|---|
| VIII-36 | 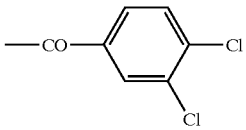 | —Cl |
| VIII-37 | $—CO—C_3F_7$ | —Cl |
| VIII-38 | 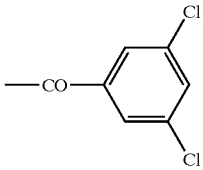 | $—OCH_2CH_2—S—CH_2COOH$ |
| VIII-39 | 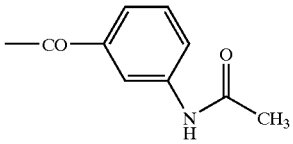 | H |
| VIII-40 | 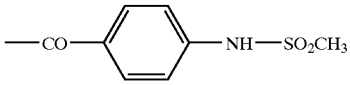 | —Cl |
| VIII-41 | 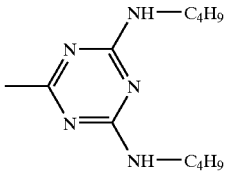 | H |
| VIII-42 | 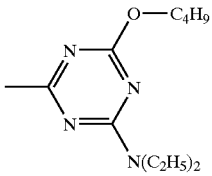 | 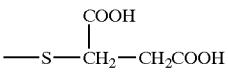 |

-continued
| | | |
|---|---|---|
| VIII-43 | 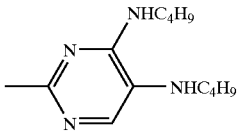 | —Cl |
| VIII-44 | $—SO_2—C_4H_9$ | —Cl |
| VIII-45 | 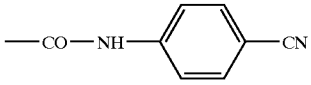 | $—O—CH_2—COO—CH_3$ |
| VIII-46 | 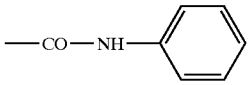 | —Cl |
| VIII-47 | $—CO—O—C_4H_9$-i | H |
| VIII-48 | $—CO—CO—N(C_4H_9)_2$ | 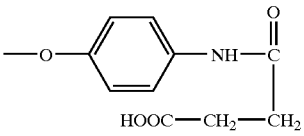 |
| VIII-49 | $—CO—CH=CH—CO—N(C_2H_5)_2$ | —Cl |
| VIII-50 | 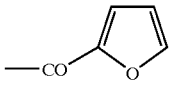 | —Cl |
| VIII-51 | 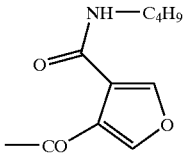 | H |
| VIII-52 | 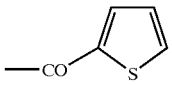 | —Cl |
| VIII-53 | 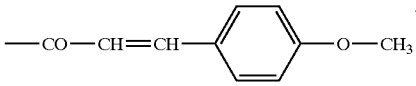 | —Cl |
| VIII-54 | 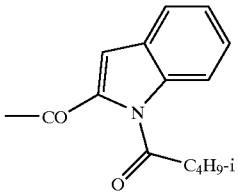 | H |
| VIII-55 | 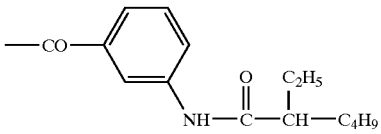 | —Cl |
| VIII-56 | 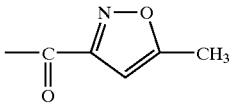 | Cl |

-continued
| | | |
|---|---|---|
| VIII-57 | 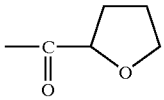 | Cl |
| VIII-58 | 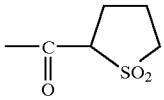 | H |
| VIII-59 | 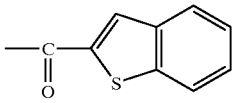 | Cl |
| VIII-60 | 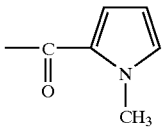 | Cl |
Examples of group (6) cyan couplers according to formula (VIII) with p=2 are:
| No. | $R^{16}$ | $R^{17}$ | $R^{15}$ | $R^{19}$ | $R^{18}$ |
|---|---|---|---|---|---|
| VIII-61 | $—C_2H_5$ | H | 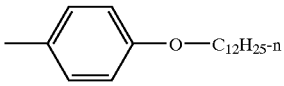 | 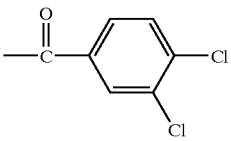 | —Cl |
| VIII-62 | $—CH_3$ | H | 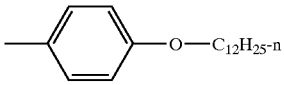 | 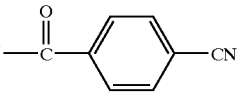 | —Cl |
| VIII-63 | $—C_2H_5$ | H | 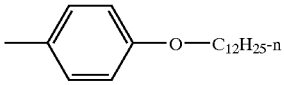 | 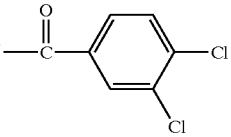 | —O—$CH_2$—CO—NH—$CH_2$—$CH_2$—O—$CH_3$ |
| VIII-64 | $—C_2H_5$ | H | 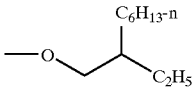 | 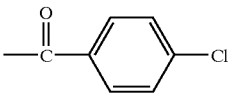 | —Cl |
| VIII-65 | $—C_2H_5$ | H | 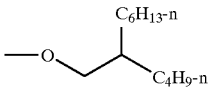 | 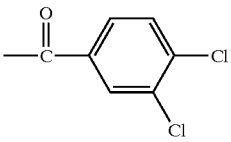 | —Cl |

Examples of group (7)cyan couplers according to formula (VIII) with p=2 are:
| No. | $R^{16}$ | $R^{17}$ | $R^{15}$ | $R^{19}$ | $R^{18}$ |
|---|---|---|---|---|---|
| VIII-66 | $—C_2H_5$ | H | 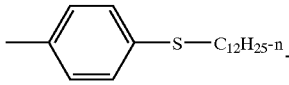 | 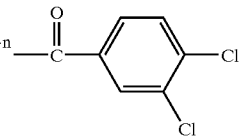 | —Cl |
| VIII-67 | $—C_2H_5$ | H | 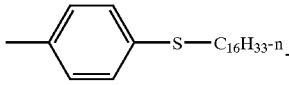 | 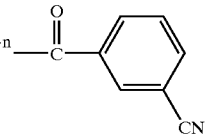 | —O—$CH_2$—$CH_2$—CO—NH—$CH_3$ |
| VIII-68 | $—C_{12}H_{25}—$ | H | 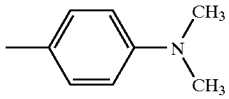 | 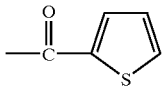 | Cl |
| VIII-69 | $—C_2H_5$ | H | 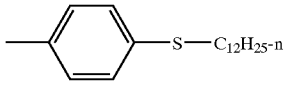 | 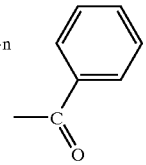 | —Cl |
| VIII-70 | $—C_2H_5$ | H | 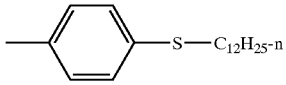 | 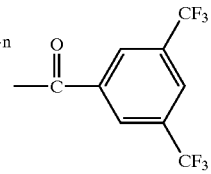 | Cl |
| VIII-71 | $—C_2H_5$ | H | 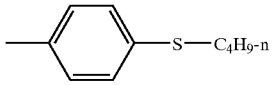 | 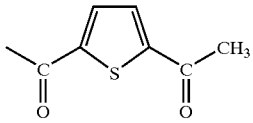 | Cl |
| VIII-72 | $—C_2H_5$ | H | 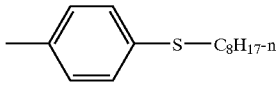 | 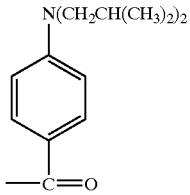 | Cl |
| VIII-73 | $—C_2H_5$ | H | 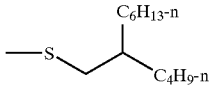 | 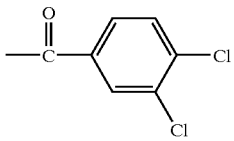 | Cl |

Examples of group (8)cyan couplers according to formula (VIII) with p=2 are:
| No. | $R^{16}$ | $R^{17}$ | $R^{15}$ | $R^{19}$ | $R^{18}$ |
|---|---|---|---|---|---|
| VIII-74 | $—C_2H_5$ | H | 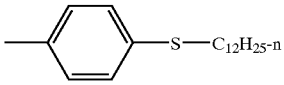 | 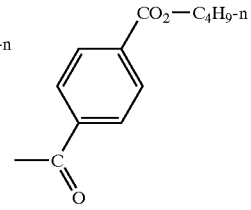 | —Cl |
| VIII-75 | $—C_2H_5$ | H | 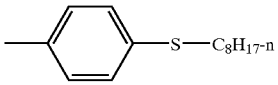 | 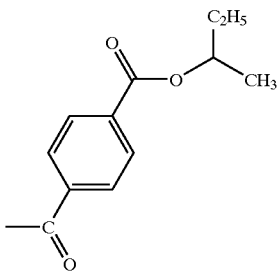 | —Cl |
| VIII-76 | $—CH_3$ | H | 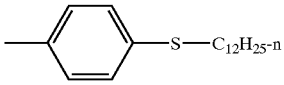 | 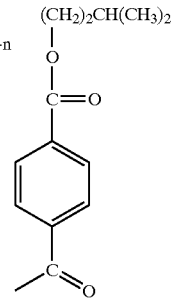 | Cl |
| VIII-77 | $—C_2H_5$ | H | 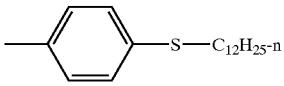 | 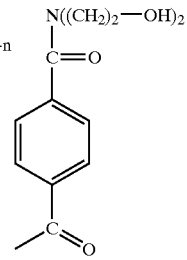 | —Cl |
| VIII-78 | $—C_2H_5$ | H | 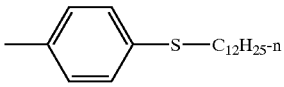 | 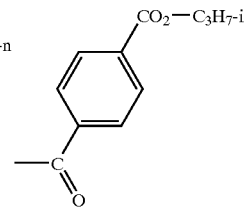 | —O—$CH_2$—CO—NH—$CH_2$—$CH_2$—O—$CH_3$ |

-continued
| No. | $R^{16}$ | $R^{17}$ | $R^{15}$ | $R^{19}$ | $R^{18}$ |
|---|---|---|---|---|---|
| VIII-79 | $—C_2H_5$ | H | 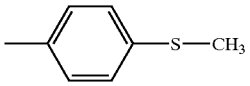 | 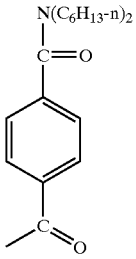 | Cl |
| VIII-80 | $—CH_3$ | H | 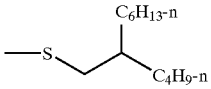 | 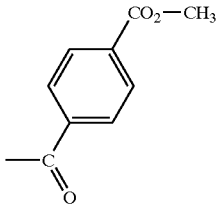 | Cl |
| VIII-81 | $—C_2H_5$ | H | 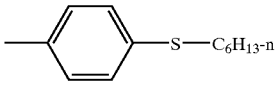 | 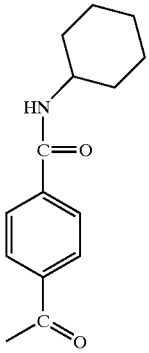 | Cl |
| VIII-82 | $—C_2H_5$ | H | 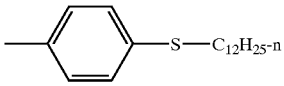 | 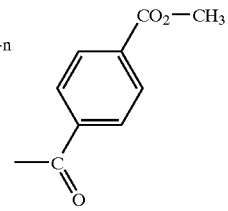 | $—O—CH_2—CO—NH—CH_2—CH_2—O—CH_3$ |
| VIII-83 | $—C_2H_5$ | H | 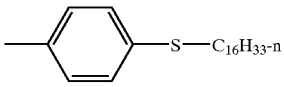 | 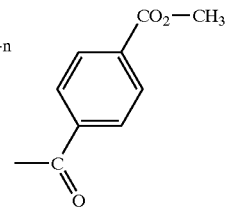 | $—O—CH_2—CH_2—CO—NH—CH_3$ |

The preparation of cyan couplers according to formula (VIII) proceeds analogously to the syntheses disclosed in U.S. Pat. No. 5,686,235 herein incorporated by reference. Examples of magenta couplers according to formula (V) are:
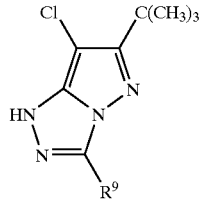
| Coupler | $R^9$ |
|---|---|
| V-1 | $—C_{13}H_{27}$ |
| V-2 | $—(CH_2)_3SO_2C_{12}H_{25}$ |
| V-3 | 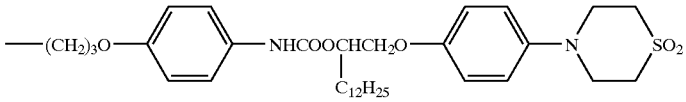 |
| V-4 | 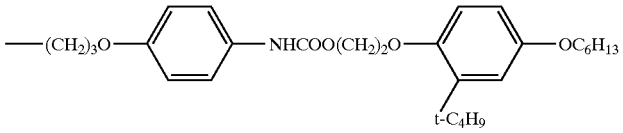 |
| V-5 | 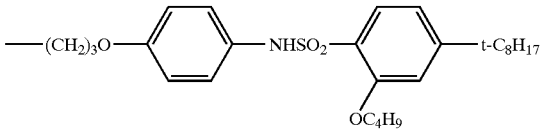 |
| V-6 | 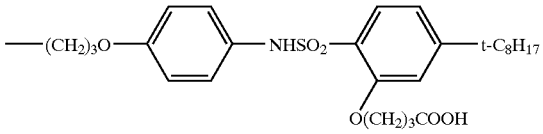 |
| V-7 | $—(CH_2)_2NHCOC_{13}H_{27}$ |
| V-8 | 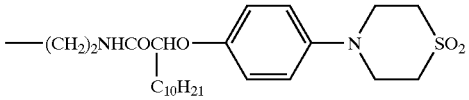 |
| V-9 | 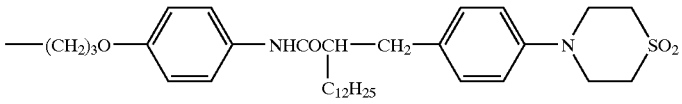 |
| V-10 | 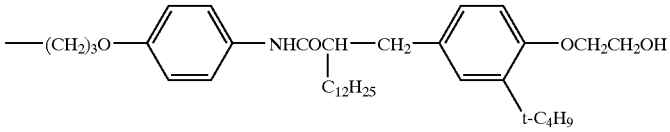 |
| V-11 | 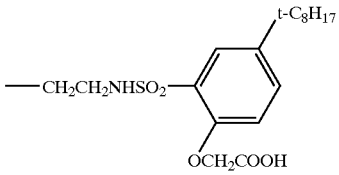 |
| V-12 | $—CH_2CH_2NHSO_2C_{16}H_{33}$ |
| V-13 | $—CH_2CH_2NHCONHC_{12}H_{25}$ |

-continued
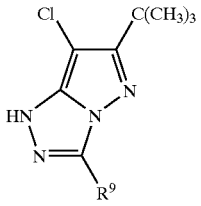
| Coupler | $R^9$ |
|---|---|
| V-14 | $—(CH_2)_3NHSO_2C_{12}H_{25}$ |
| V-15 | 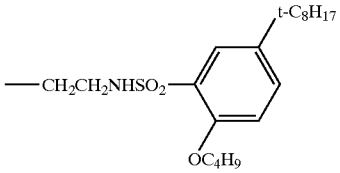 |
| V-16 | 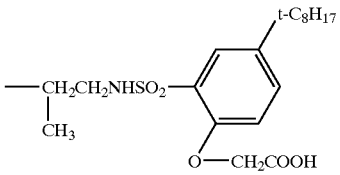 |
| V-17 | 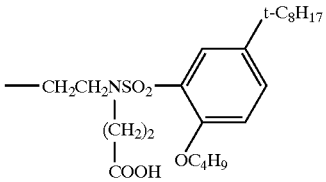 |
| V-18 | 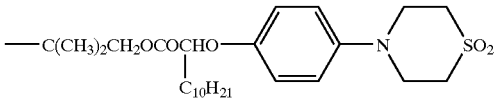 |
| V-19 | 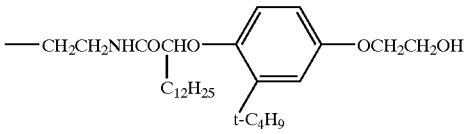 |
| V-20 | 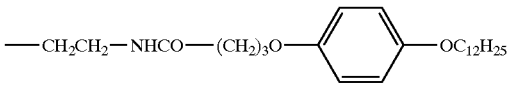 |
| V-21 | $—CH_2CH_2NHCOOC_{12}H_{25}$ |
and
V-22
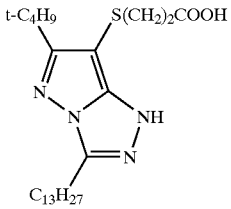

-continued
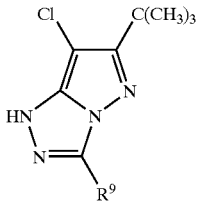
| Coupler | $R^9$ |
|---|---|
| V-23 | 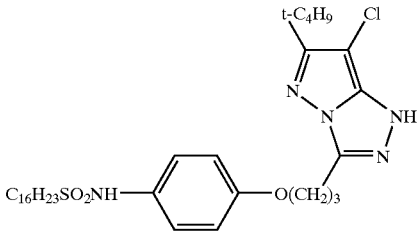 |
| V-24 | 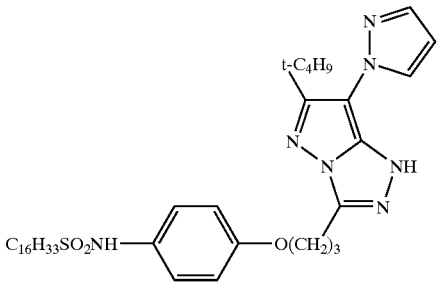 |
| V-25 | 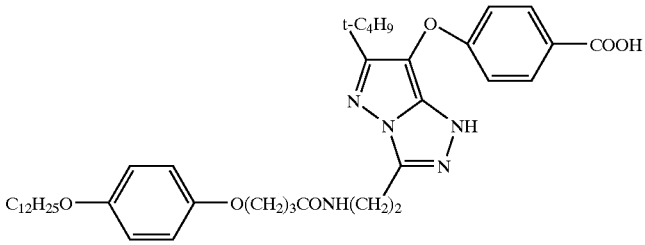 |
Examples of magenta couplers according to formula (VI) are:
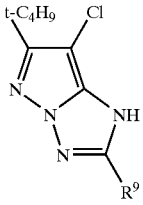
| Coupler | $R^9$ |
|---|---|
| VI-1 | 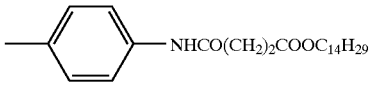 |

-continued
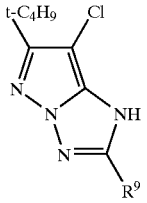
| Coupler | $R^9$ |
|---|---|
| VI-2 | 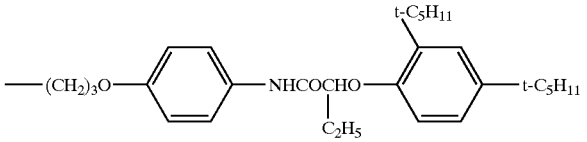 |
| VI-3 | 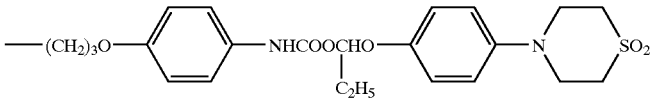 |
| VI-4 | 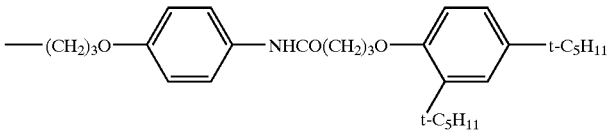 |
| VI-5 | 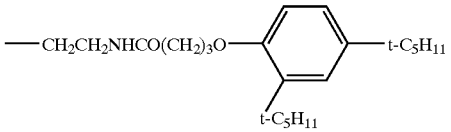 |
| VI-6 | 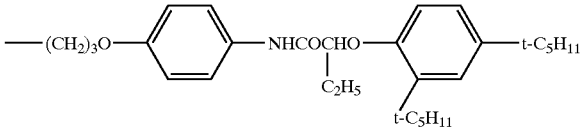 |
| VI-7 | 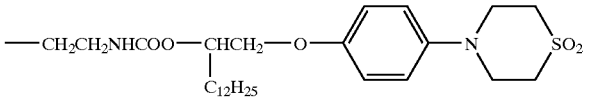 |
| VI-8 | 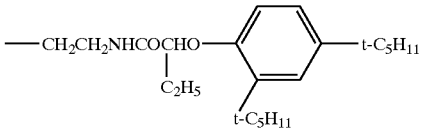 |
| VI-9 | $—CH_2CH_2NHCOC_{13}H_{27}$ |
| VI-10 | 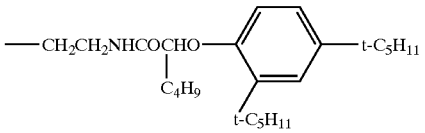 |
| VI-11 | $—(CH_2)_3SO_2C_{12}H_{25}$ |

-continued
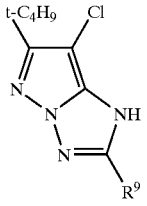
| Coupler | $R^9$ |
|---|---|
| VI-12 | 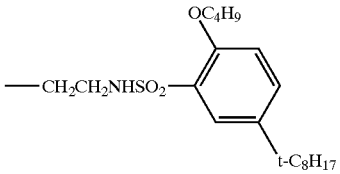 |
| VI-13 | 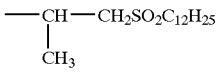 |
| VI-14 | 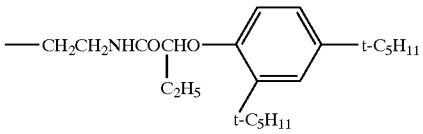 |
| VI-15 | 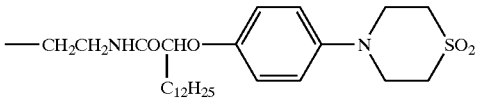 |
| VI-16 | 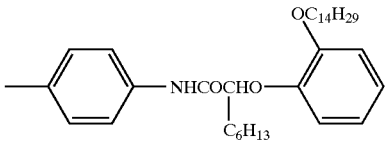 |
| VI-17 | 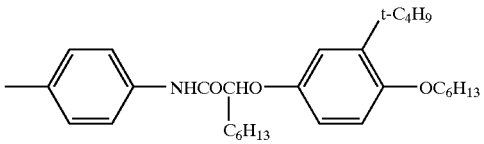 |
| VI-18 | 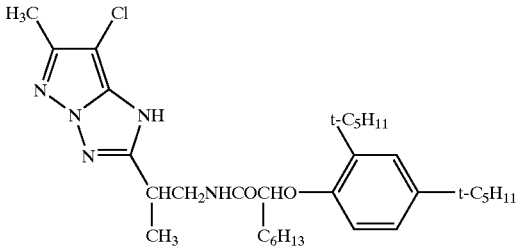 |
| VI-19 | 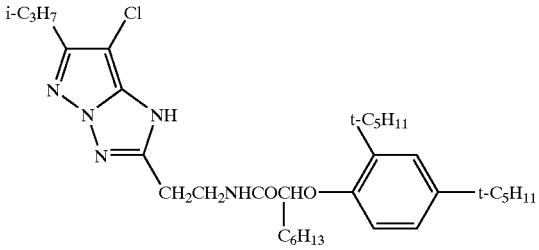 |

-continued
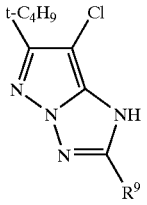
Coupler $R^9$
VI-20
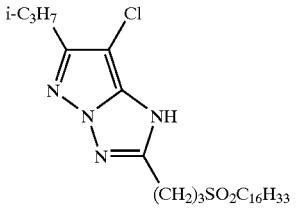
VI-21
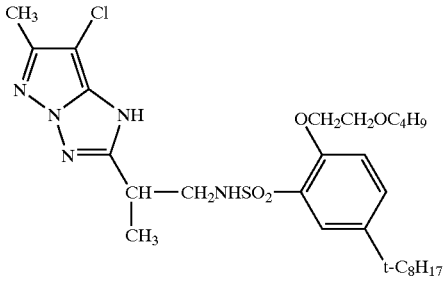
VI-22
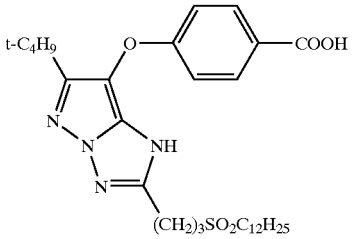
VI-23
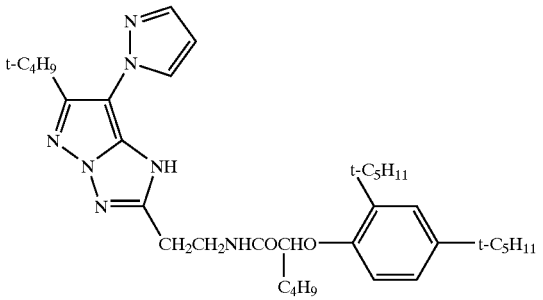

-continued
| Coupler | $R^9$ |
|---|---|
| VI-24 | 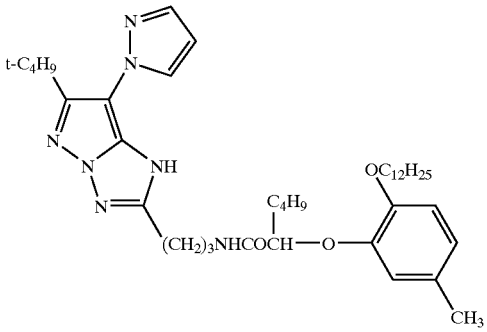 |
Examples of magenta couplers according to formula (XIV) are:
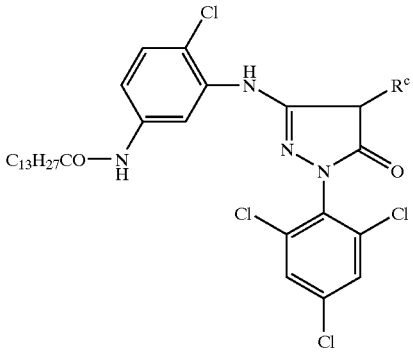
| Coupler | $R^c$ |
|---|---|
| (XIV-1) | —H |
| (XIV-2) | 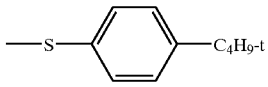 |
| (XIV-3) | 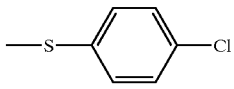 |
| (XIV-4) | 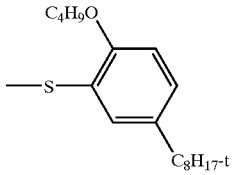 |
-continued
| | |
|---|---|
| (XIV-5) | 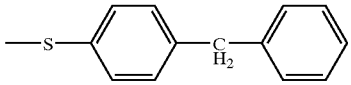 |
| (XIV-6) | 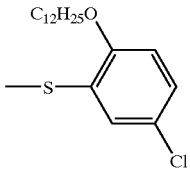 |
| (XIV-7) | 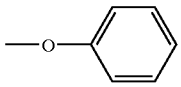 |
| (XIV-8) | 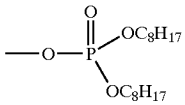 |
| (XIV-9) | —NH—$SO_2$—$C_4H_9$ |

-continued
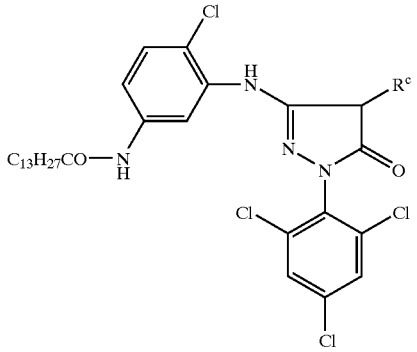
(XIV-10)
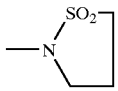
(XIV-11)
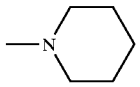
-continued
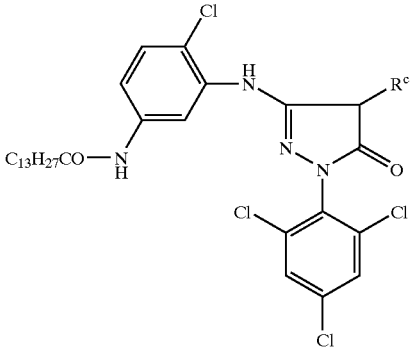
(XIV-12)
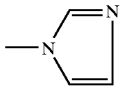
(XIV-13)
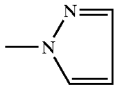
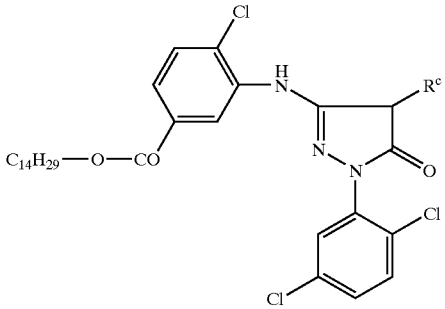
| Coupler | $R^e$ |
|---|---|
| (XIV-14) | H |
| (XIV-15) | 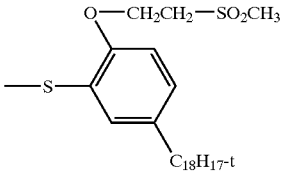 |
| (XIV-16) | 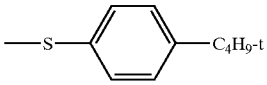 |

-continued
(XIV-17)
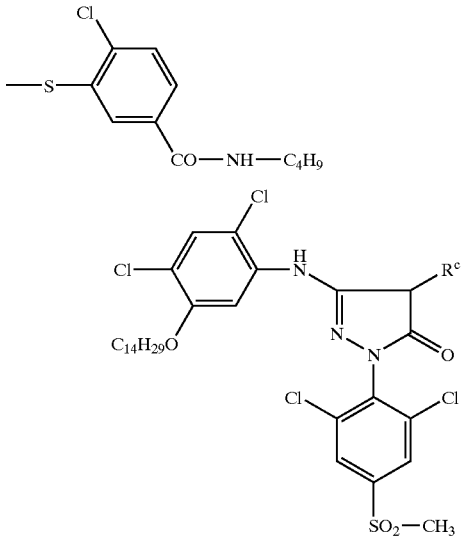
(XIV-18) H
(XIV-19)
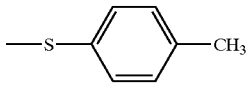
(XIV-20)
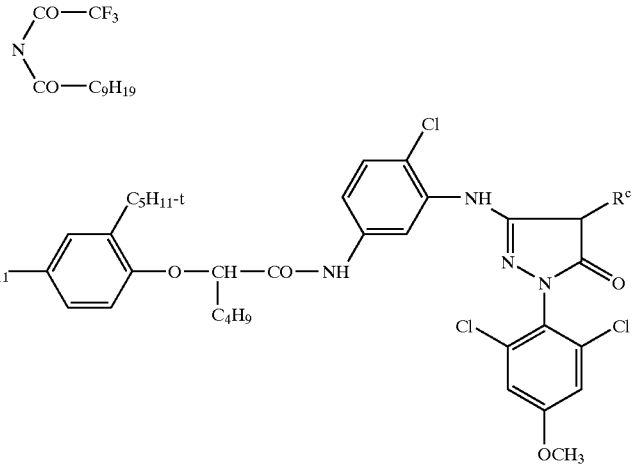
(XIV-21) H
(XIV-22)
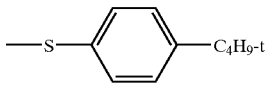
(XIV-23)
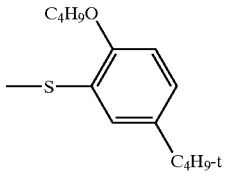

-continued
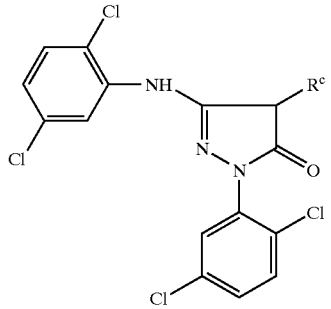
(XIV-24)
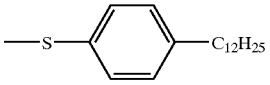
(XIV-25) —S—$C_{12}H_{25}$
(XIV-26)
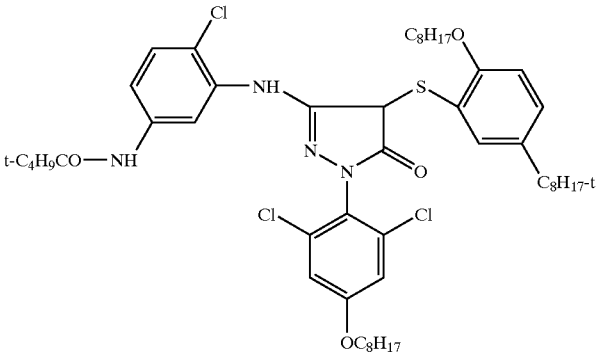
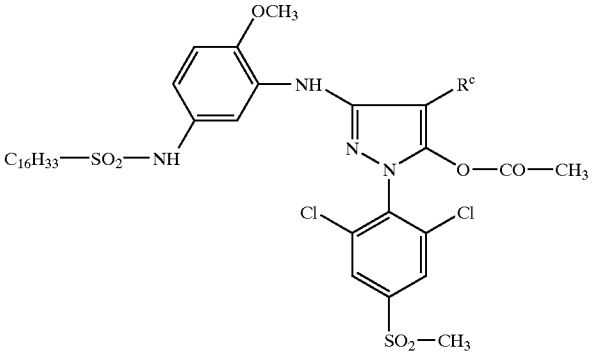
(XIV-27) H
(XIV-28)
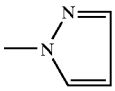
(XIV-29)
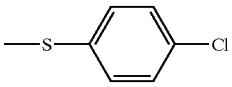

-continued
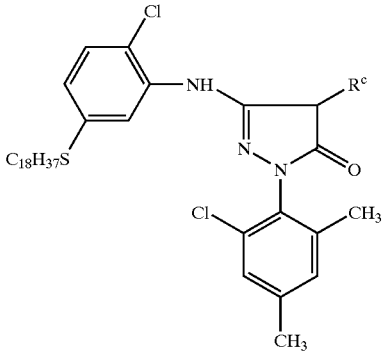
(XIV-30) H
(XIV-31)
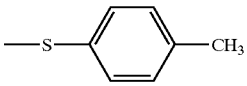
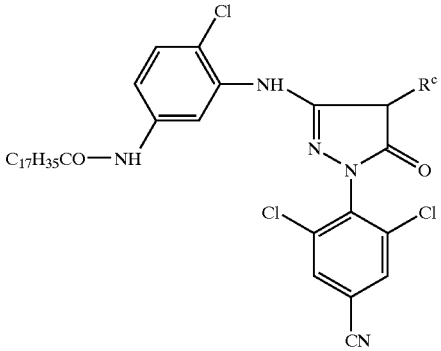
(XIV-32) H
(XIV-33)
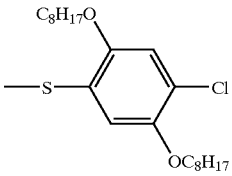
(XIV-34)
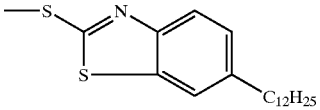
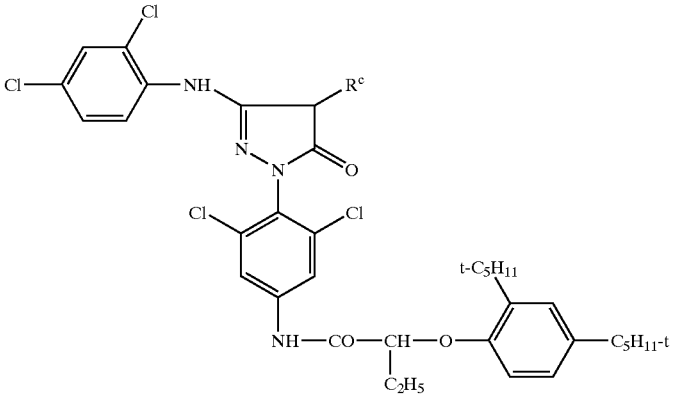
(XIV-35) H -continued
(XIV-36)
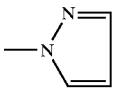
(XIV-37)
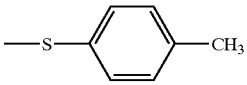
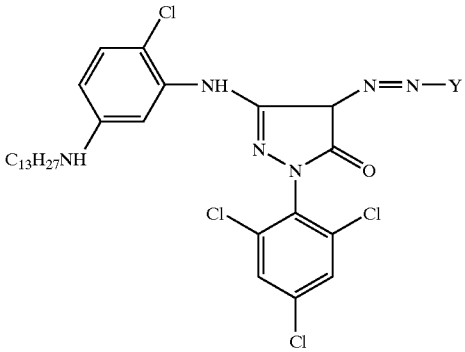
Coupler Y
(XIV-38)
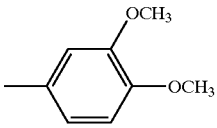
(XIV-39)
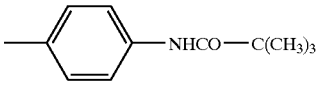
(XIV-40)
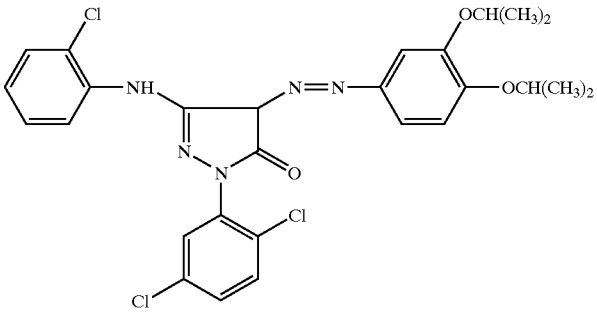
(XIV-41)
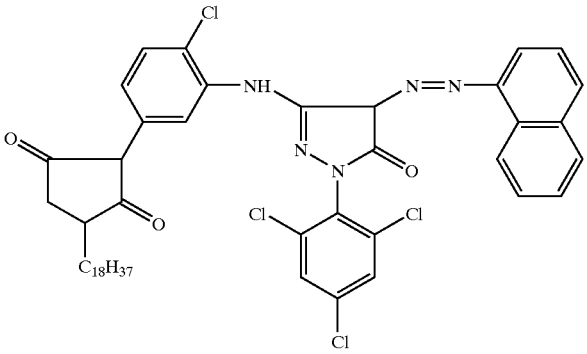

-continued
(XIV-42)
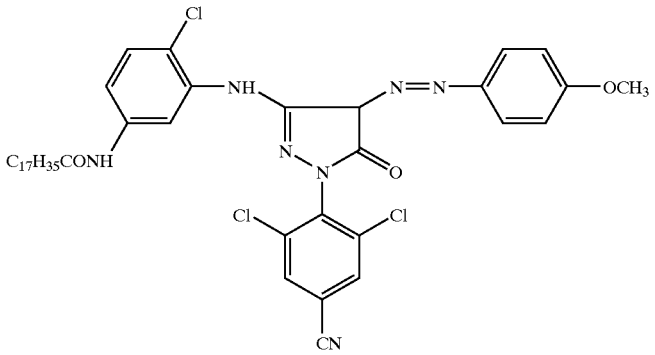
(XIV-43)
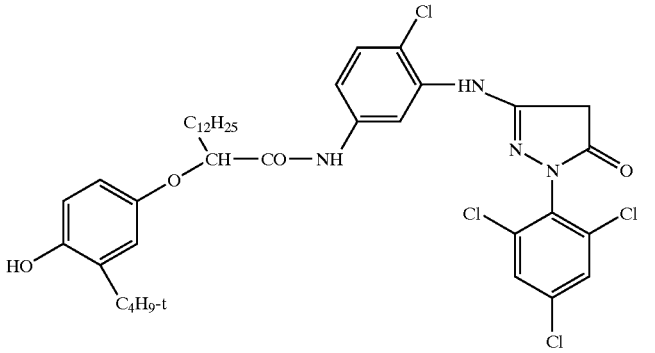
Examples of yellow couplers according to formula (IV) are:
IV-1
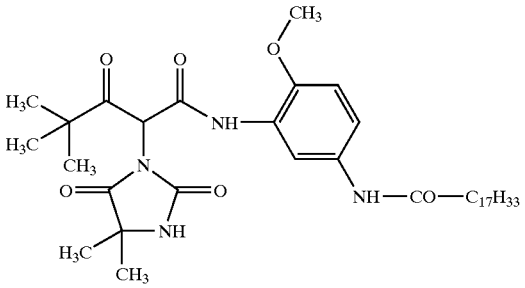
IV-2
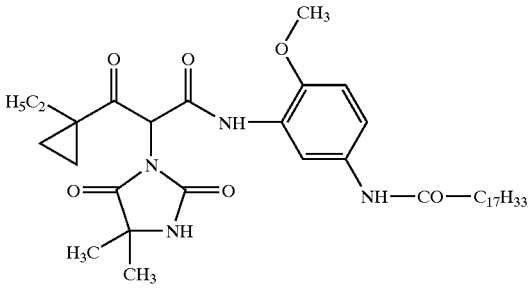
IV-3
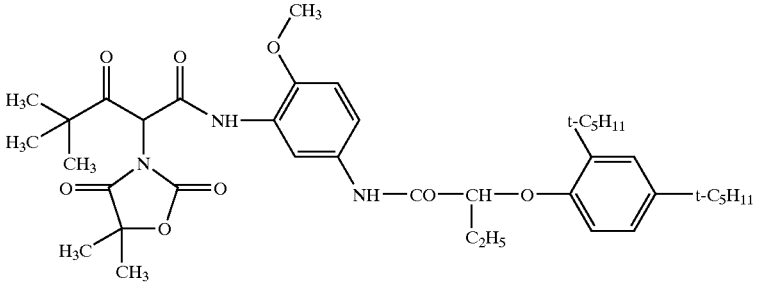

-continued
IV-4
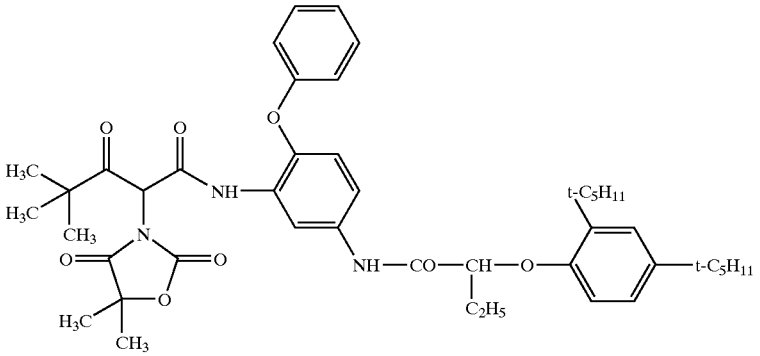
IV-5
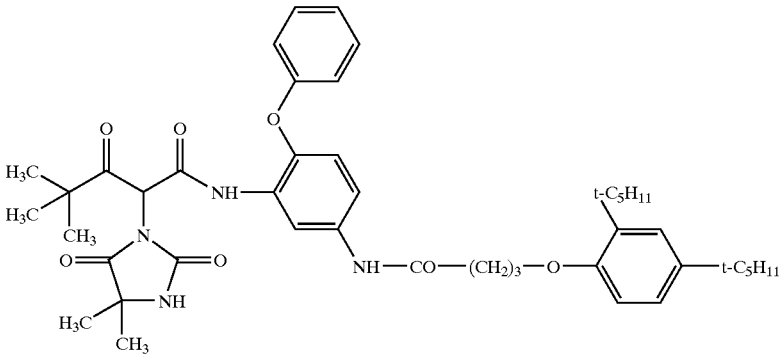
IV-6
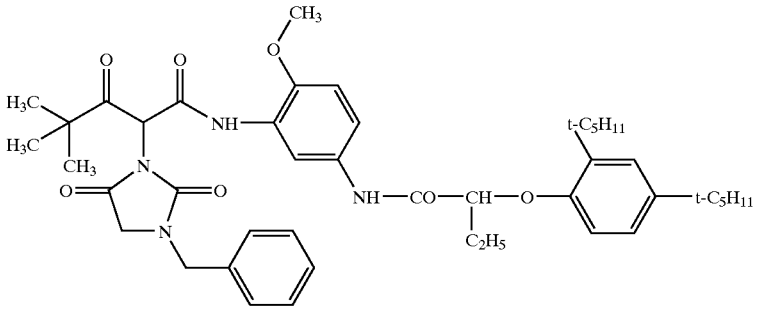
IV-7
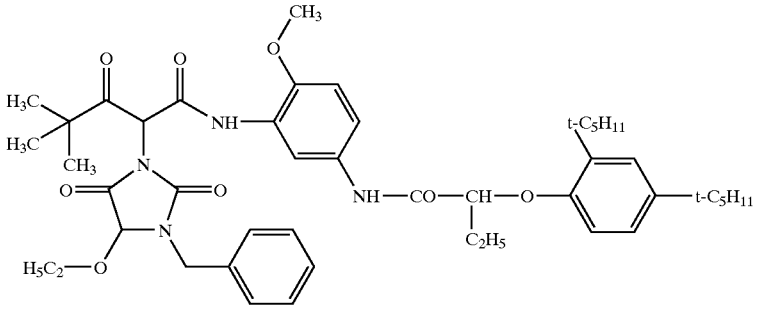
IV-8
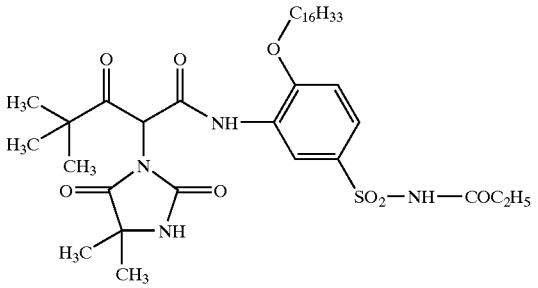
IV-9
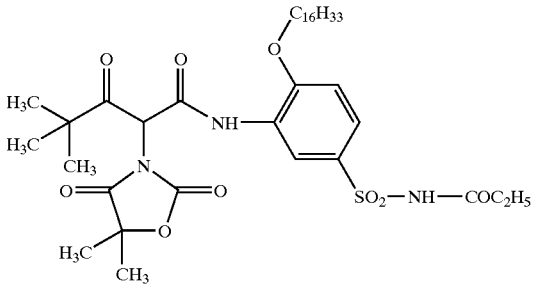

-continued
IV-10
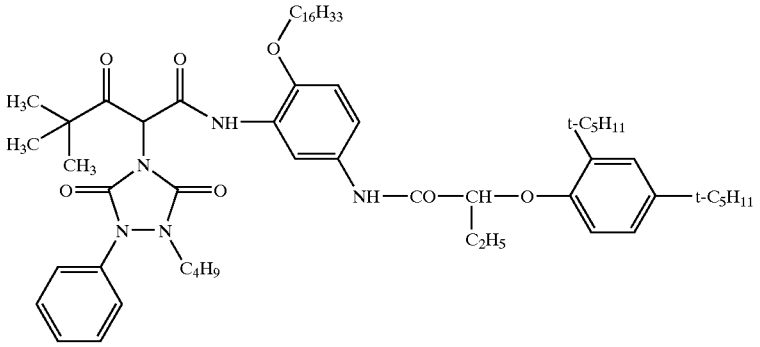
IV-11
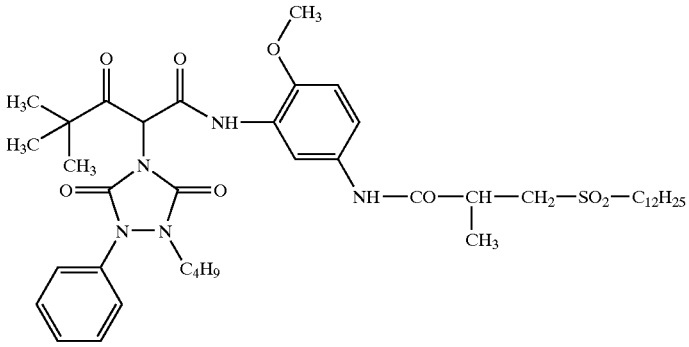
IV-12
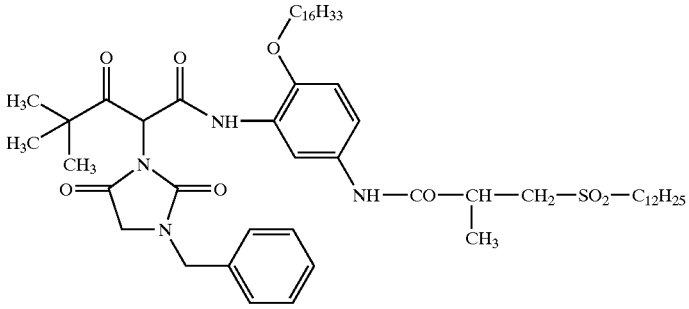
IV-13
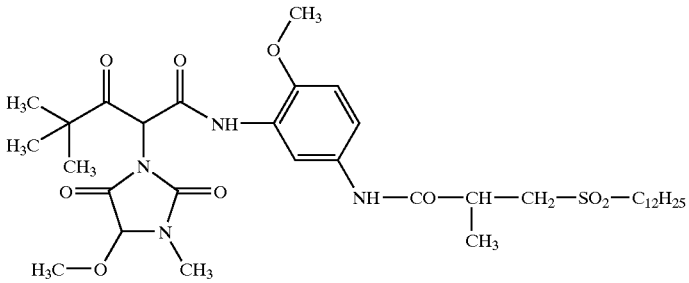
IV-14
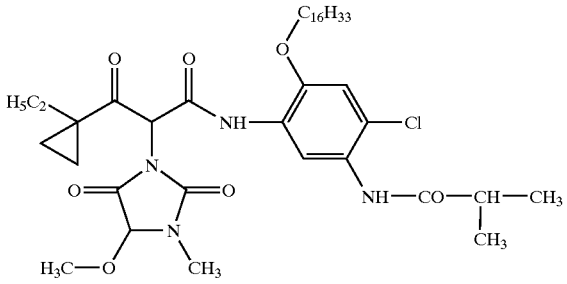

-continued
IV-15
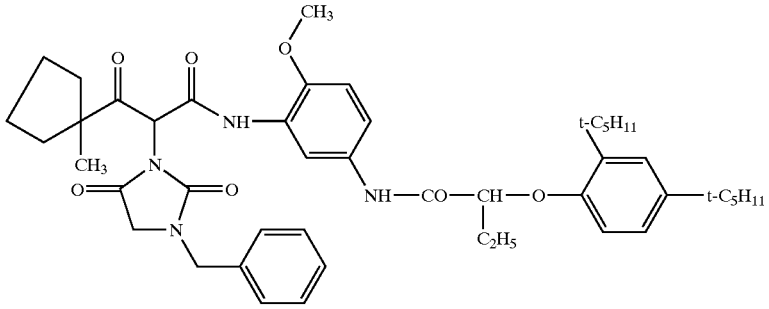
IV-16
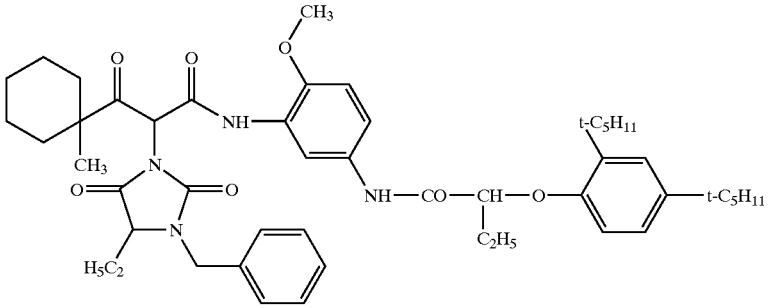
IV-17
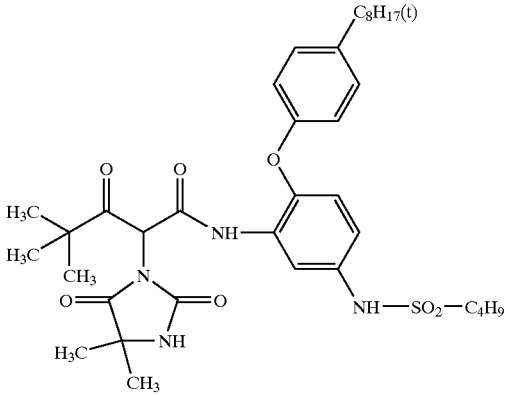
IV-18
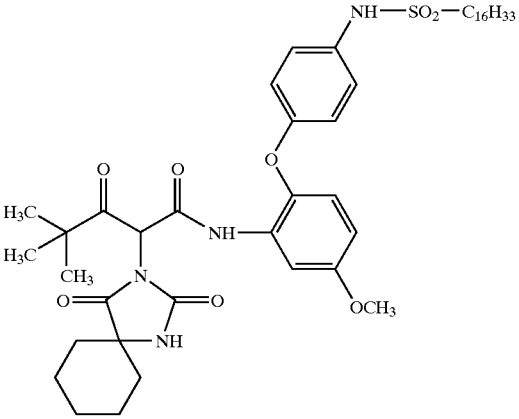
IV-19
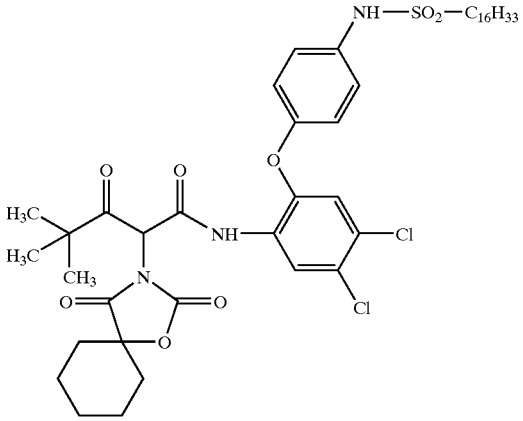
IV-20
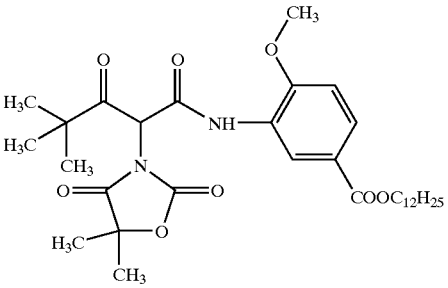

-continued
IV-21
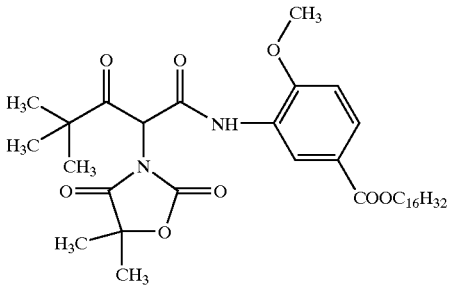
IV-22
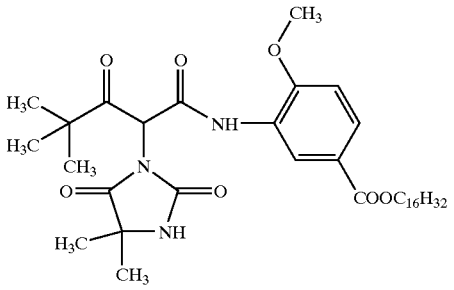
IV-23
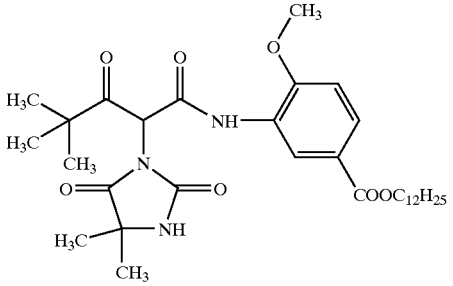
IV-24
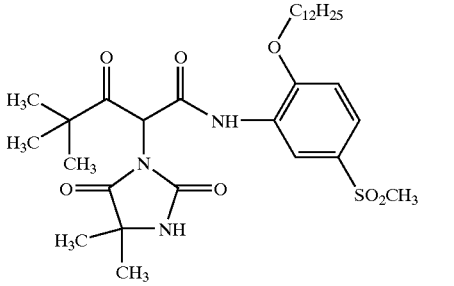
IV-25
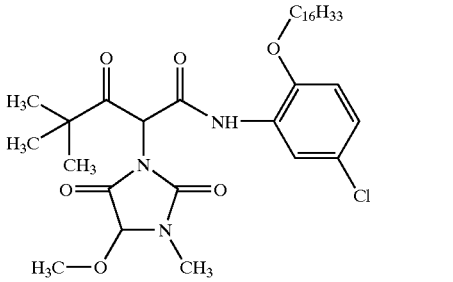
IV-26
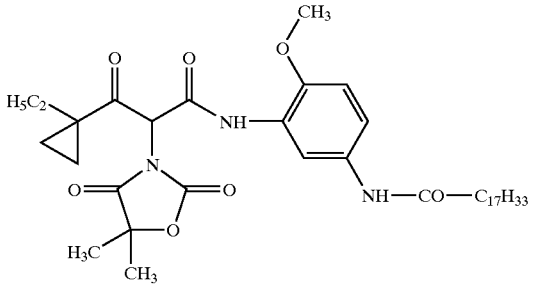
IV-27
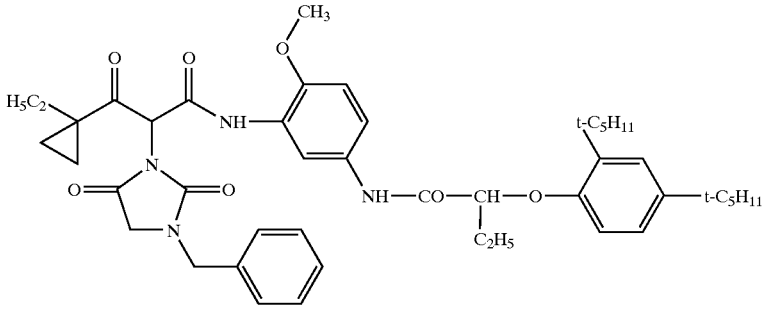
IV-28
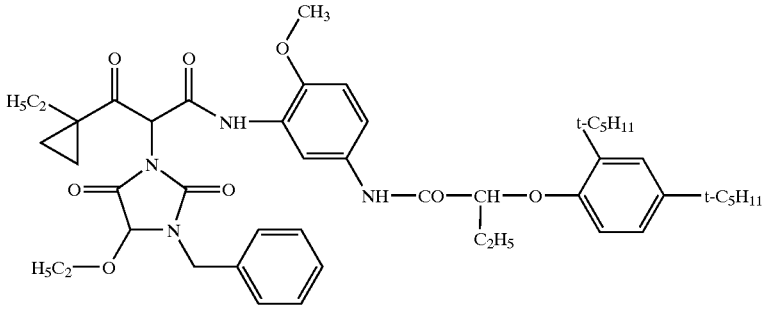

-continued
IV-29
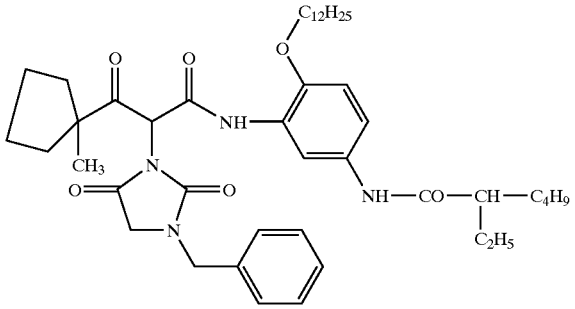
IV-30
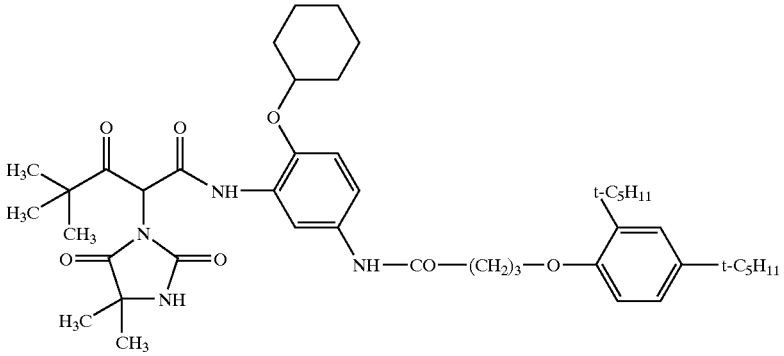
IV-31
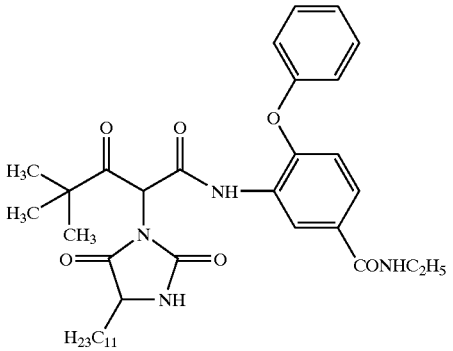
IV-32
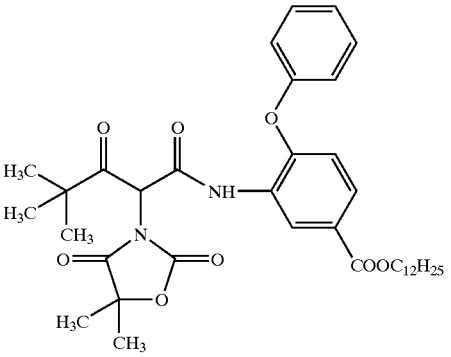
IV-33
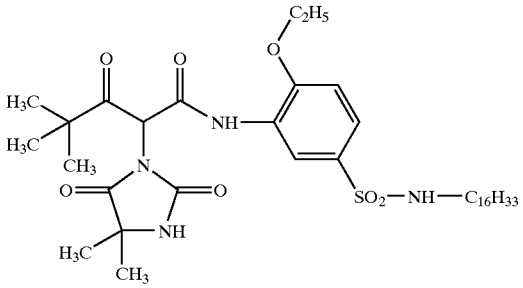
IV-34
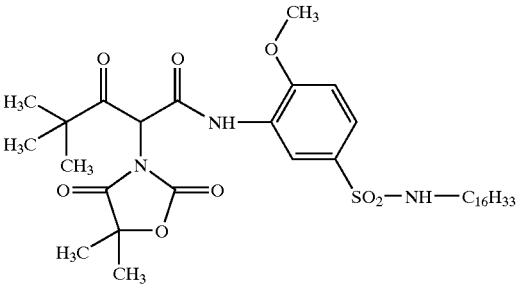
IV-35
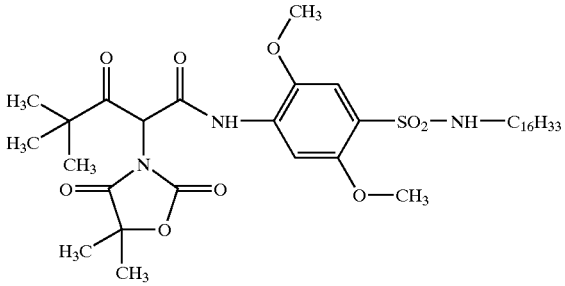

-continued
IV-36
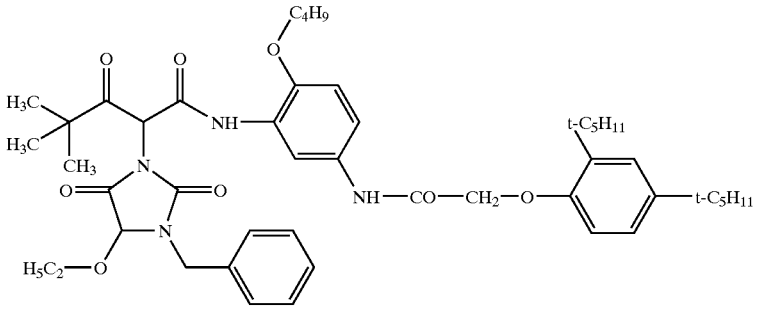
IV-37
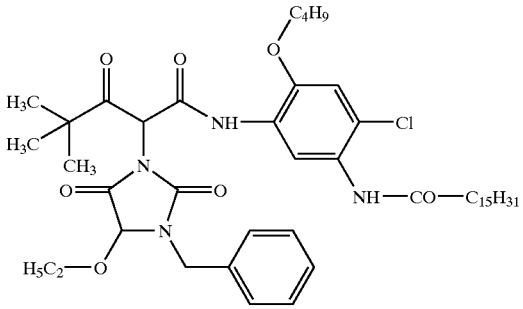
IV-38
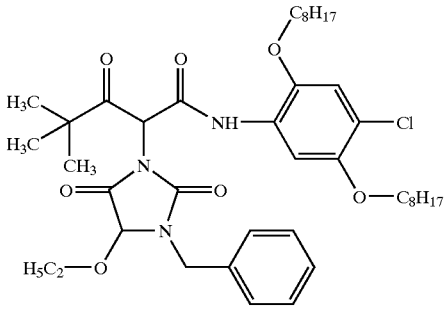
IV-39
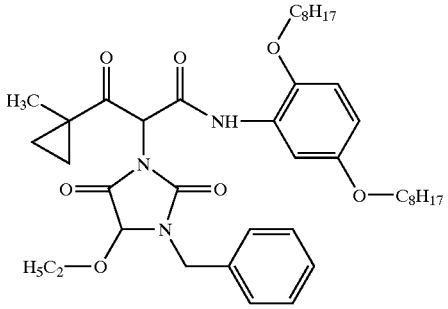
IV-40
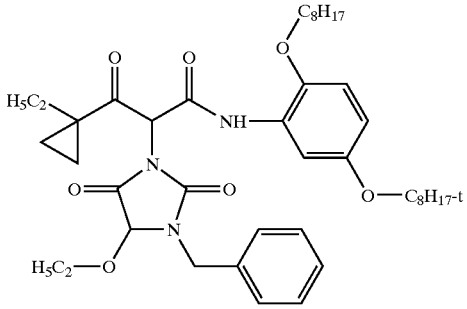
IV-41
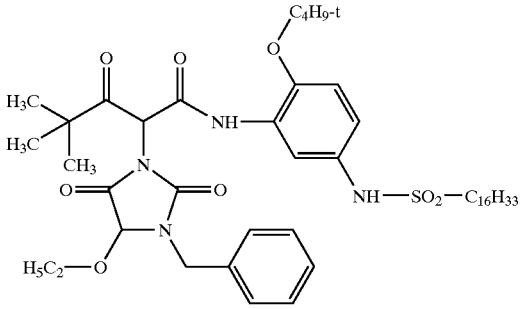
IV-42
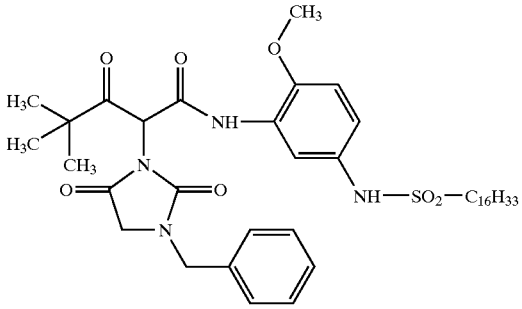
IV-43
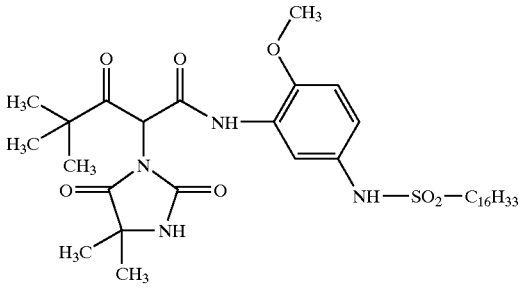
IV-44
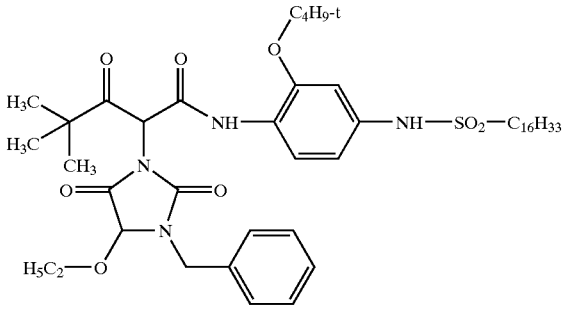

-continued
IV-45
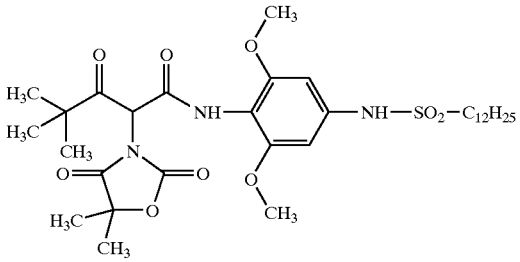
IV-46
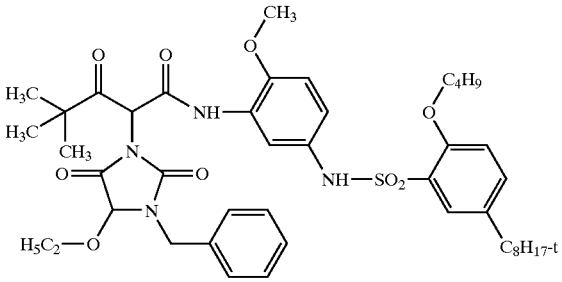
IV-47
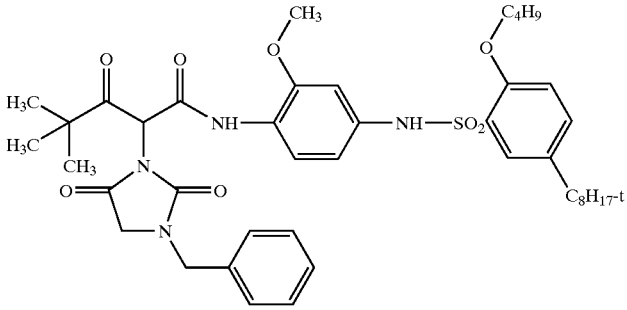
IV-48
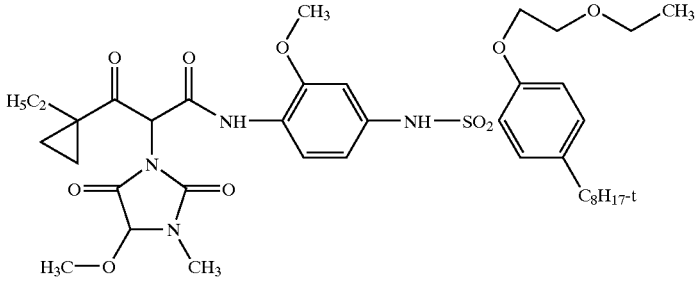
IV-49
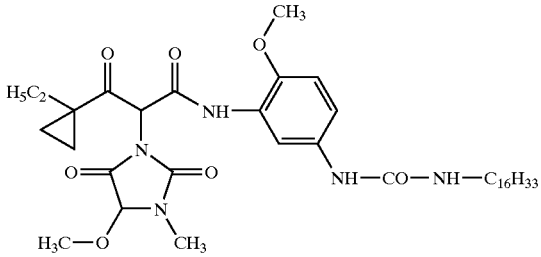
IV-50
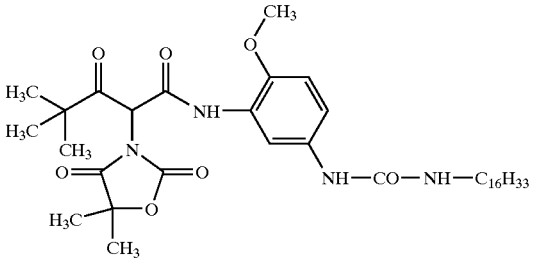
IV-51
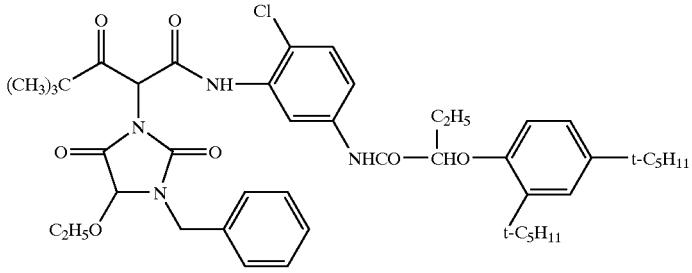

-continued

IV-52

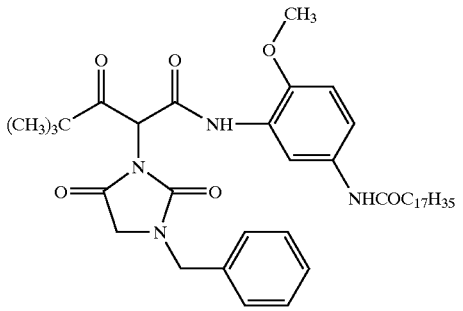

IV-53

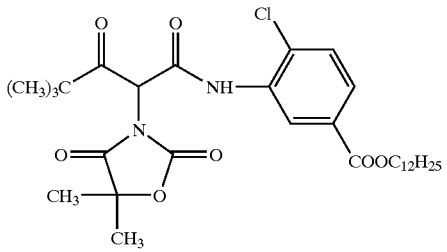

IV-54

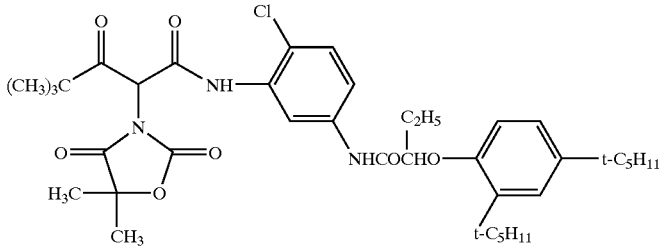

According to a preferred embodiment of the deformable colour photographic silver halide material, according to the present invention, the blue-sensitive silver halide emulsion layer contains a blue sensitizer represented by formula (IX):

(IX)

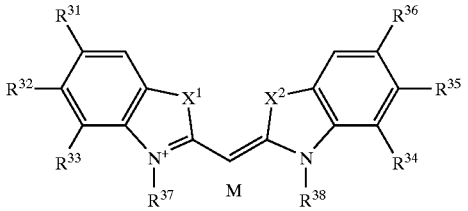

IX-1

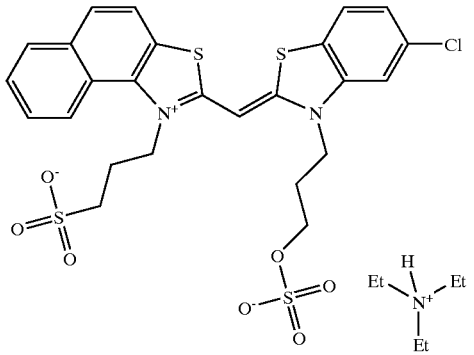

IX-2

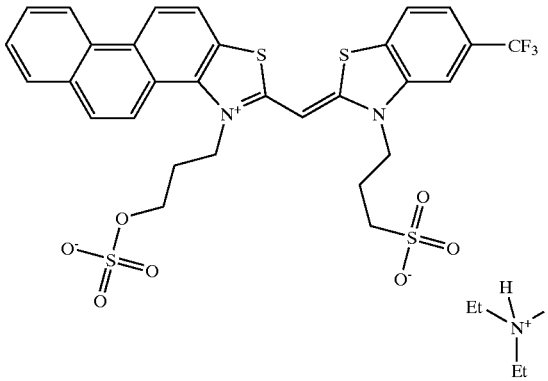

wherein $X^1$ and $X^2$ independently represent S or Se, $R^{31}$ to $R^{36}$ independently represent hydrogen, halogen or an alkyl-, alkoxy, aryl or hetero-aryl group or $R^{31}$ and $R^{32}$; $R^{32}$ and $R^{33}$; $R^{34}$ and $R^{35}$; $R^{35}$ and $R^{36}$ together represent the atoms necessary to form an anellated benzo-, naphtho- or heterocyclic ring, $R^{37}$ and $R^{38}$ independently represent an alkyl-, sulfoalkyl-, carboxyalkyl, —$(CH_2)_1SO_2R^{39}SO_2$-alkyl, —$(CH_2)_1SO_2R^{39}CO$-alkyl, —$(CH_2)_1COR^{39}SO_2$-alkyl or —$(CH_2)_1$—$COR^{39}CO$-alkyl group, $R^{39}$ represents —$N^-$— or —NH—, 1 is a whole number between 1 and 6 and M is an optional counter-ion providing charge compensation.

$R^{31}$ to $R^{36}$ preferably independently represent hydrogen, F, Cl, Br or alkyl, $CF_3$, $OCH_3$ or phenyl groups; or $R^{31}$ and $R^{32}$; $R^{32}$ and $R^{33}$; $R^{34}$ and $R^{35}$; or $R^{35}$ and $R^{36}$ together represent the atoms necessary to form an anellated benzo- or naphtho-ring.

Particularly suitable blue sensitizers include the following compounds, in which "Et" represents Ethyl:

-continued
IX-3
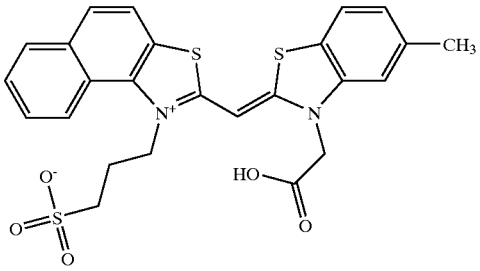
IX-4
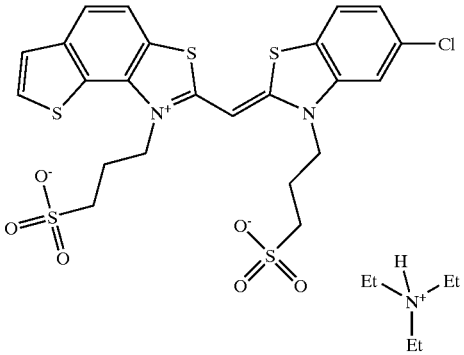
IX-5
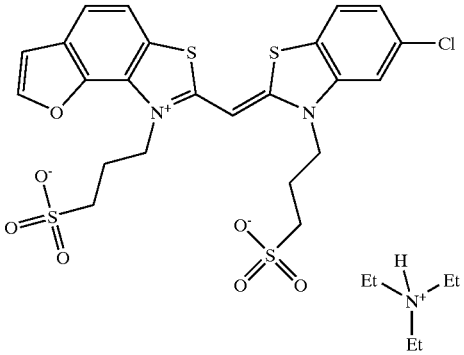
IX-6
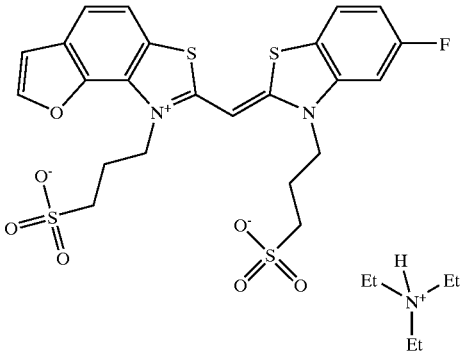
-continued
IX-7
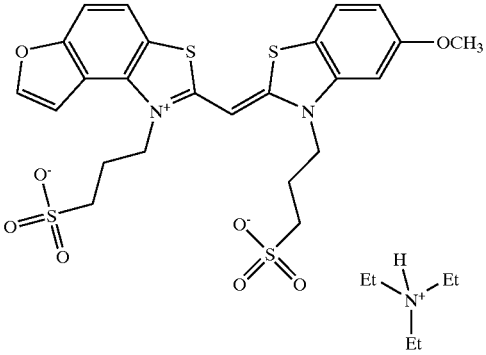
IX-8
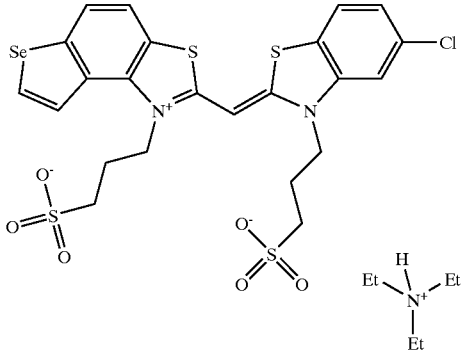
IX-9
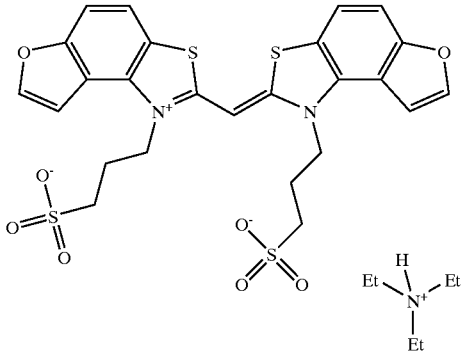
IX-10
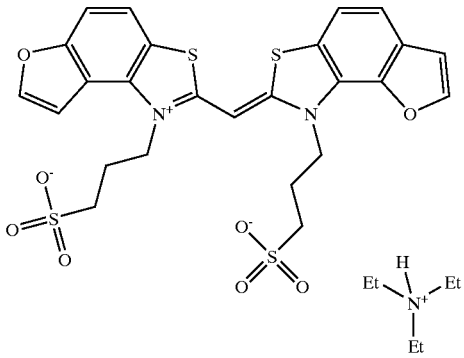

-continued
IX-11
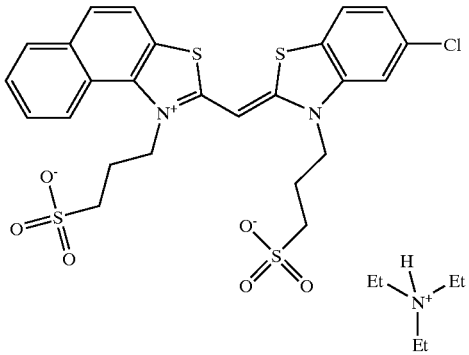
IX-12
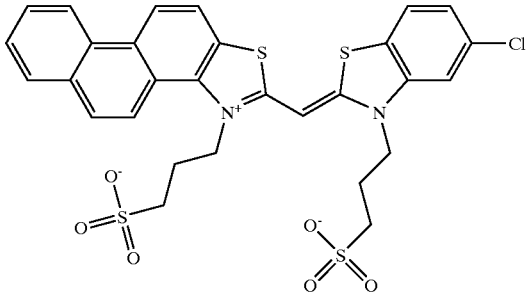
IX-13
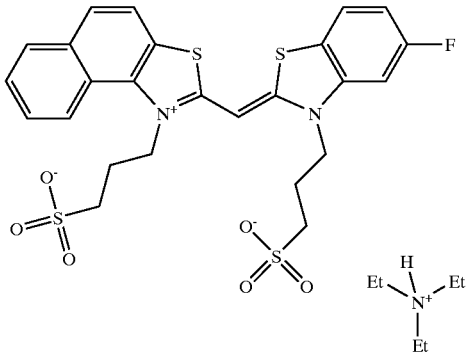
IX-14
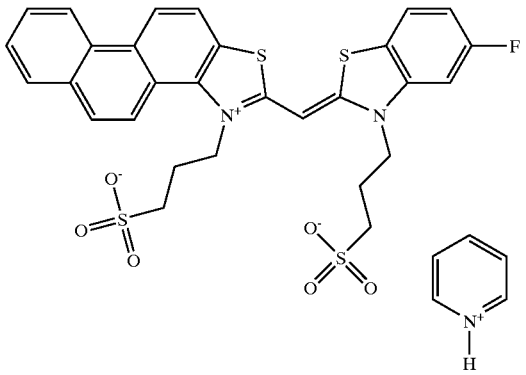
-continued
IX-15
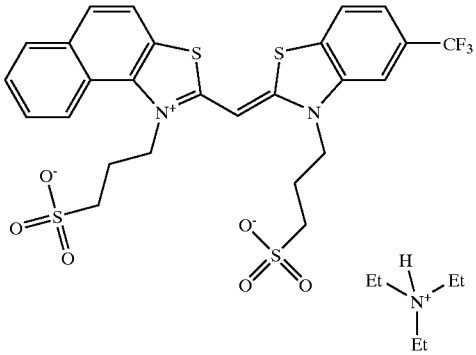
IX-16
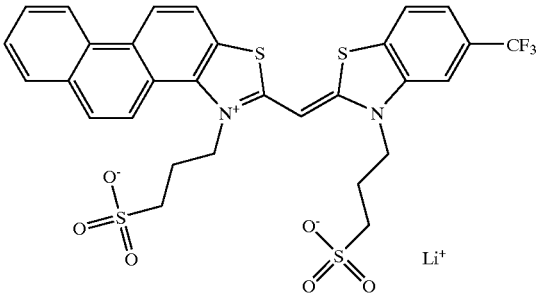
IX-17
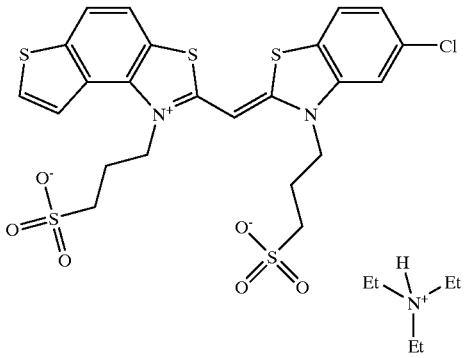
IX-18
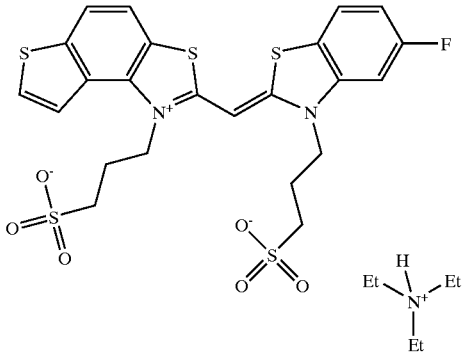

-continued
IX-21
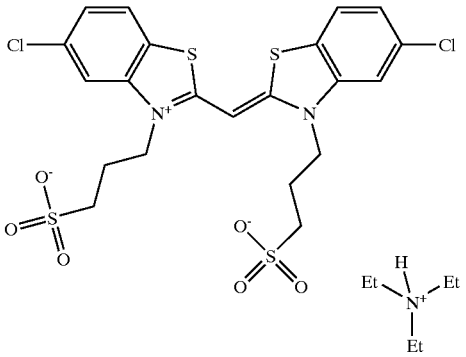
IX-22
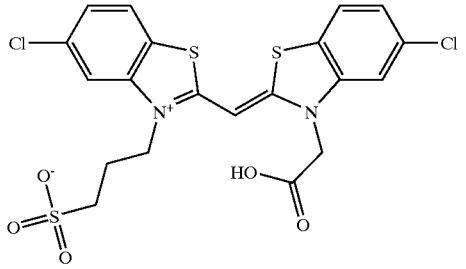
IX-23
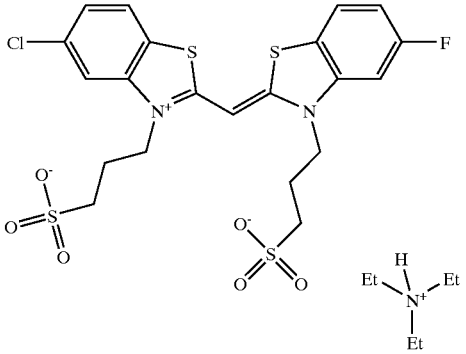
IX-24
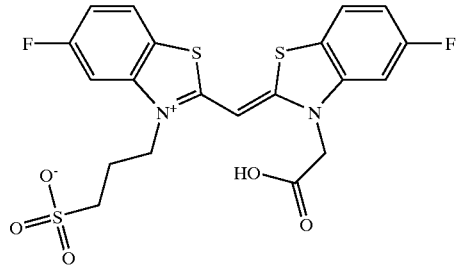
IX-25
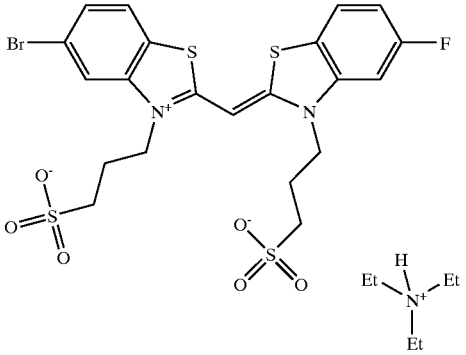
-continued
IX-26
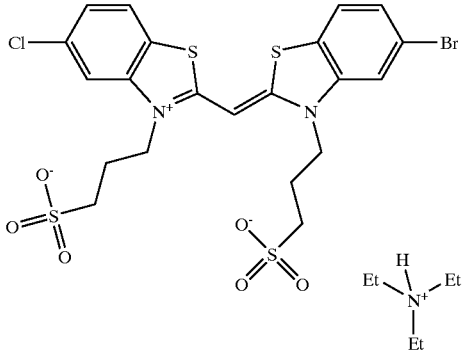
IX-27
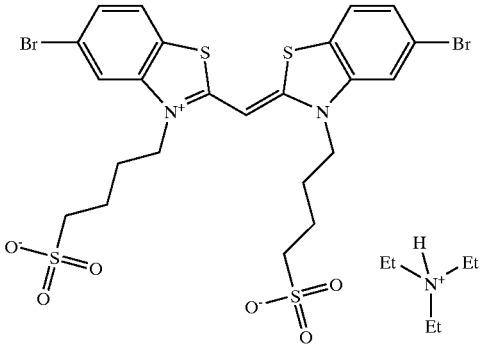
IX-28
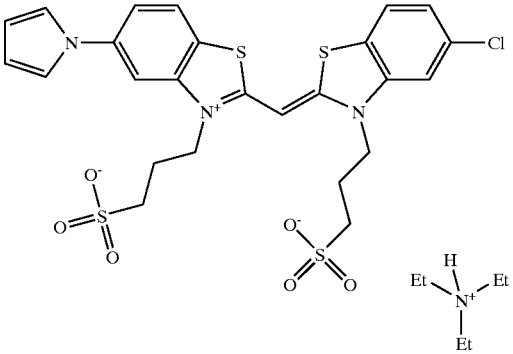
IX-29
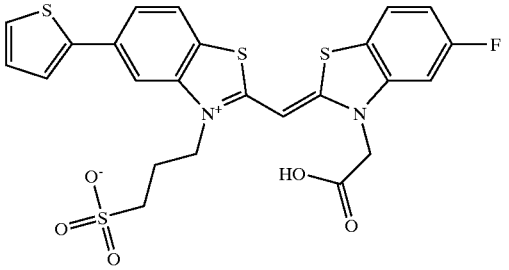

-continued

IX-30

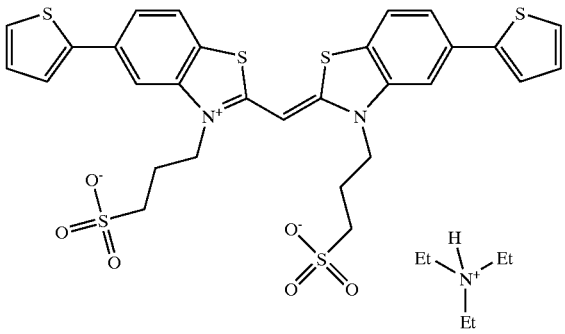

IX-31

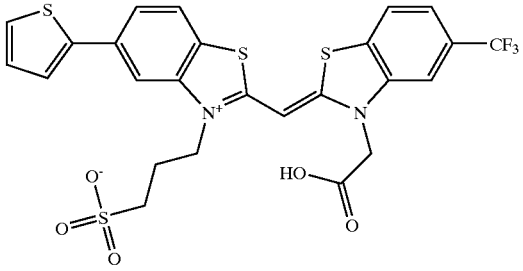

IX-32

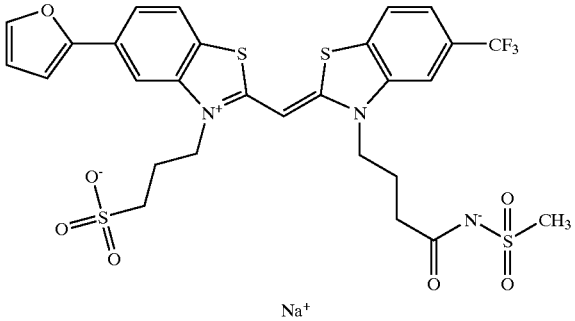

IX-33

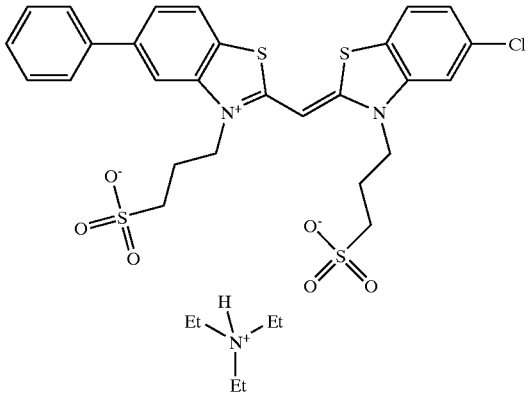

-continued

IX-34

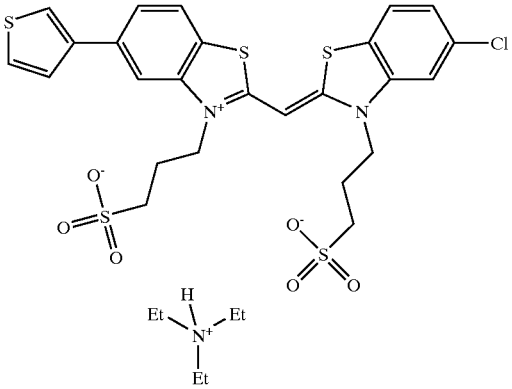

In a preferred embodiment of the present invention, the colour photographic material contains at least one blue-sensitive layer comprising a blue sensitizer according to formula (IX) wherein: $X^1$ and $X^2$ represent S, $R^{35}$ represents a trifluormethyl group or a halogen atom, in particular a chlorine atom, $R^{32}$ and $R^{33}$ together represent the atoms necessary to form an anellated benzo-, naphtho- or heterocyclic ring, particularly an anellated benzo-ring and $R^{37}$ and $R^{38}$ independently represent sulfoalkyl-, carboxyalkyl, —$(CH_2)_1SO_2R^{39}SO_2$-alkyl, —$(CH_2)_1SO_2R^{39}CO$-alkyl-, —$(CH_2)_1COR^{39}SO_2$-alkyl, —$(CH_2)_1$—$COR^{39}CO$-alkyl, particularly sulfoalkyl groups.

Suitable red sensitizers include compounds according to formula (X) and (XI):

(X)

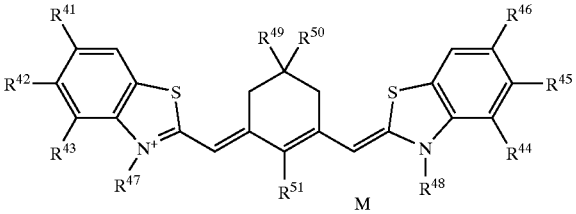

(XI)

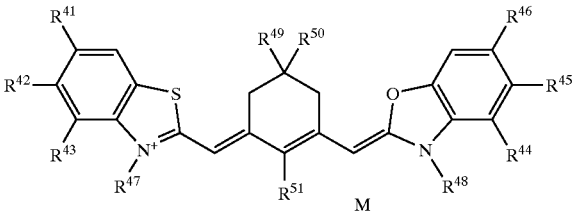

wherein $R^{41}$ to $R^{46}$ independently represent hydrogen, halogen or an alkyl-, alkoxy, aryl or hetero-aryl group; or $R^{41}$ and $R^{42}$; $R^{42}$ and $R^{43}$; $R^{44}$ and $R^{45}$; or $R^{45}$ and $R^{46}$ together represent the atoms necessary to form an anellated benzo-, naphtho- or heterocyclic ring, $R^{47}$ and $R^{48}$ independently represent an alkyl-, sulfoalkyl-, carboxyalkyl, —$(CH_2)_1SO_2YSO_2$-alkyl, —$(CH_2)_1SO_2YCO$-alkyl, —$(CH_2)_1COYSO_2$-alkyl or —$(CH_2)_1$—COYCO-alkyl group, Y represents —$N^-$— or —NH—, $R^{49}$ and $R^{50}$ independently represent a hydrogen atom or an alkyl- or an aryl group, $R^{51}$ represents a hydrogen atom, a halogen atom or an alkyl group and M represents an optional counter-ion providing charge compensation.

$R^{41}$ to $R^{46}$ preferably independently represent hydrogen, F, Cl, Br or alkyl, $CF_3$, $OCH_3$ or phenyl groups; or $R^{41}$ and $R^{42}$; $R^{42}$ and $R^{43}$; $R^{44}$ and $R^{45}$; or $R^{45}$ and $R^{46}$ together represent the atoms necessary to form an anellated benzo- or naphtho-ring.

Examples of red sensitizers are given below, wherein "Et" represents Ethyl:

X-1

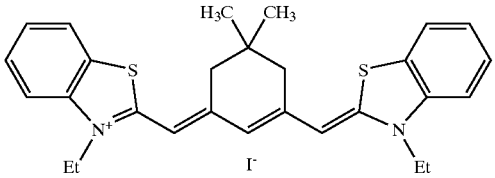

X-2

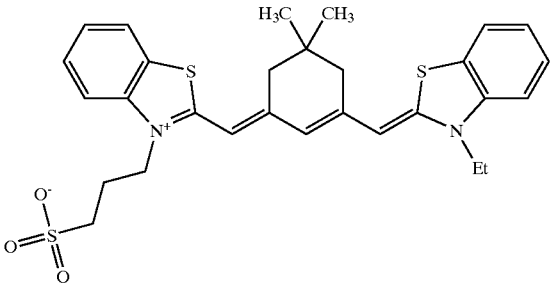

X-3

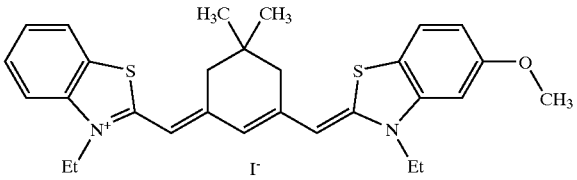

X-4

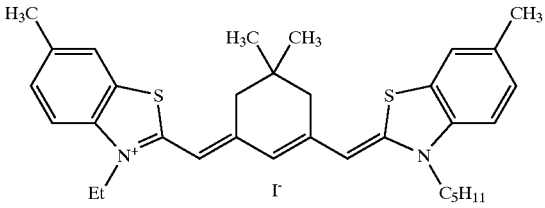

-continued

X-5

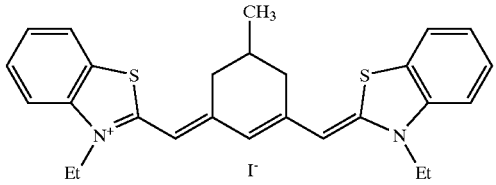

X-6

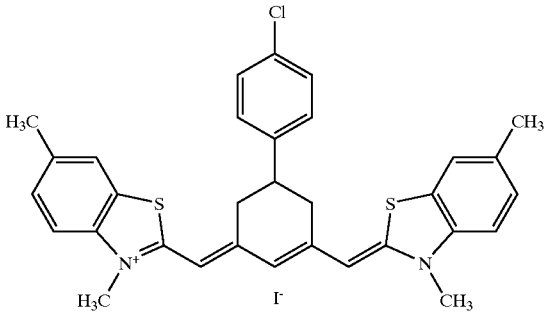

X-7

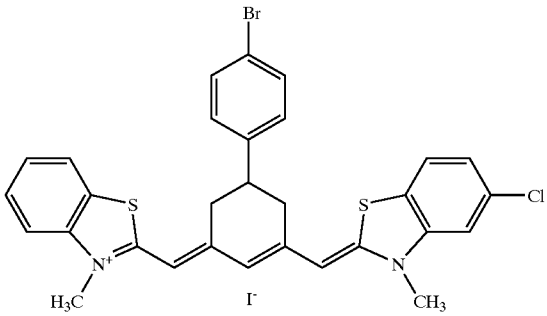

X-8

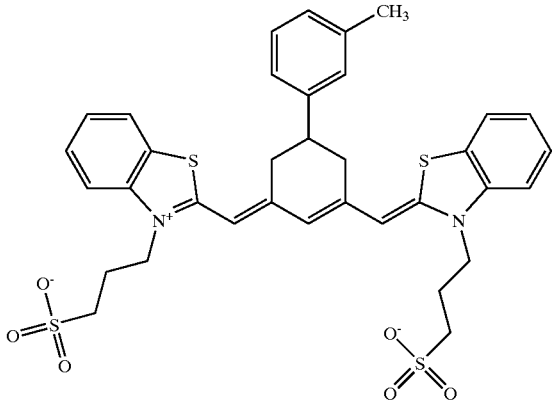

X-9

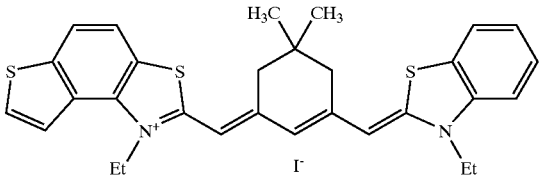

-continued
X-10
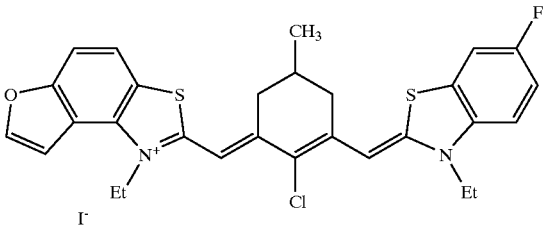
X-11
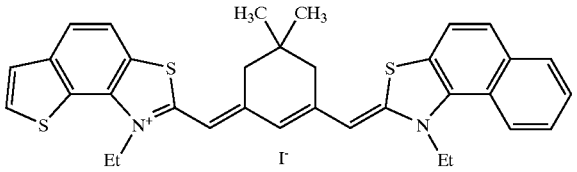
X-12
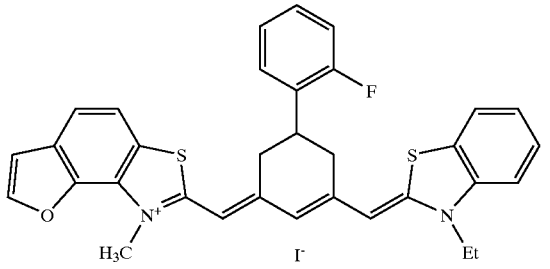
X-13
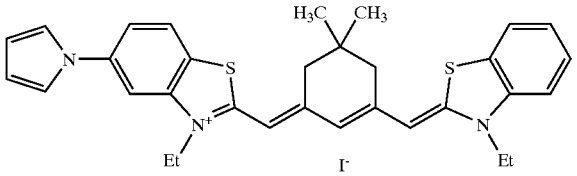
X-14
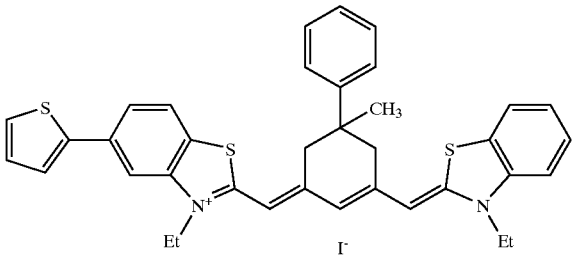
X-15
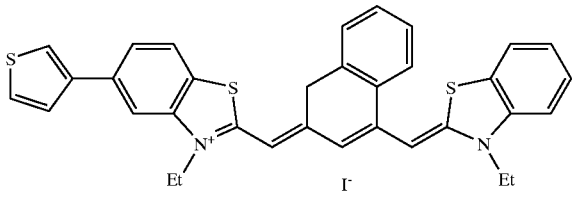
-continued
X-16
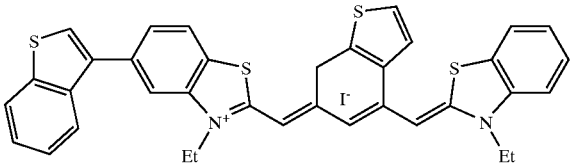
XI-1
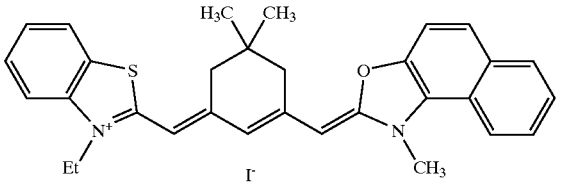
XI-2
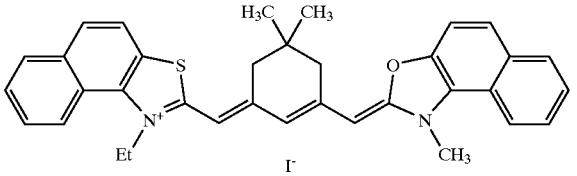
XI-3
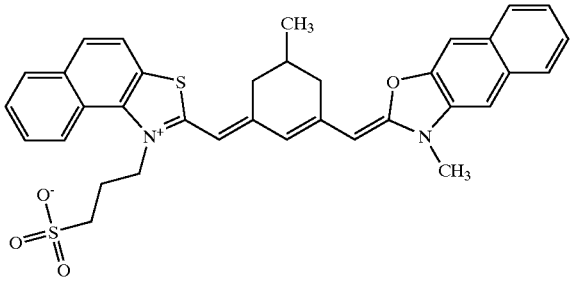
XI-4
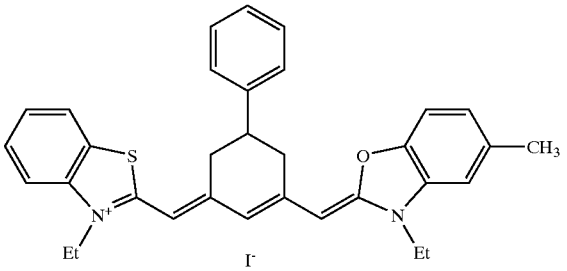
XI-5
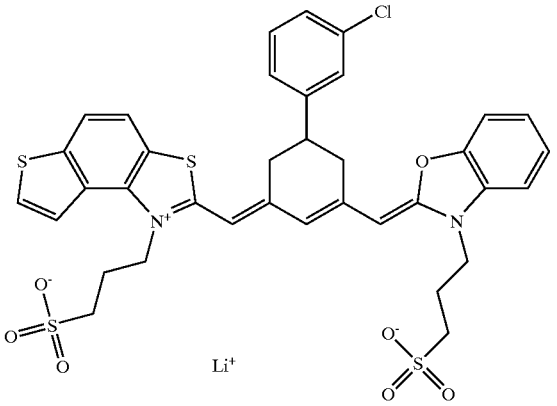

-continued
XI-6
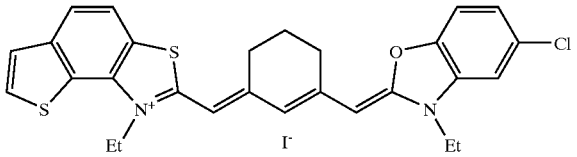
XI-7
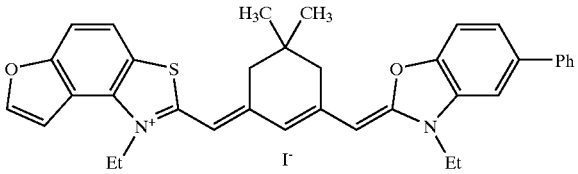
XI-8
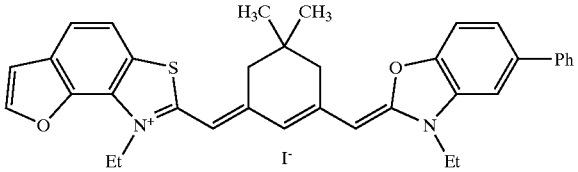
XI-9
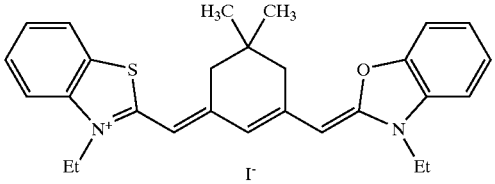
XI-10
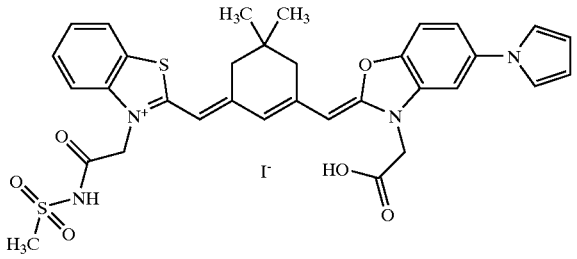
XI-11
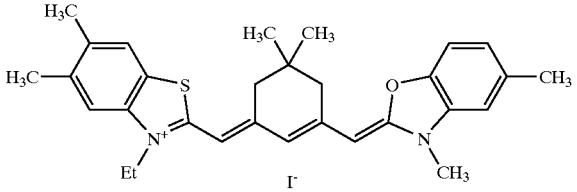
XI-12
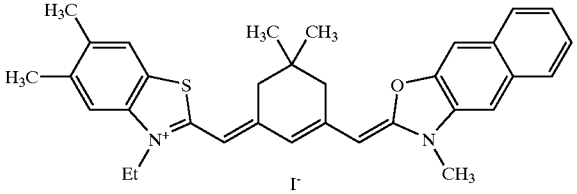
-continued
XI-13
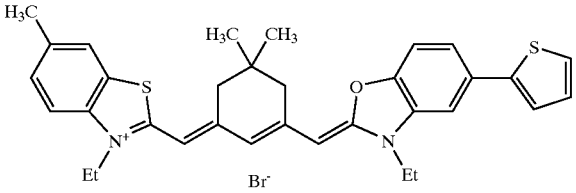
XI-14
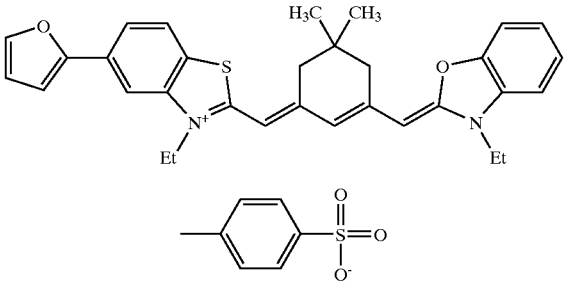
XI-15
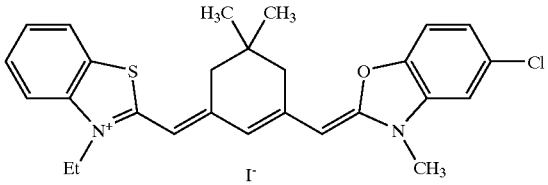
XI-16
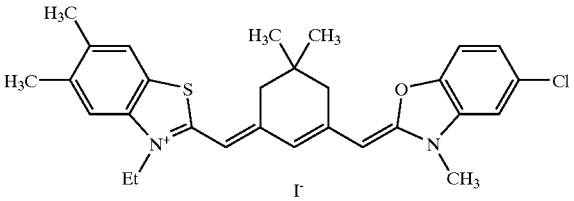
XI-17
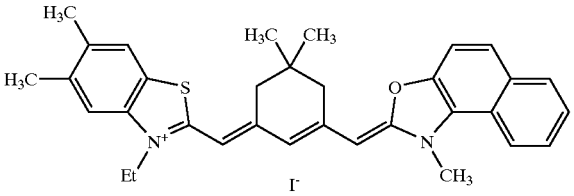
XI-18
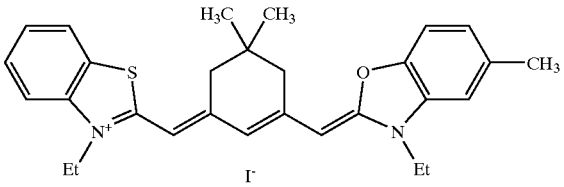
XI-19
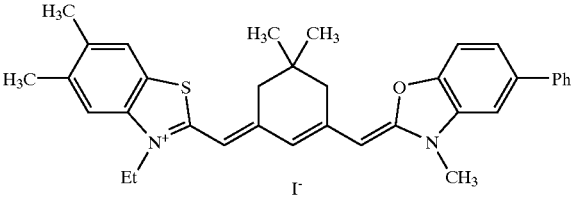

-continued

XI-20

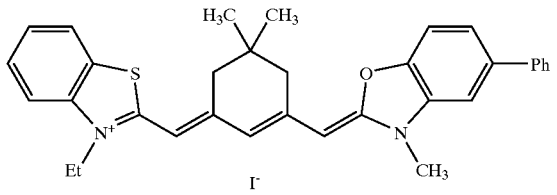

XI-21

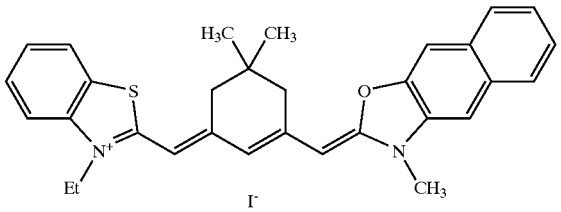

XI-22

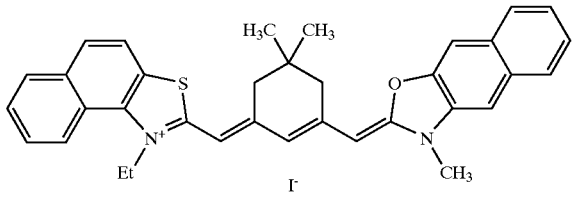

XI-23

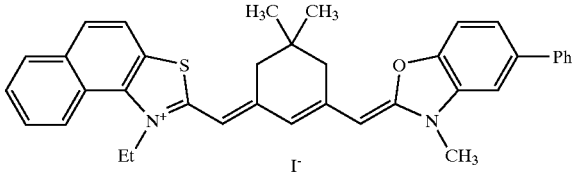

XI-24

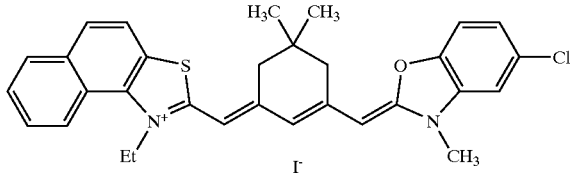

XI-25

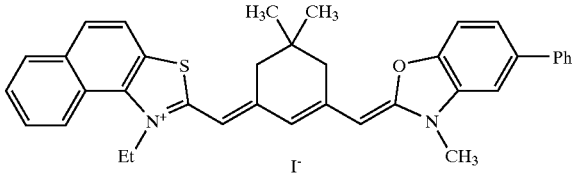

In a further preferred embodiment of the present invention, the deformable colour photographic silver halide material contains a layer containing at least one compound represented by formula (XII)

(XII)

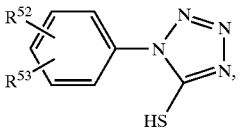

in which $R^{52}$represents H, $CH_3$ or $OCH_3$; $R^{53}$represents H, OH, $CH_3$, $OCH_3$, NHCO—$R^5$, $COOR^{54}$, $SO_2NH_2$, $NHCONH_2$ or NHCONH—$CH_3$; and $R^{54}$ represents a $C_1$–$C_4$-alkyl group. Compounds according to formula (XII) are preferably present in a light-sensitive layer in a quantity of 50 to 5000 mg per kg Ag, particularly preferably in a quantity of 200 to 2000 mg per kg Ag.

Preferred compounds according to formula (XII) are given below:

| | $R^{52}$ | $R^{53}$ |
|---|---|---|
| XII-1 | H | H |
| XII-2 | H | o-$OCH_3$ |
| XII-3 | H | m-$OCH_3$ |
| XII-4 | H | p-$OCH_3$ |
| XII-5 | H | o-OH |
| XII-6 | H | m-OH |
| XII-7 | H | p-OH |
| XII-8 | H | m-$NHCOCH_3$ |
| XII-9 | H | p-$COOC_2H_5$ |
| XII-10 | H | p-COOH |
| XII-11 | H | m-$NHCONH_2$ |
| XII-12 | H | p-$SO_2NH_2$ |
| XII-13 | o-$OCH_3$ | p-$OCH_3$ |
| XII-14 | H | m-$NHCONHCH_3$ |

In a particularly preferred embodiment of the present invention, the colour photographic material contains a compound according to formula (XII) in a blue-sensitive silver halide emulsion layer.

In a preferred embodiment of the present invention, the colour photographic material contains at least one layer containing a compound according to formula (XIII):

(XIII)

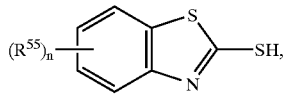

in which $R^{55}$ represents a substituent and n is 1, 2 or 3. Preferably $R^{55}$ represents a polar group, in particular a sulfo group, a sulfonate group, or a substituted or unsubstituted sulfonamido group. The sulfonamido group can be bonded through the S- or the N-aton of the group.

Compounds according to formula (XIII) are preferably present in a red-sensitive silver halide emulsion layer in a quantity of 100 to 5000 mg per kg Ag, particularly preferably in a quantity of 500 to 3000 mg per kg Ag.

Stabilizers according to formula (XIII) are particularly preferred in which $R^{55}$ represents

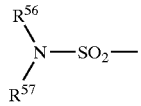

and; $R^{56}$ and $R^{57}$ independently represent H, Cl or $C_1$–$C_4$-alkyl, phenyl or chlorophenyl groups.

Particularly preferred compounds according to formula (XIII) include:

(XIII-1)

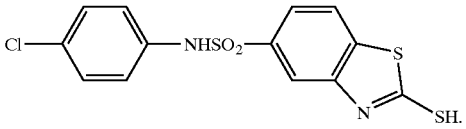

In a particularly preferred embodiment of the present invention, the red-sensitive layer contains at least one compound according to formula (XII) and at least one compound according to formula (XIII).

The main ingredients of photographic emulsion layers are binders, silver halide crystals and colour couplers. Details over suitable binders are to be found in Research Disclosure 37254, part 2 (1995) page 286, herein incorporated by reference.

The mostly hydrophobic colour couplers, as well as other hydrophobic ingredients in the layer, are usually dissolved or dispersed in high boiling point organic solvents. These solutions or dispersions are then emulsified in an aqueous binder solution (usually gelatin) and remain in the layers after drying as fine droplets (0.05 to 0.8 $\mu$m in diameter).

Suitable high boiling point organic solvents, methods for incorporation in the layers of a photographic material and other methods to incorporate chemical compounds in photographic layers are to be found in Research Disclosure 37254, part 6 (1995) page 292, herein incorporated by reference.

The light-insensitive layers generally coated between the light-sensitive layers with different spectral sensitivities can contain ingredients, which hinder undesirable diffusion of developer oxidation products from one light-sensitive layer to another such layer with different spectral sensitization.

Suitable compounds (white couplers, scavengers for developer oxidation products (also called DOP scavengers, Dox scavengers, interlayer scavengers or just scavengers) are to be found in Research Disclosure 37254, part 7 (1995) page 292 and in Research Disclosure 37038, part III, page 84 herein incorporated by reference.

The colour photographic material may further contain UV-light absorbing compounds, brighteners, spacing agents, filter dyes, formaldehyde captors, anti-fading agents, antioxidants, $D_{min}$-dyes, additives to improve the dye, coupler and white image area stability, additives to reduce colour fog, plasticizers (latices), biocides and polyvinylpyrrolidone. Such additives and other additives can be contained in the emulsion and interlayers, but can also be contained in additional layers between the support and emulsion layers and/or on the non-emulsion layer-bearing side of the support. Suitable compounds are to be found in Research Disclosure 37254, part 8 (1995) page 292 and in Research Disclosure 37038, parts IV, V, VI, VII, X, XI and XIII (1995), from page 84 herein incorporated by reference.

The layers of the colour photographic material are usually hardened i.e. the binders used, preferably gelatin, is crosslinked by a suitable chemical process. Immediate or fast hardeners are preferably employed. Suitable immediate and fast hardeners are to be found in Research Disclosure 37254, part 9 (1995), page 294 and in Research Disclosure 37038, part XII (1995), page 86, herein incorporated by reference.

The outermost layers of the photographic material and in particular the outermost layer on the image side can be embossed and/or coloured and/or printed with any kind of design, image or text.

INDUSTRIAL APPLICATION

The process for producing a deformed image, according to the present invention, can be used to apply any kind of representations like images, designs, patterns, letters and so forth to a wide variety of work pieces including pieces of furniture.

The invention is illustrated hereinafter by way of comparative and invention examples. The percentages and ratios given in these examples are by weight unless otherwise indicated.

The following compounds were used in the EXAMPLES:

EST-1

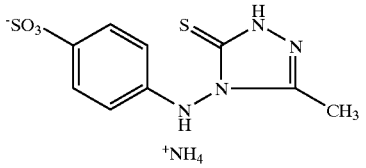

EST-2

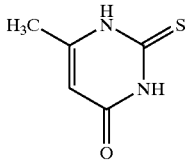

EST-3

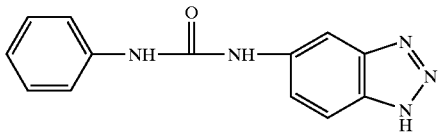

EST-4

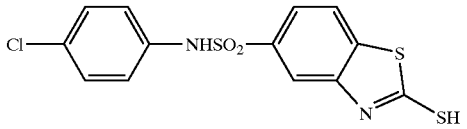

EST-5

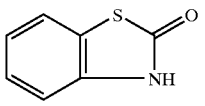

GB-1

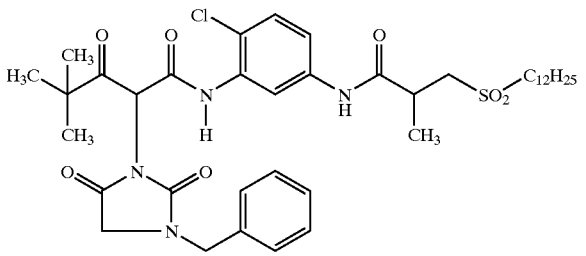

-continued
GB-3
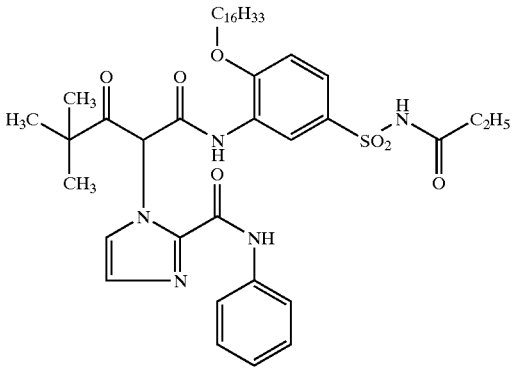
GS-1
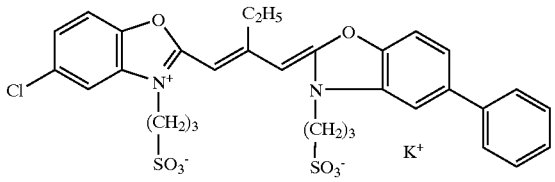
GS-2
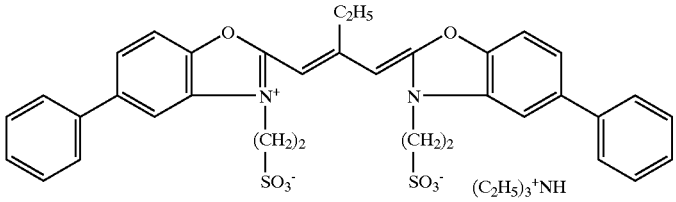
GS-3
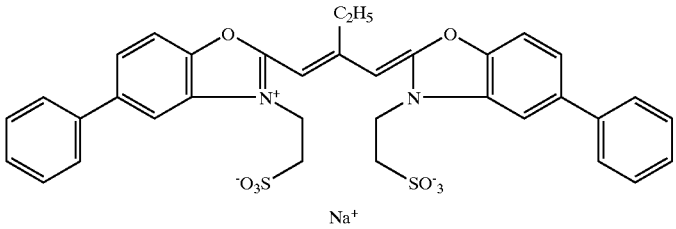
H-1
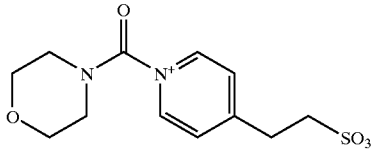
SC-1
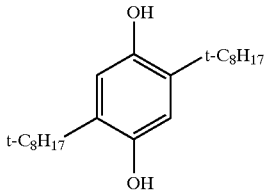
ST-1
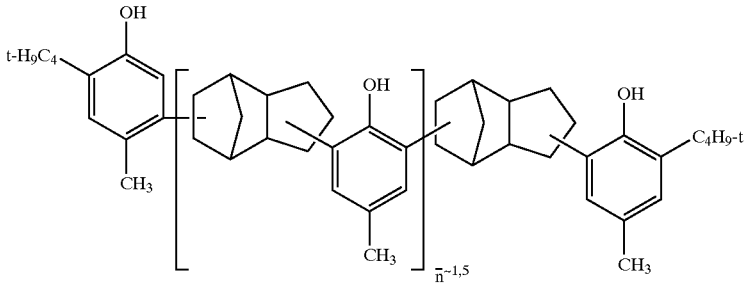
ST-2
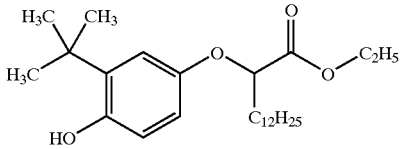
UV-1
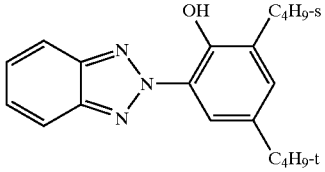

-continued

UV-2

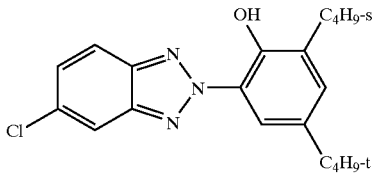

UV-3

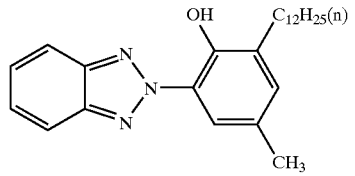

W-1

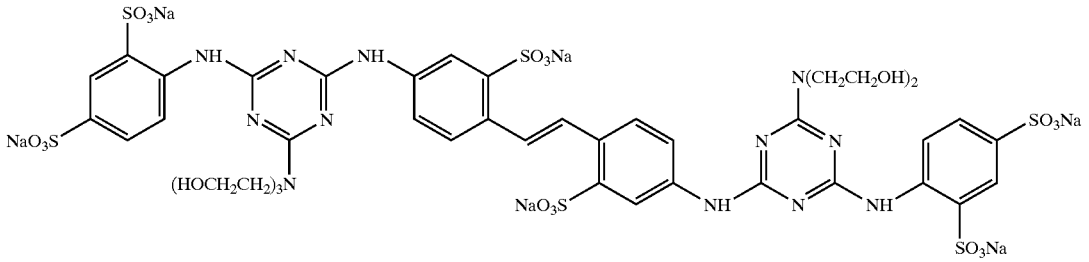

Preparation of Silver Halide Emulsions

Lippmann Emulsion (EmM1):

The following solutions were prepared:

| | | |
|---|---|---|
| Solution 01 | deionized water | 1100 g |
| | gelatin | 140 g |
| | n-decanol | 1 g |
| | NaCl | 4 g |
| Solution 02 | deionized water | 1860 g |
| | NaCl | 360 g |
| Solution 03 | deionized water | 1800 g |
| | $AgNO_3$ | 1000 g |

Solutions 02 and 03 at 40° C. were simultaneously added at a constant rate to Solution 01 in a precipitation vessel at a pAg of 7.7 and a pH of 5.3 with vigorous stirring over a period of 30 minutes. During the precipitation the pAg-value was maintained by adding a sodium chloride solution and the pH maintained by adding dilute sulphuric acid to the precipitation vessel. A silver chloride emulsion was obtained with an average silver chloride grain size of 0.09 μm. The weight ratio of gelatin to silver nitrate was 0.14. The emulsion was then subjected to ultrafitration at 50° C. and redispersed with sufficient gelatin and deionized water to yield a dispersion containing 200 g of silver chloride per kg dispersion, a weight ratio of gelatin to silver nitrate (equivalent to AgX present) of 0.3 and an average silver chloride grain size of 0.13 μm Lippmann Emulsion (EmM2):

Lippmann emulsion EmM2 was prepared as described for EmM1 except that Solution 04 was used instead of Solution 02.

| | | |
|---|---|---|
| Solution 04 | deionized water | 1860 g |
| | NaCl | 324 g |
| | KBr | 73.2 g |
| | $K_2IrCl_6$ | 1420 μg |

The emulsion obtained contained 90 mol % silver chloride, 10 mol % silver bromide and $500\times10^{-9}$ mol $Ir^{4+}$ per mol silver chloride.

Blue-Sensitive Emulsions EmB1B4:

EmB1:

The following solutions were prepared:

| | | |
|---|---|---|
| Solution 11 | deionized water | 1100 g |
| | gelatin | 136 g |
| | n-decanol | 1 g |
| | NaCl | 4 g |
| | EmM1 | 36 g |
| Solution 12 | deionized water | 1860 g |
| | NaCl | 360 g |
| | $K_2IrCl_6$ | 14.2 μg |
| Solution 13 | deionized water | 1800 g |
| | $AgNO_3$ | 1000 g |

Solutions 12 and 13 at 50° C. were simultaneously added to Solution 11 in a precipitation vessel at a pAg of 7.7 with vigorous stirring over a period of 150 minutes. During the precipitation the pAg-value was maintained by adding a sodium chloride solution and a pH of 5.3 was maintained by adding dilute sulphuric acid to the precipitation vessel. The addition rate of both Solutions 12 and 13 was so regulated that in the first 100 minutes it increased linearly from 2 mL/min to 16 mL/min and during the final 50 minutes was held constant at 20 mL/min. A silver chloride emulsion was thereby obtained with an average silver chloride grain size of 0.85 μm. The weight ratio of gelatin to silver nitrate (equivalent to AgX) was 0.14. The emulsion was then subjected to ultrafiltration at 50° C. and redispersed with sufficient gelatin and deionized water to yield a dispersion containing 200 g of silver chloride per kg dispersion and a weight ratio of gelatin to silver nitrate (equivalent to AgX present) of 0.56. The emulsion thereby obtained contained $5\times10^{-9}$ mol $Ir^{4+}$ per mole of silver chloride.

The emulsion was then chemically ripened at a pH of 5.3 with $0.13\times10^{-6}$ mol ammonium tetrachloroaurate and $5.4\times10^{-6}$ mol sodium thiosulphate per mole of silver chloride for 180 minutes at a temperature of 47° C. After chemical ripening the following ingredients were added per mole of silver chloride at 40° C.: 0.32 mmol of the spectral sensitizing compound (IX-21), 0.5 mmol of the stabilizing compound EST-1, 0.5 mmol of the stabilizing compound EST-2 and finally 0.6 mmol of potassium bromide.

EmB2:

The precipitation, desalting and redispersion were carried out as described for EmB1. The emulsion thereby obtained contained $5\times10^{-9}$ mol $Ir^{4+}$ per mole silver chloride.

After chemical ripening at a pH of 5.3 with $0.13\times10^{-6}$ mol ammonium tetrachloroaurate and $5.4\times10^{-6}$ mol sodium thiosulphate per mole of silver chloride for 180 minutes at 47° C., the following ingredients were added per mole of silver chloride at 40° C.: 0.32 mmol of the spectral sensitizing compound (IX-11), 0.5 mmol of the stabilizing compound (XII-8) and finally 0.6 mmol of potassium bromide.

EmB3:

The precipitation, desalting and redispersion were carried out as described for EmB1 except that 9.6 mg mercury(II) chloride was added to solution 12. The emulsion thereby obtained contained $5\times10^{-9}$ mol Ir4+ and $6\times10^{-6}$ mol $Hg^{2+}$ per mole silver chloride.

After chemical ripening at pH of 5.5 with $0.60\times10^{-6}$ mol ammonium tetrachloroaurate and $10.0\times10^{-6}$ mol sodium thiosulphate per mole of silver chloride for 180 minutes at 60° C., the following ingredients were added per mole of silver chloride at 40° C.: 0.32 mmol of the spectral sensitizing compound (IX-11), 0.5 mmol of the stabilizing compound (XII-8) and finally 0.6 mmol of potassium bromide.

EmB4:

The precipitation, desalting and redispersion were carried out as described for EmB1 except that Solution 12 did not contain $K_2IrCl_6$. The emulsion was mixed at 40° C. with 50 g of Lippmann Emulsion EmM2 within 20 minutes before chemical sensitization. The emulsion thereby produced contained 10 mmol silver bromide and $5\times10^{-9}$ mol $Ir^{4+}$ per mole silver chloride, which was localised in the outermost zone (the shell) of the emulsion crystals.

After chemical ripening at a pH of 5.3 with $0.01\times10^{-6}$ mol ammonium tetrachloroaurate and $5.0\times10^{-6}$ mol thiourea per mole of silver chloride for 180 minutes at 45° C., the following ingredients were added per mole of silver chloride at 40° C.: 0.32 mmol of the spectral sensitizing compound (IX-11) and 0.5 mmol of the stabilizing compound (XII-14).

Green-Sensitive Emulsions EmG1-EmG4:

EmG1:

The following solutions were prepared:

| | | |
|---|---|---|
| Solution 21 | deionized water | 1100 g |
| | gelatin | 136 g |
| | n-decanol | 1 g |
| | NaCl | 4 g |
| | EmM1 | 480 g |
| Solution 22 | deionized water | 1860 g |
| | NaCl | 360 g |
| | $K_2IrCl_6$ | 14.2 μg |
| | $RhCl_3.3H_2O$ | 3.8 μg |
| Solution 23 | deionized water | 1800 g |
| | $AgNO_3$ | 1000 g |

Solutions 22 and 23 at 48° C. were simultaneously added to Solution 21 in a precipitation vessel at a pAg of 7.7 with intensive stirring over a period of 75 minutes. During the precipitation the pAg-value was maintained by adding a sodium chloride solution and a pH-value of 5.3 was maintained by adding dilute sulphuric acid to the precipitation vessel. The addition rate of both solutions 22 and 23 was so regulated that in the first 50 minutes it increased linearly from 4 mL/min to 36 mL/min and during the final 25 minutes was held constant at 40 mL/min. A silver chloride emulsion was thereby obtained with an average silver chloride grain size of 0.37 μm. The weight ratio of gelatin to silver nitrate (equivalent to AgX) was 0.14. The emulsion was then subjected to ultrafitration at 50° C., washed and redispersed with sufficient gelatin and deionized water to yield a dispersion containing 200 g of silver chloride per kg dispersion, $5\times10^{-9}$ mol $Ir^{4+}$ and $2.5\times10^{-9}$ mol $Rh^{3+}$ per mol silver chloride and a weight ratio of gelatin to silver nitrate (equivalent to AgX present) of 0.56.

The emulsion was then chemically ripened at a pH of 5.3 with $0.82\times10^{-6}$ mol ammonium tetrachloroaurate and $2.74\times10^{-6}$ mol sodium thiosulphate per mole of silver chloride for 240 minutes at a temperature of 45° C. After chemical ripening the following ingredients were added per mole AgCl at 40° C.: 1.2 mmol of the green sensitizing compound (GS-1), 2.4 mmol of the stabilizing compound EST-3, 1.2 mmol of the stabilizing compound (XII-1) and finally 10 mmol of potassium bromide.

EmG2:

The precipitation, desalting and redispersion were carried out as described for EmG1 except that the amount of EmM1 in Solution 21 was reduced from 480 g to 195 g. After desalting and redispersion the silver chloride crystals had an average diameter of 0.50 μm.

After chemical ripening at a pH of 5.3 with $0.45\times10^{-6}$ mol ammonium tetrachloroaurate and $1.52\times10^{-6}$ mol sodium thiosulphate per mole of silver chloride for 220 minutes at 45° C., the following ingredients were added per mole AgCl at 40° C.: 0.6 mmol of the green sensitizing compound (GS-1), 1.2 mmol of the stabilizing compound (EST-1), 0.6 mmol of the stabilizing compound (XII-1) and finally 10 mmol of potassium bromide.

EmG3:

The precipitation, desalting and redispersion were carried out as described for EmG2. After chemical ripening at pH of 5.5 with $0.95\times10^{-6}$ mol ammonium tetrachloroaurate and $2.35\times10^{-6}$ mol sodium thiosulphate per mole of silver chloride for 220 minutes at 50° C., the following ingredients were added per mole AgCl at 40° C.: 0.6 mmol of the green sensitizing compound (GS-2), 1.2 mmol of the stabilizing compound (XII-8) and finally 10 mmol of potassium bromide.

EmG4:

The precipitation, desalting and redispersion were carried out as described for EmG2 except that Solution 22 did not contain $K_2IrCl_6$.

The emulsion was mixed at 40° C. with 50 g of Lippmann Emulsion EmM2 within 20 minutes before chemical sensitization. The emulsion thereby produced contained 10 mmol silver bromide and $5\times10^{-9}$ mol $Ir^{4+}$ per mole silver chloride, which was localised in the outermost zone of the emulsion crystals.

After chemical ripening at pH of 5.3 with $0.02\times10^{-6}$ mol ammonium tetrachloroaurate and $1.4\times10^{-6}$ mol thiourea per mole silver chloride for 220 minutes at 50° C., the following ingredients were added per mole AgCl at 40° C.: 0.6 mmol of the green sensitizing compound (GS-3) and 1.2 mmol of the stabilizing compound (XII-14).

Red-Sensitive Emulsions EmR1-EmR4:

EmR1:

The precipitation, desalting and redispersion were carried out as described for EmG1. The emulsion was chemically ripened at a pH of 5.3 with $2.2\times10^{-6}$ mol ammonium tetrachloroaurate and $9.0\times10^{-6}$ mol sodium thiosulphate per mole silver chloride for 280 minutes at a temperature of 55° C. After chemical ripening the following ingredients were added per mole AgCl at 40° C.: 150 μmol of the spectral sensitizing compound (X-1), 5.0 mmol of the stabilizing compound EST-4 and finally 10 mmol of potassium bromide.

EmR2:

The precipitation, desalting and redispersion were carried out as described for EmG2. The emulsion was chemically ripened at a pH of 5.3 with $1.2\times10^{-6}$ mol ammonium tetrachloroaurate and $5.0\times10^{-6}$ mol sodium thiosulphate per mole of silver chloride for 256 minutes at a temperature of 55° C. After chemical ripening the following ingredients were added per mole AgCl at 40° C.: 75 μmol of the spectral sensitizing compound (X-1), 2.5 mmol of the stabilizing compound EST-4 and finally 10 mmol of potassium bromide.

EmR3:

The precipitation, desalting and redispersion were carried out as described for EmR2. The emulsion was chemically ripened at a pH of 5.5 with $1.8\times10^{-6}$ mol ammonium tetrachloroaurate and $7.5\times10^{-6}$ mol sodium thiosulphate per mole of silver chloride for 330 minutes at a temperature of 50° C. After chemical ripening the following ingredients were added per mole AgCl at 40° C.: 75 μmol of the spectral sensitizing compound (X-2), 1.2 mmol of the stabilizing compound (XII-8), 0.4 mmol of the stabilizing compound (EST-5) and finally 10 mmol of potassium bromide.

EmR4:

The precipitation, desalting and redispersion were carried out as described for EmG4.

The emulsion was mixed at 40° C. with 50 g of Lippmann Emulsion EmM2 within 20 minutes before chemical sensitization. The emulsion thereby produced contained 10 mmol silver bromide and $5\times10^{-9}$ mol $Ir^{4+}$ per mole silver chloride, which was concentrated in the outermost zone of the emulsion crystals.

The emulsion was chemically ripened at a pH of 5.3 with $0.10\times10^{-6}$ mol ammonium tetrachloroaurate and $6.3\times10^{-6}$ mol thiourea per mole of silver chloride for 300 minutes at a temperature of 50° C. After chemical ripening the following ingredients were added per mole AgCl at 50° C.: 75 μmol of the spectral sensitizing compound (X-4) and 1.2 mmol of the stabilizing compound (XII-14).

EXAMPLE 1

A colour photographic material, suitable for photographic processing, was prepared by coating the following layers in the following order onto a PVC plastic foil. The silver halide coverage is given as equivalent quantities of silver nitrate.

Layer Assembly 101:

Support: 220 μm thick PVC toned white with $TiO_2$ (comprising no plastizisers)—corona pretreated Subbing layer: 0.4 g/m$^2$ gelatin

- 1.5 ml/m$^2$ 40% aqueous dispersion of dispersion D-1
- 6.0 ml/m$^2$ 30% aqueous dispersion of colloidal silica (average particle size 0:025 μm, ph of 8)
- 0.1 ml/m$^2$ 5% aqueous solution of wetting agent Tergitol® 4 (supplied by Niacet Corporation)
- 0.1 g/m$^2$ silane SL-1
- 26.0 g/m$^2$ deionized water Layer 2: (blue-sensitive layer)

- Blue-sensitized silver halide emulsion EmB1 (99,94 mol-% chloride, 0.06 mol-% bromide, average grain size 0.85 μm) equivalent to 0.48 g/m$^2$ $AgNO_3$
- 1.00 g/m$^2$ gelatin
- 0.20 g/m$^2$ yellow coupler GB-1
- 0.40 g/m$^2$ yellow coupler GB-3
- 0.30 g/m$^2$ tricresylphosphate (TKP)
- 0.10 g/m$^2$ stabilizer ST-1

Layer 3: (interlayer)

- 1.00 g/m$^2$ gelatin
- 0.06 g/m$^2$ Dox-scavenger SC-1
- 0.06 g/m$^2$ Dox-scavenger SC-2
- 0.12 g/m$^2$ TKP Layer 4: (green-sensitive layer)

- Green-sensitized silver halide emulsion EmG1 (99 mol-% chloride, 1 mol-% bromide, average grain size 0.37 μm) equivalent to 0.35 g/m$^2$ $AgNO_3$.
- 0.76 g/m$^2$ gelatin
- 0.44 g/m$^2$ magenta coupler XIV-43
- 0.07 g/m$^2$ stabilizer ST-2
- 0.14 g/m$^2$ stabilizer SC-2
- 0.18 g/m$^2$ TKP Layer 5: (UV-protection layer)

- 1.05 g/m$^2$ gelatin
- 0.35 g/m$^2$ UV-Absorber UV-1
- 0.20 g/m$^2$ UV-Absorber UV-2
- 0.13 g/m$^2$ UV-Absorber UV-3
- 0.06 g/m$^2$ Dox-scavenger SC-1
- 0.06 g/m$^2$ Dox-scavenger SC-2
- 0.33 g/m$^2$ TKP Layer 6: (red-sensitive layer)

- Red-sensitized silver halide emulsion EmR1 (99.0 mol-% chloride, 1 mol-% bromide, average grain size 0.37 μm) equivalent to 0.33 g/m$^2$ $AgNO_3$
- 0.81 g/m$^2$ gelatin
- 0.42 g/m$^2$ cyan coupler VII-2
- 0.20 g/m$^2$ TKP
- 0.20 g/m$^2$ dibutyl phthalate Layer 7: (UV-protection layer)

- 0.54 g/m$^2$ gelatin
- 0.35 g/m$^2$ UV-Absorber UV-1
- 0.10 g/m$^2$ UV-Absorber UV-2
- 0.05 g/m$^2$ UV-Absorber UV-3
- 0,15 g/m$^2$ TKP Layer 8: (protective layer)

- 0.90 g/m$^2$ gelatin
- 0.05 g/m$^2$ brightener W-1
- 0.07 g/m$^2$ polyvinylpyrrolidone
- 1.20 ml/m$^2$ silicon oil
- 2.50 mg/m$^2$ spacing agent of poly(methylmethacrylate), average particle size 0.8 μm
- 0.30 g/$^2$ immediate hardening agent H-1

EXAMPLES 2 to 4

The layer assemblies of the colour photographic materials of EXAMPLES 2 to 4 with layer assemblies of 102, 103 and 104 respectively were prepared analogously to that of EXAMPLE 1. The layer assemblies are summarized in Table 1:

TABLE 1

| Layer | Emulsion | | | |
|---|---|---|---|---|
| assembly | Layer 2 | Layer 4 | Layer 6 | Comment |
| 101 | EmB1 | EmG1 | EmR1 | INVENTION EXAMPLE 1 |
| 102 | EmB2 | EmG2 | EmR2 | INVENTION EXAMPLE 2 |
| 103 | EmB3 | EmG3 | EmR3 | INVENTION EXAMPLE 3 |
| 104 | EmB4 | EmG4 | EmR4 | INVENTION EXAMPLE 4 |

Table 2 gives the particle size M*, the type and quantity of doping agent, the stabilizers and sensitizers used in the silver halide emulsion layers given in Table 1. The Hg-, Ir- and Rh-quantities are molar ratios with respect to silver halide.

TABLE 2

| | Emulsions | | | | | |
|---|---|---|---|---|---|---|
| | Layer 2 | | Layer 4 | | Layer 6 | |
| Layer assembly | M* [μm] | Added Ingredients | M* [μm] | Added ingredients | M* [μm] | Added ingredients |
| 101 | 0.85 | $5 \times 10^{-9}$ Ir(IV)<br>EST-1<br>EST-2<br>IX-21 | 0.37 | $5 \times 10^{-9}$ Ir(IV)<br>$2.5 \times 10^{-9}$ Rh(III)<br>EST-3<br>XII-1<br>GS-1 | 0.37 | $5 \times 10^{-9}$ Ir(IV)<br>$2.5 \times 10^{-9}$ Rh(III)<br>EST-4<br>X-1 |
| 102 | 0.85 | $5 \times 10^{-9}$ Ir(IV)<br>XII-8<br>IX-11 | 0.50 | $5 \times 10^{-9}$ Ir (IV)<br>$2.5 \times 10^{-9}$ Rh(III)<br>EST-1<br>XII-1<br>GS-1 | 0.50 | $5 \times 10^{-9}$ Ir(IV)<br>$2.5 \times 10^{-9}$ Rh(III)<br>EST-4<br>X-1 |
| 103 | 0.85 | $5 \times 10^{-9}$ Ir(IV)<br>$6 \times 10^{-6}$ Hg(II)<br>XII-8<br>IX-11 | 0.50 | $5 \times 10^{-9}$ Ir(IV)<br>$2.5 \times 10^{-9}$ Rh(III)<br>XII-8<br>GS-2 | 0.50 | $5 \times 10^{-9}$ Ir(IV)<br>$2.5 \times 10^{-9}$ Rh(III)<br>EST-5<br>XII-8<br>RS-2 |
| 104 | 0.85 | $5 \times 10^{-9}$ Ir(IV)*<br>XII-14<br>IX-11 | 0.50 | $5 \times 10^{-9}$ Ir(IV)*<br>$2{,}5 \times 10^{-9}$ Rh(III)<br>XII-14<br>GS-3 | 0.50 | $5 \times 10^{-9}$ Ir(IV)*<br>$2{,}5 \times 10^{-9}$ Rh(III)<br>XII-14<br>RS-3 |

*Iridium is localized in the outermost zone (shell) of the grain

Chemical processing of photographic materials of EXAMPLES 1 to 4

All the EXAMPLES were processed as follows:

a)developed for 45 s at 350° C. with a colour developer with the following composition:

9.0 g triethanolamine 4.0 g N,N-diethylhydroxylamine 0.05 g diethylenglycol 5.0 g 3-methyl-4-amino-N-ethyl-N-methansulfonamidoethyl-anilin-sulphate 0.2 g potassium sulphite 0.05 g triethylenglycol 22 g potassium carbonate 0.4 g potassium hydroxide 2.2 g ethylendiamine-tetra-acetic acid disodium salt 2.5 g potassium chloride 0.3 g 1,2-dihydroxybenzol-3,4,6-trisulfonic acid trisodium salt made up with water to 1000 mL; pH=10.0 b) bleaching/fixing for 45 s at 35° C. with a bleacher/fixer bath with the following composition:

75 g ammonium thiosulphate 13.5 g sodium hydrogen sulphite 2.0 g ammonium acetate 57 g ethylene-diamine-tetra-acetic acid iron ammonium salt 9.5 g 25% aqueous ammonia made up with acetic acid to 1000 ml; pH=5.5 c)washing with deionized water at 33° C. for 2 minutes d)drying

Evaluation of Sensitometric Properties of Colour Photographic Materials of EXAMPLES 1 to 4

The sensitometric evaluation results are presented in Table 3 in the form of the following parameters:

Dmin : Minimum density of the material without exposure according to X-Rite Status A E: sensitivity×1000 at a density of $D_{min}$+0.6; the light exposure amount log I×t needed to achieve the required density depends on the color filter set between the exposure unit and the material; therefore the sensitivy is given as relativ values Gamma-value G1: threshold gradation×100, i.e. 100 times the slope of the sensitometric curve between a density of $D_{min}$+0.10 and a density of $D_{min}$+0.85

Gamma-value G2: middle gradation×100, i.e. 100 times the slope of the sensitometric curve between a density of $D_{min}$+0.85 and a density of $D_{min}$+1.60

Analogue Exposure:

The sensitometric properties of the colour photographic material upon analogue exposure were determined by exposing it through a graduated grey wedge with a density change per density step of 0.1 with a halogen lamp with a constant exposure (light intensity×time) for exposure times of 0.04 s, 0.82 s, 4.91 s and 76 s.

Digital Exposure:

The sensitometric properties of the colour photographic material upon digital exposure were determined by exposing it with an digital printer with the following technical specifications:

Red laser: wavelength of 683 nm

Green laser: wavelength of 543 nm

Blue laser: wavelength of 458 nm

Optical resolution: 400 dpi

Exposure time: approx. 131 ns per pixel (pixel exposure time)

Number of colour steps attained: 256 per channel

First an area of the sample was so exposed at an pixel exposure time of 131 ns with an intensity I, that the density D after processing was ca. 0.6 (according to X-Rite Status A). Then the light intensity was so reduced or increased that the logarithm of the exposure, log (I×t) was 0.1 lower or 0.1 higher than the previous exposure step. This procedure was followed until in total 29 steps were exposed. The lowest step corresponded to a zero light intensity (Dmin).

TABLE 3

| Layer | Exposure | Relative sensitivity, E | | | G1 | | | G2 | | |
|---|---|---|---|---|---|---|---|---|---|---|
| assembly | time | Y | M | C | Y | M | C | Y | M | C |
| 101 | 131 ns | 1208 | 980 | 962 | 150 | 152 | 156 | 220 | 268 | 290 |
| 101 | 40 ms | 1228 | 1242 | 1244 | 163 | 163 | 171 | 248 | 314 | 372 |
| 101 | 0.82 s | 1201 | 1219 | 1246 | 173 | 175 | 188 | 241 | 356 | 407 |
| 101 | 4.91 s | 1165 | 1149 | 1174 | 170 | 172 | 184 | 327 | 345 | 389 |
| 101 | 76.0 s | 1088 | 989 | 959 | 155 | 155 | 154 | 234 | 312 | 306 |
| 102 | 131 ns | 1012 | 1008 | 1057 | 165 | 168 | 170 | 261 | 275 | 305 |
| 102 | 40 ms | 1220 | 1180 | 1210 | 166 | 173 | 176 | 269 | 286 | 320 |
| 102 | 0.82 s | 1174 | 1135 | 1250 | 174 | 186 | 188 | 307 | 326 | 367 |
| 102 | 4.91 s | 1152 | 1100 | 1246 | 177 | 186 | 193 | 310 | 326 | 380 |
| 102 | 76.0 s | 1132 | 1052 | 1200 | 174 | 180 | 190 | 326 | 328 | 390 |
| 103 | 131 ns | 1094 | 1102 | 1150 | 179 | 175 | 169 | 273 | 280 | 315 |
| 103 | 40 ms | 1225 | 1215 | 1200 | 192 | 181 | 173 | 290 | 304 | 322 |
| 103 | 0.82 s | 1200 | 1210 | 1240 | 197 | 182 | 172 | 300 | 312 | 332 |
| 103 | 4.91 s | 1180 | 1180 | 1240 | 198 | 178 | 173 | 286 | 294 | 331 |
| 103 | 76.0 s | 1125 | 1125 | 1170 | 193 | 168 | 168 | 262 | 268 | 332 |
| 104 | 131 ns | 1200 | 1185 | 1174 | 166 | 163 | 175 | 252 | 281 | 335 |
| 104 | 40 ms | 1350 | 1320 | 1300 | 169 | 165 | 183 | 259 | 290 | 354 |
| 104 | 0.82 s | 1348 | 1330 | 1355 | 171 | 168 | 182 | 270 | 310 | 364 |
| 104 | 4.91 s | 1348 | 1328 | 1366 | 173 | 168 | 183 | 160 | 296 | 364 |
| 104 | 76.0 s | 1347 | 1312 | 1350 | 173 | 167 | 178 | 278 | 312 | 350 |

In digital exposure high sensitivities are not necessary, because commercial laser units have surplus powers. In analog exposure reduction in heat development is desirable and hence the use of lower intensity lamps, which again means that high sensitivities are important. Furthermore, high sensitivities are required for exposing large formats, to reduce the exposure time and thereby increase the productivity.

The results in Table 3 show that all of the colour photographic materials investigated exhibited acceptable performances for digital (131 ns) or long time exposures (76 s).

Layer assemblies 102 and 103, however, possess higher sensitivities for long time exposures than layer configuration 101 and layer configuration 104 exhibited the highest sensitivities.

Higher G1- and G2-values lead to images with higher contrasts and hence to better images. For analog exposure G1-values between 1.7 and 1.9 are preferred and G2-values between 250 and 400. For digital exposure the shoulder gradation G2 should be as high as possible to increase the image quality. However, even when, as in the case of layer configuration 101, the G1- and G2-values fall outside these ranges for analogue exposure, the colour photographic material is still usable although with slightly lower image brilliance.

Layer configurations 102 to 104, on the other hand, are usable without loss in image quality in the whole exposure range and are supremely suitable for both digital and long time exposures.

It has been surprisingly found that the deformable colour photographic recording materials of the present invention are suitable for digital exposure and give high quality images. Particularly good results have been realized with colour photographic materials containing stabilizers according to formula (XII). Furthermore, it has been found advantageous to use blue sensitizers according to formula (IX) and red sensitizers according to formula (X), and in particular to use silver halide emulsions with a higher silver halide grain size.

EXAMPLES 5 to 7

The layer assemblies of the photographic materials of EXAMPLES 5 to 7 with layer assemblies 105, 106 and 107 respectively were prepared analogously to that of EXAMPLE 4 (layer assembly 104) with the difference that the PVC support was replaced by the following supports:

EXAMPLE 5: polyethylene coated paper (photographic support supplied by Schoeller; weight 258 g/m2; 35 g/m2 polyethylene containing about 11% by weight of $TiO_2$ pigments are coated on the front-side (the side the photographic layers are applied to); 28 g/m2 polyethylene are coated on the back-side; and the back-side of the coated paper is provided with an antistatic layer.

EXAMPLE 6: PC foil (175 μm thick; supplied by General Electric)

EXAMPLE 7: PET foil (175 μm thick; longitudinally and laterally stretched); such a foil is commonly used as a support for display materials.

EXAMPLE 8

Layer assembly 108 consisted only of 220 μm thick PVC toned white with $TiO_2$ (comprising no plastizisers)-corona pretreated.

Image Quality and Deformation Test

Layer assemblies 104 to 107 were digitally exposed as described above with an image comprising black characters of varying size (height 3 mm to 10 mm) and chemical processed as described for EXAMPLES 1 to 4.

On layer assembly 108 an image comprising black characters of varying size (height 3 mm to 10 mm) was produced by conventional offset printing.

A transparent PVC sheet of 80 μm precoated on one side with a polyethylene sheet 75 μm thick was laid onto the thus prepared image and laminated with the polyethylene in contact with the topcoat of the image layer of layer assemblies 104 to 108. A roller laminator was used for pressing together the superposed materials at a temperature of 104° C. measured within the sandwich.

After lamination the following deformation test was applied to layer assemblies 104 to 108. A membrane press was used to press the photographic material onto a work-piece that was pretreated with a wood glue and the test was run at a temperature of 95° C. The work-piece in the form of a drawer-front was made of chip-wood and had grooves in the form of half-pipes on its front, the half-pipes having a diameter of 0.8 cm. On deformation, the photographic material lying over the halfpipes is pressed in the halfpipe and thereby stretched. The material is also stretched at the front edges and cornes of the work-piece. At the back-side of the work-piece, overhanging material is cut off. The test pieces were evaluated qualitatively with the following results:

Deformation Results

Layer assembly (104) could easily be deformed and exhibited neither cracks nor micro-cracks.

Layer assembly (105) could not be deformed (exhibited cracks and micro-cracks).

Layer assembly (106) could be deformed, but needed longer then layer assembly 104; it exhibited neither cracks nor micro-cracks.

Layer assembly (107) could not be deformed, (exhibited micro-cracks).

Layer assembly (108) could easily be deformed and exhibited neither cracks nor micro-cracks.

Since layer assemblies (105) and (107) failed the deformation test they were not suitable for the present invention and hence were not further evaluated.

Image Quality Results

The image quality was evaluated with the naked eye by looking at the black characters-in the deformed part of the test pieces. Layer assembly (104) showed no loss in image quality at the deformed parts.

Layer assembly (106) showed minor losses in image quality that were barely visible as a small loss in density (dark grey instead of black) of the characters in the deformed parts.

Layer assembly (108) showed a significant loss in image quality in form of a clearly visible brightening of the characters in the deformed parts. Along the edges and corners grey and even white lines appear within the characters.

From the test results it is evident, that PVC and PC are preferred supports for the photographic material of the present invention. The advantage of PVC is it's ease of deformation. The XXX material (108) gave a poor image quality upon deformation and cannot be used according to the present invention.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A deformable colour photographic silver halide material, said colour photographic silver halide material comprising on a deformable plastic support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler.

2. Material according to claim 1, wherein the silver halide emulsions have an overall silver chloride content of at least 70 mol %.

3. Material according to claim 2, wherein the silver halide emulsions have an overall silver chloride content of at least 98 mol %.

4. Material according to claim 1, wherein the silver halide crystals of at least one silver halide emulsion contains structured crystals with a silver chloride content of at least 70 mol % and with at least two different zones, the outermost zone having a higher molar content of silver bromide than the rest of the crystal.

5. Material according to claim 1, wherein said support is provided with a subbing layer comprising 1.3 to 80% by weight of a proteinaceous colloid, 0 to 85% by weight of colloidal silica and 0 to 30% by weight of a siloxane, which can form a reaction product with said colloidal silica.

6. Material according to claim 5, wherein said subbing layer is provided on the same side of said support as the silver halide emulsion layers.

7. Material according to claim 1, wherein said green-sensitive silver halide emulsion layer and/or said red-sensitive silver halide emulsion layer contain at least one silver halide emulsion with silver halide crystals having an average grain size of at least 0.4 $\mu$m.

8. Material according to claim 1, wherein said silver halide emulsion layers contain one or more binders.

9. Material according to claim 8, wherein said binders in said silver halide emulsion layers are at least 80% by weight gelatin.

10. Material according to claim 1, wherein said colour photographic material contains at least one light-sensitive layer containing a compound represented by formula (XII):

(XII)

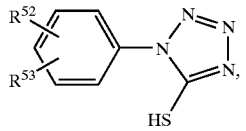

in which $R^{52}$ represents H, $CH_3$ or $OCH_3$; $R^{53}$ represents H, OH, $CH_3$, $OCH_3$, NHCO—$R^{54}$, $COOR^{54}$, $SO_2NH_2$, $NHCONH_2$ or NHCONH—$CH_3$; and $R^{54}$ represents $C_1$–$C_4$-Alkyl.

11. Material according to claim 1, wherein said blue-sensitive silver halide emulsion layer contains a blue sensitizer represented by formula (IX):

(IX)

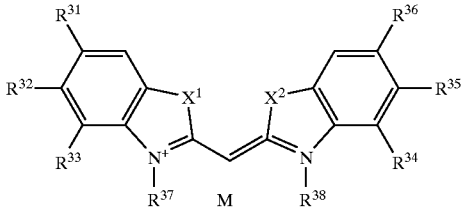

wherein $X^1$ and $X^2$ independently represent S or Se, $R^{31}$ to $R^{36}$ independently represent hydrogen, halogen or an alkyl, alkoxy, aryl or hetero-aryl group or $R^{31}$ and $R^{32}$; $R^{32}$ and $R^{33}$; $R^{34}$ and $R^{35}$; $R^{35}$ and $R^{36}$ together represent the atoms necessary to form an anellated benzo-ring, naphtho-ring or heterocyclic ring, $R^{37}$ and $R^{38}$ independently represent an alkyl-, sulfoalkyl-, carboxyalkyl, $(CH_2)_tSO_2R^{39}SO_2$-alkyl, $(CH_2)_tSO_2R^{39}CO$-alkyl, —$(CH_2)_tCOR^{39}SO_2$-alkyl or —$(CH_2)_t$—$COR^{39}CO$-alkyl group, $R^{39}$ represents —$N^-$— or —NH—, t is a whole number between 1 and 6 and M is an optional counter-ion providing charge compensation.

12. Material according to claim 1, wherein said deformable plastic support is a polycarbonate, poly(vinylchloride), vinylchloride copolymer or a polyester; or a copolyester based on PET.

13. Material according to claim 1, wherein the outermost layer on the image side of said colour photographic material is provided with a protective foil.

14. A process for producing a deformed image comprising the steps of: exposing a deformable colour photographic silver halide material, said colour photographic silver halide material comprising on a deformable plastic support at least one blue-sensitive silver halide emulsion layer containing at least one yellow coupler, at least one green-sensitive silver halide emulsion layer containing at least one magenta coupler and at least one red-sensitive silver halide emulsion layer containing at least one cyan coupler; processing said exposed colour photographic material to produce an image; and deforming said colour photographic material.

15. Process according to claim 14, wherein said deforming step comprises the application of heat and pressure and wherein at least part of the material is elongated.

16. Process according to claim 14, wherein said deforming step comprises deforming said deformable colour photographic material in contact with a work piece.

17. Process according to claim 14, wherein said deformable colour photographic silver halide material is provided with a protective foil before deforming said colour photographic material with a work piece.

18. Process according to claim 14, wherein said deforming step comprises deforming said colour photographic material by vacuum deformation.

19. Process according to claim 14, wherein said deforming step comprises deforming said colour photographic material by injection moulding.

* * * * *

UNITED STATES PATENT AND TRADEMARK OFFICE

CERTIFICATE OF CORRECTION

PATENT NO. : 6,818,390 B2
DATED : November 16, 2004
INVENTOR(S) : Ly Cuong et al.

It is certified that error appears in the above-identified patent and that said Letters Patent is hereby corrected as shown below:

Title page,
Item [73], Assignee, "AGFA-Gevaert" should be -- Agfa-Gevaert --.

Column 113,
Line 27, formula (IX) should be as follows:

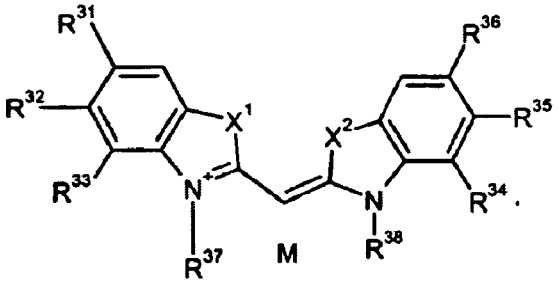

(IX)

Signed and Sealed this

Eleventh Day of April, 2006

JON W. DUDAS
*Director of the United States Patent and Trademark Office*